US005735132A

United States Patent [19]

Sumida et al.

[11] Patent Number: 5,735,132

[45] Date of Patent: Apr. 7, 1998

[54] CONTROL-INFORMATION DETECTING APPARATUS FOR A REFRIGERATION AIR-CONDITIONER USING A NON-AZEOTROPE REFRIGERANT

[75] Inventors: Yoshihiro Sumida; Takashi Okazaki, both of Hyogo; Osamu Morimoto; Tomohiko Kasai, both of Wakayama, all of Japan

[73] Assignee: Mitsubishi Denki Kabushiki Kaisha, Tokyo, Japan

[21] Appl. No.: 779,851

[22] Filed: Jan. 7, 1997

Related U.S. Application Data

[62] Division of Ser. No. 500,551, Jul. 11, 1995, Pat. No. 5,626,026.

[30] Foreign Application Priority Data

Jul. 21, 1994 [JP] Japan ..... 6-169570
Aug. 31, 1994 [JP] Japan ..... 6-207457

[51] Int. Cl.[6] ..... F25B 1/00

[52] U.S. Cl. ..... 62/129; 62/502

[58] Field of Search ..... 62/125, 126, 127, 62/222, 224, 225, 114, 502, 188, 174

[56] References Cited

U.S. PATENT DOCUMENTS

| | | | |
|---|---|---|---|
| 4,217,760 | 8/1980 | Vakil et al. | 62/174 X |
| 5,158,747 | 10/1992 | Manz et al. | 62/125 X |
| 5,214,918 | 6/1993 | Oguni et al. | 62/126 X |
| 5,410,887 | 5/1995 | Urata et al. | 62/129 |

FOREIGN PATENT DOCUMENTS

| | | |
|---|---|---|
| 5-24417 | 4/1993 | Japan . |
| 5-45868 | 7/1993 | Japan . |
| 6-117737 | 4/1994 | Japan . |

*Primary Examiner*—Harry B. Tanner
*Attorney, Agent, or Firm*—Wolf, Greenfield & Sacks, P.C.

[57] ABSTRACT

A control-information detecting apparatus for a refrigeration air-conditioner using a non-azeotrope refrigerant is equipped with a temperature detector and a pressure detector at the refrigerating cycle of the air-conditioner, which cycle is formed by connecting a compressor, a condenser, a decompressing device, and an evaporator, to detect the temperature and the pressure of the refrigerant circulating the cycle for obtaining the circulation composition of the refrigerant with the composition computing unit thereof. The usual optimum operation of the cycle is thereby enabled even if the circulation composition of the refrigerant has changed.

2 Claims, 35 Drawing Sheets

CONTROL-INFORMATION DETECTING APPARATUS FOR A REFRIGERATION AIR-CONDITIONER USING A NON-AZEOTROPE REFRIGERANT

This application is a division of application Ser. No. 08/500,551, filed Jul. 11, 1995, entitled CONTROL-INFORMATION DETECTING APPARATUS FOR A REFRIGERATOION AIR-CONDITIONER USING A NON-AZEOTROPE REFRIGERANT and now U.S. Pat. No. 5,626,026.

BACKGROUND OF THE INVENTION

1. Field of the Invention

This invention relates to a control-information detecting apparatus for a refrigeration air-conditioner using a non-azeotrope refrigerant composed of a high boiling component and a low boiling component. In particular, the invention relates to a control-information detecting apparatus for efficiently operating a refrigeration air-conditioner with high reliability even if the composition of a circulating refrigerant (hereinafter referred to as a circulating composition) has changed to another one different from initially filled one.

2. Description of the Prior Art

FIG. 48 is a block diagram showing the construction of a conventional refrigeration air-conditioner using a non-azeotrope refrigerant illustrated in, for example, Japanese Unexamined Patent Application Published under No. 6546/86 (Kokai Sho-61/6546). In FIG. 48, reference numeral 1 designates a compressor; numeral 2 designates a condenser; numeral 3 designates a decompressing device using an expansion valve; numeral 4 designates an evaporator; and numeral 5 designates an accumulator. These elements are connected in series with a pipe between them, and compose a refrigeration air-conditioner as a whole. The refrigeration air-conditioner uses a non-azeotrope refrigerant composed of a high boiling component and a low boiling component as the refrigerant thereof.

Next, the operation thereof will be described. In the refrigeration air-conditioner constructed as described above, a refrigerant gas having been compressed into a high temperature and high pressure state by the compressor 1 is condensed into liquid by the condenser 2. The liquefied refrigerant is decompressed by the decompressing device 3 to a low pressure refrigerant of two phases of vapor and liquid, and flows into the evaporator 4. The refrigerant is evaporated by the evaporator 4 to be stored in the accumulator 5. The gaseous refrigerant in the accumulator 5 returns to the compressor 1 to be compressed again and sent into the condenser 2. In this apparatus, the accumulator 5 prevents the return to the compressor 1 of a refrigerant in a liquid state by storing surplus refrigerants, which have been produced at the time when the operation condition or the load condition of the refrigeration air-conditioner is in a specified condition.

It has been known that such a refrigeration air-conditioner using a non-azeotrope refrigerant suitable for its objects as the refrigerant thereof has merits capable of obtaining a lower evaporating temperature or a higher condensing temperature of the refrigerant, which could not be obtained by using a single refrigerant, and capable of improving the cycle efficiency thereof. Since the refrigerants such as "R12" or "R22" (both are the codes of ASHRAE: American Society of Heating, Refrigeration and Air Conditioning Engineers), which have conventionally been widely used, cause the destruction of the ozone layer of the earth, the non-azeotrope refrigerant is proposed as a substitute.

Since the conventional refrigeration air-conditioner using a non-azeotrope refrigerant is constructed as described above, the circulation composition of the refrigerant circulating through the refrigerating cycle thereof is constant if the operation condition and the load condition of the refrigeration air-conditioner are constant, and thereby the refrigerating cycle thereof is efficient. But, if the operation condition or the load condition has changed, in particular, if the quantity of the refrigerant stored in the accumulator 5 has changed, the circulation composition of the refrigerant changes. Accordingly, the control of the refrigerating cycle in accordance with the changed circulation composition of the refrigerant, namely the adjustment of the quantity of the flow of the refrigerant by the control of the number of the revolutions of the compressor 1 or the control of the degree of opening of the expansion valve of the decompressing device 3, is required. Because the conventional refrigeration air-conditioner has no means for detecting the circulation composition of the refrigerant, it has a problem that it cannot keep the optimum operation thereof in accordance with the circulation composition of the refrigerant thereof. Furthermore, it has another problem that it cannot operate with high safety and reliability, because it cannot detect the abnormality of the circulation composition of the refrigerant thereof when the circulation composition has changed by the leakage of the refrigerant during the operation of the refrigerating cycle or an operational error at the time of filling up the refrigerant.

SUMMARY OF THE INVENTION

In view of the foregoing, it is an object of the present invention to provide a control-information detecting apparatus for a refrigeration air-conditioner using a non-azeotrope refrigerant, which apparatus, composed in a simple construction, can exactly detect the circulation composition of the refrigerant in the refrigerating cycle of the air-conditioner by computing the signals from a temperature detector and a pressure detector of the apparatus with a composition computing unit thereof even if the circulation composition has changed owing to the change of the operation condition or the load condition of the air-conditioner, or even if the circulation composition has changed owing to the leakage of the refrigerant during the operation thereof or an operational error at the time of filling up the refrigerant.

It is another object of the present invention to provide a control-information detecting apparatus for a refrigeration air-conditioner using a non-azeotrope refrigerant, which apparatus can exactly detect the circulation composition of the refrigerant in the refrigerating cycle of the air-conditioner for operating the refrigerating cycle always in an optimum state by computing the signals from plural temperature detectors and a pressure detector of the apparatus with a composition computing unit thereof even if the circulation composition has changed owing to the change of the operation condition or the load condition of the air-conditioner, or even if the circulation composition has changed owing to the leakage of the refrigerant during the operation thereof or an operational error at the time of filling up the refrigerant.

It is a further object of the present invention to provide a control-information detecting apparatus for a refrigeration air-conditioner using a non-azeotrope refrigerant, which apparatus can exactly detect the circulation composition of the refrigerant in the refrigerating cycle of the air-conditioner by detecting a temperature and a pressure of the refrigerant in the accumulator thereof or a temperature and a pressure of the refrigerant between the accumulator and the suction pipe of the condenser thereof with a temperature detector and a pressure detector of the apparatus respectively and by computing the signals from these detectors with a composition computing unit thereof even if the circulation composition has changed owing to the change of the operation condition or the load condition of the air-conditioner, or even if the circulation composition has changed owing to the leakage of the refrigerant during the operation thereof or an operational error at the time of filling up the refrigerant.

It is a further object of the present invention to provide a control-information detecting apparatus for a refrigeration air-conditioner using a non-azeotrope refrigerant, which apparatus can exactly detect the circulation composition of the refrigerant in the refrigerating cycle of the air-conditioner by providing a liquid level detector for detecting a liquid level in the accumulator thereof even if the circulation composition has changed owing to the change of the operation condition or the load condition thereof, or even if the circulation composition has changed owing to the leakage of the refrigerant during the operation thereof or an operational error at the time of filling up the refrigerant.

It is a further object of the present invention to provide a control-information detecting apparatus for a refrigeration air-conditioner using a non-azeotrope refrigerant, which apparatus can exactly detect the circulation composition of the refrigerant in the refrigerating cycle of the air-conditioner by connecting a pipe of the first heat exchanger thereof and the suction pipe of the compressor thereof with a bypass pipe and by providing a temperature detector and a pressure detector to the bypass pipe and further by computing the signals from these detectors with a composition computing unit of the apparatus even if the circulation composition has changed owing to the change of the operation condition or the load condition of the air-conditioner, or even if the circulation composition has changed owing to the leakage of the refrigerant during the operation thereof or an operational error at the time of filling up the refrigerant.

It is a further object of the present invention to provide a control-information detecting apparatus for a refrigeration air-conditioner using a non-azeotrope refrigerant, which apparatus can detect control information and prevent the energy loss of the air-conditioner by forming a heat exchanging section on a bypass pipe thereof.

It is a further object of the present invention to provide a control-information detecting apparatus for a refrigeration air-conditioner using a non-azeotrope refrigerant, which apparatus can detect control information and make the shape of the air-conditioner compact by exchanging heat between the high pressure side and the low pressure side of the bypass pipe thereof.

It is a further object of the present invention to provide a control-information detecting apparatus for a refrigeration air-conditioner using a non-azeotrope refrigerant, which apparatus can exactly detect the circulation composition of the refrigerant in the refrigerating cycle of the air-conditioner by computing the signals from plural temperature detectors and a pressure detector of the apparatus for detecting temperatures and a pressure of a refrigerant on the low pressure side respectively with a composition computing unit thereof even if the circulation composition has changed owing to the change of the operation condition or the load condition of the air-conditioner, or even if the circulation composition has changed owing to the leakage of the refrigerant during the operation thereof or an operational error at the time of filling up the refrigerant.

It is a further object of the present invention to provide a control-information detecting apparatus for a refrigeration air-conditioner using a non-azeotrope refrigerant, which apparatus can exactly detect a change of the circulation composition of the refrigerant in the refrigerating cycle of the air-conditioner by being provided with a comparison operation means for generating a warning signal when the circulation composition is out of a predetermined range and makes it possible to safely operate the air-conditioner with high reliability, which change has been generated by the leakage of the refrigerant during the operation thereof or an operational error at the time of filling up the refrigerant.

According to the first aspect of the present invention, for achieving the above-mentioned objects, there is provided a control-information detecting apparatus for a refrigeration air-conditioner using a non-azeotrope refrigerant; which apparatus comprises a first temperature detector for detecting the temperature of the refrigerant at the entrance of the evaporator of the air-conditioner, a pressure detector for detecting the pressure of the refrigerant at the entrance of the evaporator, and a composition computing unit for computing the composition of the refrigerant circulating through the refrigerating cycle thereof on the signals respectively detected by the first temperature detector and the pressure detector.

As stated above, the control-information detecting apparatus according to the first aspect of the present invention inputs the pressure and the temperature at the entrance of the evaporator in the refrigerating cycle into the composition computing unit. If the composition computing unit computes a composition of a refrigerant on the assumption that the dryness of the refrigerant flowing into the evaporator is a prescribed value, the apparatus, composed in a simple construction, can detect the change of the circulation composition of the refrigerant for determining the control values to the compressor, the decompressing device, and the like of the air-conditioner in accordance with the composition of the refrigerant. Thereby, the air-conditioner can be controlled in the optimum condition thereof even if the circulation composition has changed.

According to the second aspect of the present invention, there is provided a control-information detecting apparatus for a refrigeration air-conditioner using a non-azeotrope refrigerant; which apparatus comprises a first temperature detector for detecting the temperature of the refrigerant at the entrance of the evaporator of the air-conditioner, a pressure detector for detecting the pressure of the refrigerant at the entrance of the evaporator, a second temperature detector for detecting the temperature of the refrigerant at the exit of the condenser thereof, and a composition computing unit for computing the composition of the refrigerant circulating through the refrigerating cycle on the signals respectively detected by the first temperature detector, the pressure detector and the second temperature detector.

As stated above, the control-information detecting apparatus according to the second aspect of the present invention detects the temperature and the pressure of the refrigerant at the entrance of the evaporator and the temperature of the refrigerant at the exit of the condenser, and computes these detected values with the composition computing unit to output the computed values. Consequently, the apparatus can determine the control values to the compressor, the decompressing device, and the like of the refrigeration air-conditioner in accordance with the circulation composition of the refrigerant. Thereby, the air-conditioner can be controlled in the optimum condition thereof even if the circulation composition has changed.

According to the third aspect of the present invention, there is provided a control-information detecting apparatus for a refrigeration air-conditioner using a non-azeotrope refrigerant; which apparatus comprises a comparison operation means for generating a warning signal when a composition of a refrigerant computed by the composition computing unit thereof is out of a predetermined range, and a warning means operated by the warning signal generated by the comparison operation means.

As stated above, in the control-information detecting apparatus according to the third aspect of the present invention, the comparison operation means generates a warning signal when the composition of the refrigerant detected by the composition computing unit is out of the predetermined range, and the warning means works on the waning signal generated by the comparison operation means. Thereby, when the composition of the refrigerant is out of the prescribed range, the fact can immediately be known.

According to the fourth aspect of the present invention, there is provided a control-information detecting apparatus for a refrigeration air-conditioner using a non-azeotrope refrigerant; which apparatus comprises a temperature detector for detecting the temperature of the refrigerant in the accumulator of the air-conditioner or the temperature of the refrigerant between the accumulator and the suction pipe of the condenser of the air-conditioner, a pressure detector for detecting the pressure of the refrigerant in the accumulator or the pressure of the refrigerant between the accumulator and the suction pipe, and a composition computing unit for computing the composition of the refrigerant circulating through the refrigerating cycle thereof on the signals respectively detected by the temperature detector and the pressure detector.

As stated above, the control-information detecting apparatus according to the fourth aspect of the present invention detects the temperature and the pressure of the refrigerant in the accumulator or the temperature and the pressure of the refrigerant between the accumulator and the suction pipe of the condenser with the temperature detector and the pressure detector thereof respectively. If the composition computing unit computes the composition of the refrigerant on the assumption that the dryness of the refrigerant flowing into the evaporator of the air-conditioner is a prescribed value, the apparatus, composed in a simple construction, can detect the change of the circulation composition of the refrigerant for determining the control values to the compressor, the decompressing device, and the like of the air-conditioner in accordance with the circulation composition. Thereby, the air-conditioner can be controlled in the optimum condition thereof even if the circulation composition has changed.

According to the fifth aspect of the present invention, there is provided a control-information detecting apparatus for a refrigeration air-conditioner using a non-azeotrope refrigerant; which apparatus comprises a liquid level detector for detecting the liquid level in the accumulator of the air-conditioner, and a composition computing unit for computing the composition of the refrigerant circulating through the refrigerating cycle thereof on the signal detected by the liquid level detector.

As stated above, the control-information detecting apparatus according to the fifth aspect of the present invention detects the liquid level in the accumulator with the liquid level detector thereof to input the detected signal into the composition computing unit. If the unit computes the composition of the refrigerant by using the relationships between the liquid levels and the circulation compositions of the refrigerant, which relationships have been investigated previously, the air-conditioner can be controlled in the optimum condition thereof with the simply constructed control-information detecting apparatus even if the circulation composition of the refrigerant has changed.

According to the sixth aspect of the present invention, there is provided a control-information detecting apparatus for a refrigeration air-conditioner using a non-azeotrope refrigerant, which air-conditioner has a bypass pipe connecting the pipe between the first heat exchanger thereof and the first decompressing device thereof to the suction pipe of the compressor thereof with a second decompressing device between them. The apparatus detects the temperature and the pressure of the refrigerant at the exit of the second decompressing device with a first temperature detector and a pressure detector thereof respectively, and computes the composition of the refrigerant circulating through the refrigerating cycle of the air-conditioner on the signals respectively detected by the temperature detector and the pressure detector with the composition computing unit of the apparatus.

As stated above, the control-information detecting apparatus according to the sixth aspect of the present invention computes the composition of the refrigerant by providing the first temperature detector and the pressure detector on the bypass pipe connecting the pipe between the first heat exchanger and the first decompressing device to the suction pipe of the compressor with the second decompressing device between them. Because the downstream side of the second decompressing device is always in a low pressure two-phase state in such a construction, the composition of the refrigerant can be known from the temperatures and the pressures detected by the same temperature detector and the pressure detector in both cases of air cooling and air heating.

According to the seventh aspect of the present invention, there is provided a control-information detecting apparatus for a refrigeration air-conditioner using a non-azeotrope refrigerant; which air-conditioner has a bypass pipe connecting the pipe between the first heat exchanger thereof and the first decompressing device thereof to the suction pipe of the compressor thereof with a second decompressing device between them. The apparatus detects the temperature and the pressure of the refrigerant at the exit of the second decompressing device with a first temperature detector and a pressure detector thereof respectively, and detects the temperature of the refrigerant at the entrance of the second decompressing device with a second temperature detector thereof. The apparatus, then, computes the composition of the refrigerant circulating through the refrigerating cycle of the air-conditioner on the signals respectively detected by the first temperature detector, the pressure detector, and the second temperature detector with the composition computing unit of the apparatus.

As stated above, the control-information detecting apparatus according to the seventh aspect of the present invention computes the composition of the refrigerant by providing the first and the second temperature detectors, and the pressure detector on the bypass pipe connecting the pipe between the first heat exchanger and the first decompressing device to the suction pipe of the compressor with the second decompressing device between them. Because the downstream side of the second decompressing device is always in a low pressure two-phase state in such a construction, the composition of the refrigerant can be known from the temperatures and the pressures detected by the same temperature detector and the pressure detector in both cases of air cooling and air heating.

According to the eighth aspect of the present invention, there is provided a control-information detecting apparatus for a refrigeration air-conditioner using a non-azeotrope refrigerant, which air-conditioner has a bypass pipe provided with a heat exchanging section for exchanging heat between the bypass pipe and a pipe between the first heat exchanger thereof and the first decompressing device thereof.

As stated above, the control-information detecting apparatus according to the eighth aspect of the present invention can be applied to the refrigeration air-conditioner that can prevent energy loss by forming the heat exchanging section on the bypass pipe to convey the enthalpy of the refrigerant flowing in the bypass pipe to the refrigerant flowing the main pipe.

According to the ninth aspect of the present invention, there is provided a control-information detecting apparatus for a refrigeration air-conditioner using a non-azeotrope refrigerant; which air-conditioner has a bypass pipe for connecting the high pressure side extending from the exit of the compressor thereof through the first decompressing device thereof to the low pressure side extending from the first decompressing device through the entrance of the compressor with a second decompressing device between them, and a cooling means for cooling the non-azeotrope refrigerant flowing from the high pressure side of the bypass pipe into the second decompressing device. The apparatus detects the temperature and the pressure of the refrigerant on the low pressure side at the exit of the second decompressing device with the first temperature detector and the pressure detector thereof respectively. The apparatus, then, computes the composition of the refrigerant circulating through the refrigerating cycle of the air-conditioner on the signals respectively detected by the first temperature detector and the pressure detector with the composition computing unit thereof.

As stated above, the control-information detecting apparatus according to the ninth aspect of the present invention computes the composition of the refrigerant circulating through the refrigerating cycle of the air-conditioner on the signals having been detected by the temperature detector and the pressure detector of the apparatus for exactly detecting the circulation composition even if the composition has changed owing to the change of the operation condition or the load condition thereof, or even if the composition has changed owing to the leakage of the refrigerant during the operation thereof or an operational error at the time of filling up the refrigerant.

According to the tenth aspect of the present invention, there is provided a control-information detecting apparatus for a refrigeration air-conditioner using a non-azeotrope refrigerant, which air-conditioner is provided with a cooling means for cooling the non-azeotrope refrigerant flowing from the high pressure side of the bypass pipe thereof into the second decompressing device thereof. The cooling means is constructed so as to exchange heat between the high pressure side and the low pressure side of the bypass pipe.

As stated above, the control-information detecting apparatus according to the tenth aspect of the present invention can be applied to the refrigeration air-conditioner shaped in a compact form by employing the method of exchanging heat between the high pressure side and the low pressure side of the bypass pipe thereof for cooling the bypass pipe.

According to the eleventh aspect of the present invention, there is provided a control-information detecting apparatus for a refrigeration air-conditioner using a non-azeotrope refrigerant; which air-conditioner has a bypass pipe connecting the high pressure side extending from the exit of the compressor thereof through the first decompressing device thereof to the low pressure side extending from the first decompressing device through the entrance of the compressor with a second decompressing device between them, and a cooling means for cooling the non-azeotrope refrigerant flowing from the high pressure side of the bypass pipe into the second decompressing device. The apparatus detects the temperature and the pressure of the refrigerant on the low pressure side at the exit of the second decompressing device with the first temperature detector and the pressure detector thereof respectively, and detects the temperature of the refrigerant on the high pressure side at the entrance of the second decompressing device with the second temperature detector thereof. The apparatus, then, computes the composition of the refrigerant circulating through the refrigerating cycle of the air-conditioner on the signals respectively detected by the first and the second temperature detectors and the pressure detector with the composition computing unit thereof.

As stated above, the control-information detecting apparatus according to the eleventh aspect of the present invention computes the composition of the refrigerant circulating through the refrigerating cycle of the air-conditioner on the signals having been detected by the first and the second temperature detectors and the pressure detector with the composition computing unit for exactly detecting the circulation composition even if the circulation composition has changed owing to the change of the operation condition or the load condition thereof, or even if the circulation composition has changed owing to the leakage of the refrigerant during the operation thereof or an operational error at the time of filling up the refrigerant.

According to the twelfth aspect of the present invention, there is provided a control-information detecting apparatus for a refrigeration air-conditioner using a non-azeotrope refrigerant; which air-conditioner has a bypass pipe connecting the high pressure side extending from the exit of the compressor thereof through the first decompressing device thereof to the low pressure side extending from the first decompressing device through the entrance of the compressor with a second decompressing device between them, and a cooling means for cooling the non-azeotrope refrigerant flowing from the high pressure side of the bypass pipe into the second decompressing device. The apparatus detects the temperatures of the refrigerant on the high pressure side of the bypass pipe with the three temperature detectors or more thereof, and detects the pressure of the refrigerant on the high pressure side of the bypass pipe with the pressure detector thereof. The apparatus, then, computes the composition of the refrigerant circulating through the refrigerating cycle of the air-conditioner on the signals respectively detected by the three temperature detectors or more and the pressure detector with the composition computing unit thereof.

As stated above, the control-information detecting apparatus according to the twelfth aspect of the present invention computes the composition of the refrigerant circulating through the refrigerating cycle on the signals having been detected by the three temperature detectors or more and the pressure detector respectively for exactly detecting the circulation composition even if the circulation composition has changed owing to the change of the operation condition or the load condition of the air-conditioner, or even if the circulation composition has changed owing to the leakage of the refrigerant during the operation thereof or an operational error at the time of filling up the refrigerant.

According to the thirteenth aspect of the present invention, there is provided a control-information detecting apparatus for a refrigeration air-conditioner using a non-azeotrope refrigerant; which air-conditioner has a bypass pipe connecting the high pressure side extending from the exit of the compressor thereof through the first decompressing device thereof to the low pressure side extending from the first decompressing device through the entrance of the compressor with a second decompressing device between them, and a heat exchanging section for exchanging heat between the high pressure side and the low pressure side of the bypass pipe. The apparatus detects the temperatures of the refrigerant on the low pressure side of the bypass pipe with the three temperature detectors or more thereof, and detects the pressure of the refrigerant on the low pressure side of the bypass pipe with the pressure detector thereof. The apparatus, then, computes the composition of the refrigerant circulating through the refrigerating cycle of the air-conditioner on the signals respectively detected by the three temperature detectors or more and the pressure detector with the composition computing unit thereof.

As stated above, the control-information detecting apparatus according to the thirteenth aspect of the present invention computes the circulation composition on the signals having been detected by the three temperature detectors or more and the pressure detector respectively for exactly detecting the circulation composition even if the circulation composition has changed owing to the change of the operation condition or the load condition of the air-conditioner, or even if the circulation composition has changed owing to the leakage of the refrigerant during the operation thereof or an operational error at the time of filling up the refrigerant.

The above and further objects and novel features of the present invention will more fully appear from the following detailed description when the same is read in connection with the accompanying drawings. It is to be expressly understood, however, that the drawings are for purpose of illustration only and are not intended as a definition of the limits of the invention.

DETAILED DESCRIPTION OF THE PREFERRED EMBODIMENTS

Preferred embodiments of the present invention will now be described in detail with reference to the accompanying drawings.

EMBODIMENT 1

Figure 1:
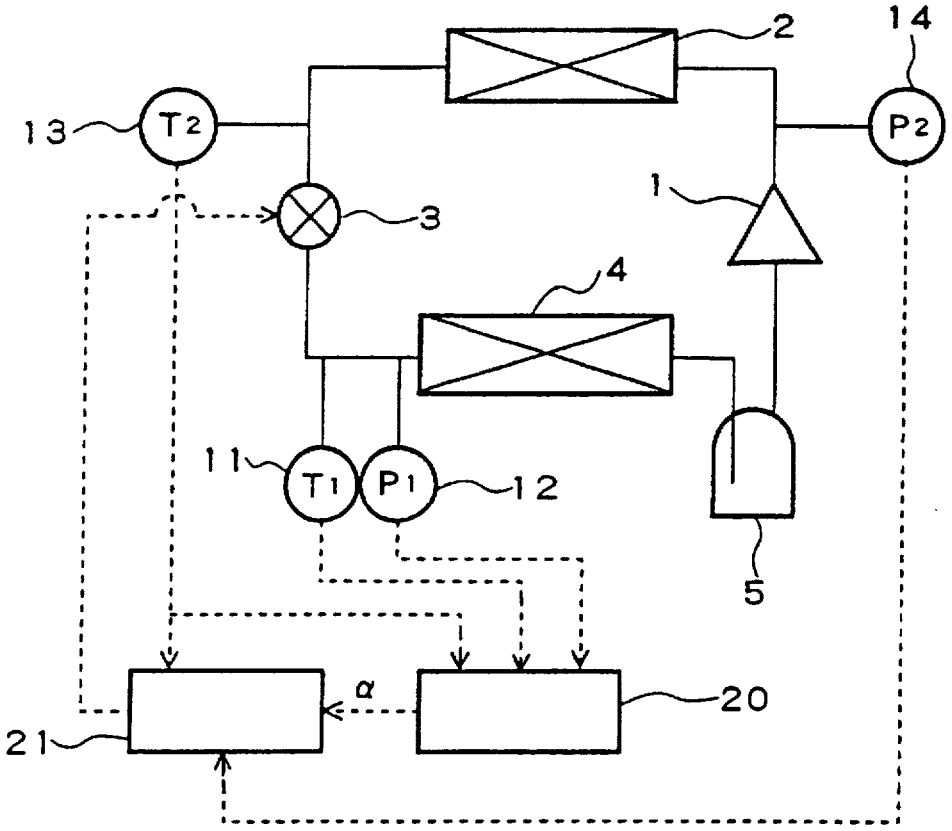
FIG. 1 is a block diagram showing the construction of a refrigeration air-conditioner using a non-azeotrope refrigerant, which air-conditioner is equipped with a control-information detecting apparatus therefor according to a first embodiment (embodiment 1) of the present invention.

FIG. 1 is a block diagram showing the construction of a refrigeration air-conditioner using a non-azeotrope refrigerant, which air-conditioner is equipped with a control-information detecting apparatus for it according to a first embodiment of the present invention. In FIG. 1, reference numeral 1 designates a compressor; numeral 2 designates a condenser; numeral 3 designates a decompressing device using an electric expansion valve; numeral 4 designates an evaporator; and numeral 5 designates an accumulator. These elements are connected in series with a pipe between them, and compose a refrigerating cycle. The degree of opening of the electric expansion valve of the decompressing device 3 is controlled on the output signals of a control unit 21, which controls the air-conditioner on the control information detected by this apparatus. For example, a non-azeotrope refrigerant composed of a high boiling component "R134a" and a low boiling component "R32" (both are the codes of ASHRAE) is filled in the refrigerating cycle thereof.

At the entrance of the evaporator 4 are respectively equipped a first temperature detector 11 for detecting the temperature T1 of the refrigerant at that place and a first pressure detector 12 for detecting the pressure P1 of the refrigerant at that place. At the exit of the condenser 2 is equipped a second temperature detector 13 for detecting the temperature T2 of the refrigerant at that place. The signals detected by these temperature detector 11, pressure detector 12, and temperature detector 13 are respectively input into a composition computing unit 20. The control-information detecting apparatus of the present embodiment comprises the first and the second temperature detectors 11, 13, the first pressure detector 12, and the composition computing unit 20. On the discharge pipe of the compressor 1 is equipped a second pressure detector 14 for detecting the pressure of the refrigerant at that place; the signals detected by the pressure detector 14 are input into the control unit 21 together with the signals detected by the temperature detector 13.

The composition computing unit 20 has the function of computing the circulation composition α of the non-azeotrope refrigerant on the temperature T1, the pressure P1, and the temperature T2 respectively detected by the temperature detector 11, the pressure detector 12, and the temperature detector 13. The computed value of the circulation composition α is input into the control unit 21. The control unit 21 further has the function of computing a saturated liquid temperature TL at a condensation pressure on the circulation composition α and a pressure P2 detected by the pressure detector 14, the function of computing the degree of supercooling at the exit of the condenser 2 on the saturated liquid temperature TL and a temperature T2 detected by the temperature detector 13, and the function of controlling the degree of opening of the electric expansion valve of the decompressing device 3 so that the degree of supercooling becomes a prescribed value.

Next, the operation of the present embodiment constructed as described above will be described.

The refrigerant gas having been compressed by the compressor 1 into high temperature and high pressure is condensed by the condenser 2 into liquid, and the liquefied refrigerant is decompressed by the decompressing device 3 into a refrigerant in two phases of vapor and liquid having a low pressure, which flows into the evaporator 4. The refrigerant is evaporated by the evaporator 4 and returns to the compressor 1 through the accumulator 5. Then, the refrigerant is again compressed by the compressor 1 to be sent into the condenser 2. The surplus refrigerants, which are produced at the time when the operation condition or the load condition of the air-conditioner is a specified condition, are stored in the accumulator 5.

Figure 2:
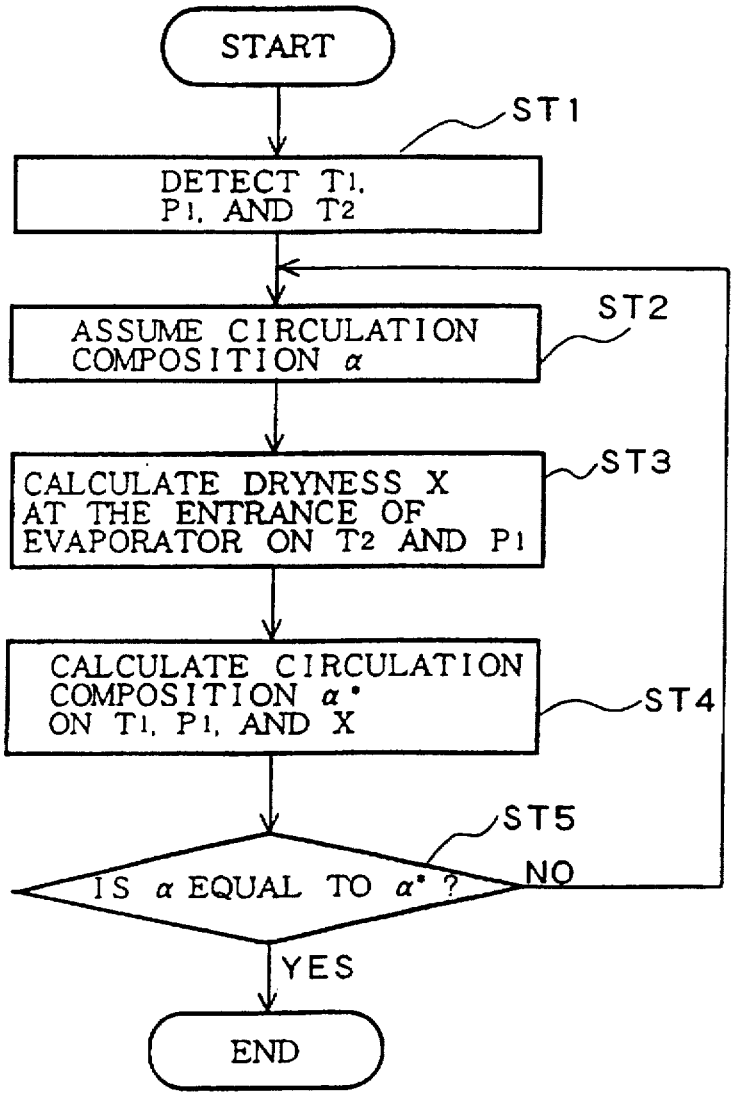
FIG. 2 is a flowchart showing the operation of the composition computing unit of the embodiment 1.
Figure 3:
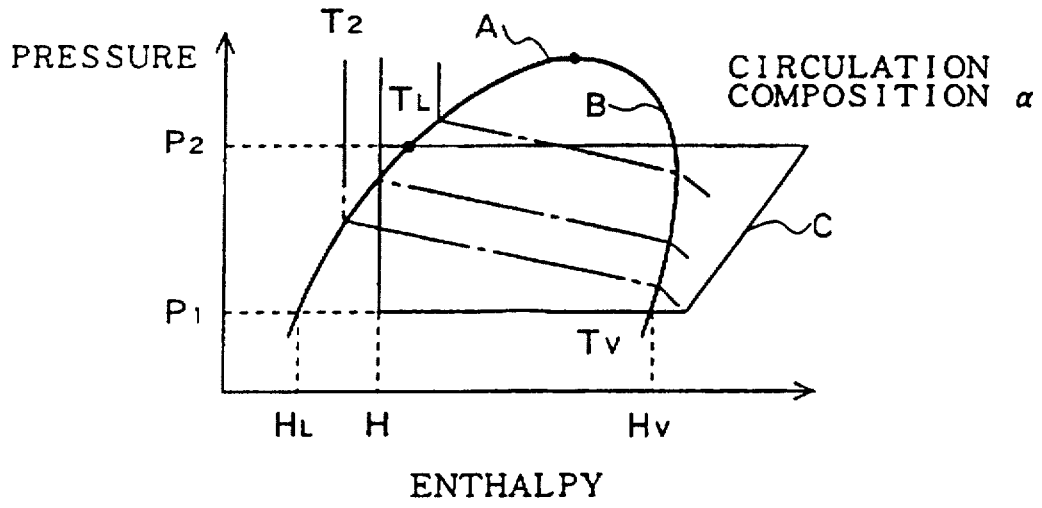
FIG. 3 is an explanatory diagram for the illustration of the operation of the composition computing unit of the embodiment 1 by using lines showing the relationships between pressures and enthalpy.
Figure 4:
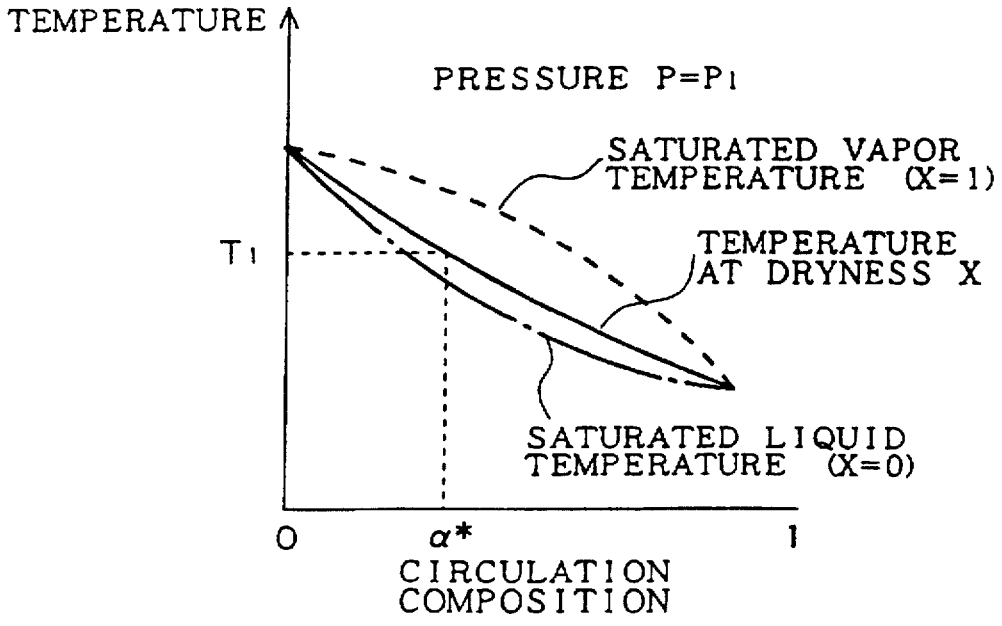
FIG. 4 is an explanatory diagram for the illustration of the operation of the composition computing unit of the embodiment 1 by using the relationships between the temperatures of a non-azeotrope refrigerant and the circulation compositions.

Next, the operation of the composition computing unit 20 will be described in connection with the flowchart shown in FIG. 2, the line diagram of pressure and enthalpy shown in FIG. 3, and the vapor-liquid equilibrium line diagram of the non-azeotrope refrigerant shown in FIG. 4. In FIG. 3, the full line A is a saturated liquid curve to the composition α of the refrigerant circulating through the refrigerating cycle; the full line B is a saturated vapor curve to the circulation composition α; the full line C is a cycle performance line; and the alternate long and short dash lines are iso-thermal lines. The axis of abscissa of FIG. 4 designates the weight ratios of the low boiling component; the axis of ordinates thereof designates temperatures; the dotted line thereof designates saturated vapor temperatures (X=1) when the pressure at the entrance of the evaporator 4 is P1; the alternate long and short dash line thereof designates saturated liquid temperatures (X=0); and the full line thereof designates temperatures at dryness X (0<X<1).

When the composition computing unit 20 begins to operate, the unit 20 takes therein the temperature T1 and the pressure P1 of the refrigerant at the entrance of the evaporator 4, and the temperature T2 of the refrigerant at the exit of the condenser 2 therein, which temperatures T1, T2, and the pressure P1 are respectively detected by the temperature detectors 11, 13, and the pressure detector 12 at STEP ST1. Then, the circulation composition α in the refrigerating cycle is assumed as a certain value at STEP ST2, and the dryness X of the refrigerant flowing into the evaporator 4 is calculated on this assumption at STEP ST3. That is to say, an enthalpy H is obtained from the temperature T2 at the exit of the condenser 2, the value of the enthalpy $H_L$ at the time when the pressure of the saturated liquid curve A is P1 is obtained from the pressure P1 at the entrance of the evaporator 4, and the dryness X at the entrance of the evaporator 4 is approximately determined in conformity with the following formula uniquely on the circulation composition a assumed as shown in FIG. 3.

$$X=(H-H_L)/(H_V-H_L)$$

where $H_V$ designates the enthalpy at the point of intersection of the saturated vapor curve B and the cycle performance line C. In practice, relationships among the dryness X, the temperatures T2, and the pressures P1 have been memorized in the composition computing unit 20 in advance, and the dryness X is computed by using the values of the temperature T2 and the pressure P1. Furthermore, a circulation composition α* is calculated from the dryness X, the temperature T1 and the pressure P1 of the refrigerant at the entrance of the evaporator 4 at STEP ST4. Namely, the temperature and the pressure of the non-azeotrope refrigerant in two-phases of vapor and liquid, the dryness of which is X, is determined in accordance with the circulation composition of the refrigerant circulating through a refrigerating cycle as shown in FIG. 4. Accordingly, the circulation composition α* can be calculated by using the characteristic shown with a full line in FIG. 4. At STEP ST5, the circulation composition α* and the circulation composition α having been assumed previously are compared, and the circulation composition is obtained as the α if both of them are equal. If both of them are not equal, the composition computing unit 20 returns to STEP ST2 for assuming a new value of the circulation composition α, and the unit 20 continues the aforementioned calculation until both the values become equal.

Figure 5:
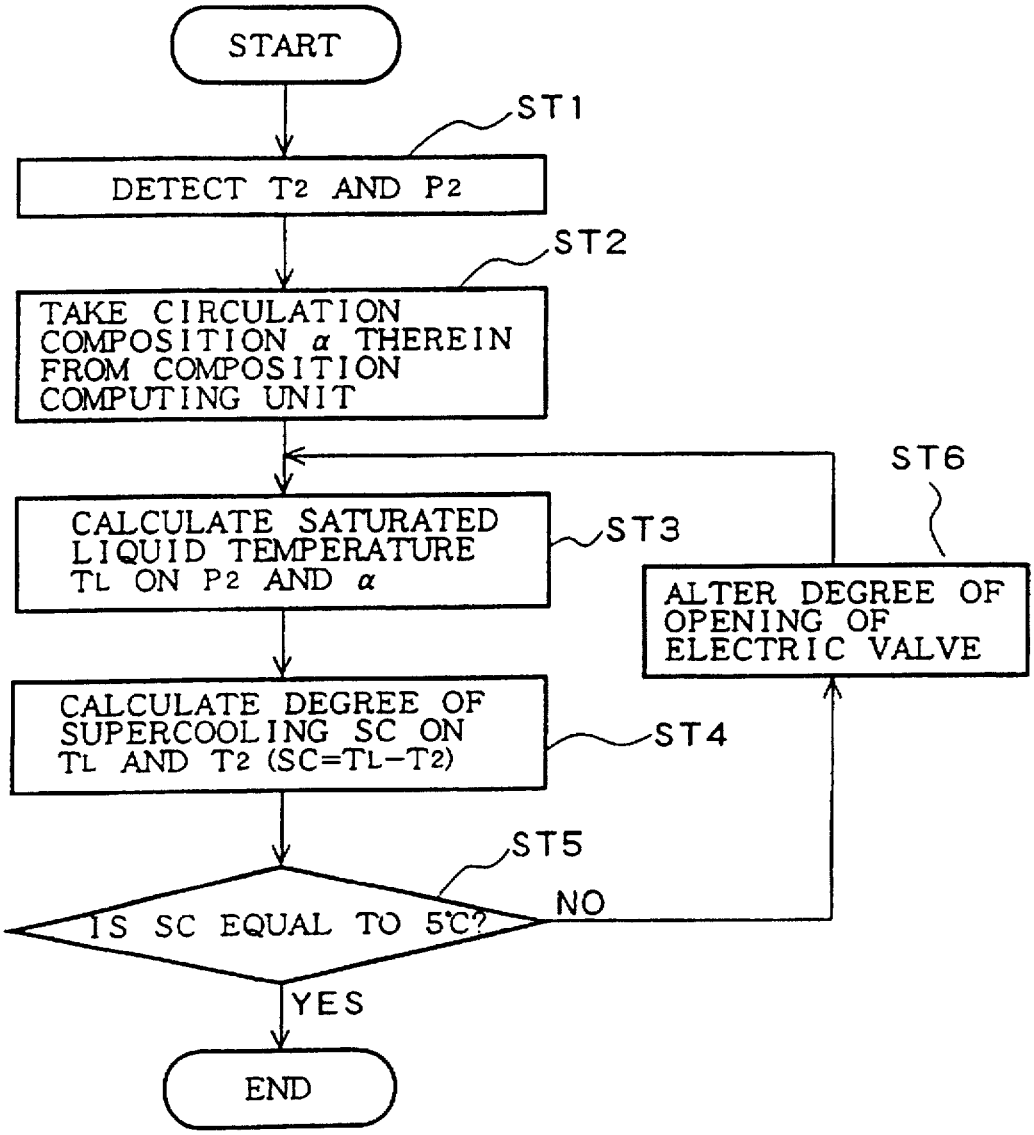
FIG. 5 is a flowchart showing the operation of the control unit of the refrigeration air-conditioner related to the embodiment 1.

Next, the operation of the control unit 21 will be described in connection with the flowchart shown in FIG. 5.

When the control unit 21 begins to operate, the temperature T2 at the exit of the condenser 2 and the condensation pressure P2 are detected by the temperature detector 13 and the pressure detector 14 respectively at STEP ST1. Then, the control unit 21 takes therein the circulation composition α calculated by the composition computing unit 20 from the unit 20 at STEP ST2, and calculates the saturated liquid temperature $T_L$ at the condensation pressure P2 on the pressure P2 and the circulation composition α at STEP ST3. This saturated liquid temperature $T_L$ is uniquely determined on the pressure P2, since the circulation composition α is fixed (see FIG. 3). The control unit 21 calculates the degree of supercooling SC of the refrigerant at the exit of the condenser 2 on the temperature T2 at the exit and the saturated liquid temperature $T_L$ at STEP ST4 ($SC=T_L-T2$). Then, the unit 21 judges whether the degree of supercooling accords with a predetermined value, for example, 5° C. or not at STEP ST5. When the degree of supercooling accords with the predetermined value, the unit 21 moves to the end step. When the degree of supercooling is not judged to be in accord with the predetermined value, the unit 21 moves to STEP ST6 to execute the alteration process of the degree of opening of the electric expansion valve of the decompressing device 3.

The degree of supercooling at the exit of the condenser 2 is kept at an appropriate value to make the optimum operation of the air-conditioner possible by repeating the aforementioned operation even if the circulation composition in the refrigerating cycle has changed owing to the change of the operation condition or the load condition of the refrigeration air-conditioner, or even if the circulation composition has changed owing to the leakage of the refrigerant during the operation of the air-conditioner or an operational error at the time of filling up the refrigerant.

The mixed refrigerant, which is a two-component system in the present embodiment, may be a multi-component system such as a three-component system for obtaining similar effects.

Also, the control unit 21 in the present embodiment controls the degree of opening of the electric expansion valve of the decompressing device 3 so as to keep the degree of supercooling at the exit of the condenser 2 at a constant value even if the circulation composition in the refrigerating cycle has changed, but it may make the optimum operation of the air-conditioner possible similarly to the aforementioned to control the degree of superheat at the exit of the evaporator 4 to be a constant value by detecting the temperature at the exit of the evaporator 4 and calculating the saturated vapor temperature $T_V$ at the evaporation pressure P1 on the circulating composition α and the pressure P1 (see FIG. 3).

Furthermore, the control unit 21 controls the degree of the opening of the electric expansion valve of the decompressing device 3 to be the optimum value even if the circulation composition in the refrigerating cycle has changed as described above, but the control unit 21 may control the number of revolutions of the compressor 1 in accordance with the circulation compositions for obtaining similar effects.

EMBODIMENT 2

Figure 6:
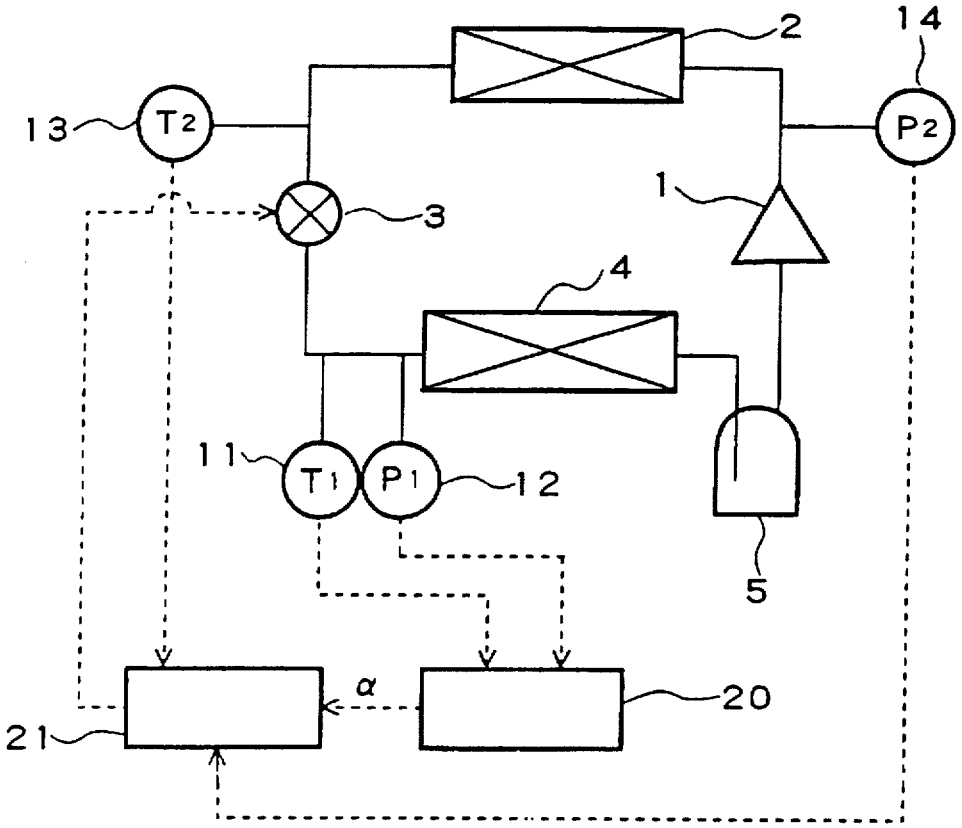
FIG. 6 is a block diagram showing the construction of a refrigeration air-conditioner using a non-azeotrope refrigerant, which air-conditioner is equipped with a control-information detecting apparatus for it according to a second embodiment (embodiment 2) of the present invention.

FIG. 6 is a block diagram showing the construction of a refrigeration air-conditioner using a non-azeotrope refrigerant, which air-conditioner is equipped with a control-information detecting apparatus for it according to a second embodiment of the present invention. This embodiment is equipped with a first temperature detector 11 for detecting the temperature T1 of the refrigerant at the entrance of the evaporator 4 and a first pressure detector 12 for detecting the pressure P1 of the refrigerant at that place. The signals detected by the temperature detector 11 and the pressure detector 12 are respectively input into the composition computing unit 20. At the exit of the condenser 2 is equipped a second temperature detector 13 for detecting the temperature T2 of the refrigerant at that place. The control-information detecting apparatus of the present embodiment comprises these temperature detectors 11, 13, pressure detector 12, and composition computing unit 20. A second pressure detector 14 for detecting the pressure of the refrigerant in the discharge pipe of the compressor 1 is equipped at that place. The signals detected by these temperature detector 13 and pressure detector 14 are input into the control unit 21.

The composition computing unit 20 has the function of computing the circulation composition α of the non-azeotrope refrigerant on the temperature T1 and the pressure P1 respectively detected by the temperature detector 11 and the pressure detector 12. The computed values of the circulation composition α are input into the control unit 21. The control unit 21 has the function of computing the saturated liquid temperature $T_L$ at the condensation pressure on the circulation composition α and the pressure P2 detected by the pressure detector 14, the function of computing the degree of supercooling at the exit of the condenser 2 on the saturated liquid temperature $T_L$ and the temperature T2 detected by the temperature detector 13, and the function of controlling the degree of opening of the electric expansion valve of the decompressing device 3 so that the degree of supercooling becomes a prescribed value.

Next, the operation of the composition computing unit 20 of the present embodiment will be described. The composition computing unit 20 takes therein the temperature T1 and the pressure P1 at the entrance of the evaporator 4 having been respectively detected by the temperature detector 11 and the pressure detector 12 at first. The refrigerant flowing into the evaporator 4 is ordinarily in a two-phase state of vapor and liquid, the dryness of which is about 0.1 to 0.3. Therefore, by assuming the dryness to be, for example, 0.2, the composition α of the refrigerant circulating through the refrigerating cycle can be presumed only on the information of the temperature T1 and the pressure P1. That is to say, the circulation composition α can be calculated from the temperature T1 and the pressure P1 by using the characteristic shown with the full line in FIG. 4.

Because the operation of the control unit 21 is similar to that of the embodiment 1, the description thereof is omitted.

The circulation composition of the refrigerant in the refrigerating cycle can be detected only from the temperature and the pressure at the entrance of the evaporator 4 in the present embodiment, and the degree of supercooling at the exit of the condenser 2 is kept to be an appropriate value to make the usual optimum operation possible despite the change of the circulation composition.

The dryness may be set at a value other than one of about 0.1 to 0.3, the set value in the aforementioned embodiment.

The construction as described above makes it possible to simplify the computations in the composition computing unit 20 and to realize the control-information detecting apparatus with a simple construction, which apparatus has functions similar to those of the embodiment 1 and is cheap in cost.

EMBODIMENT 3

Figure 7:
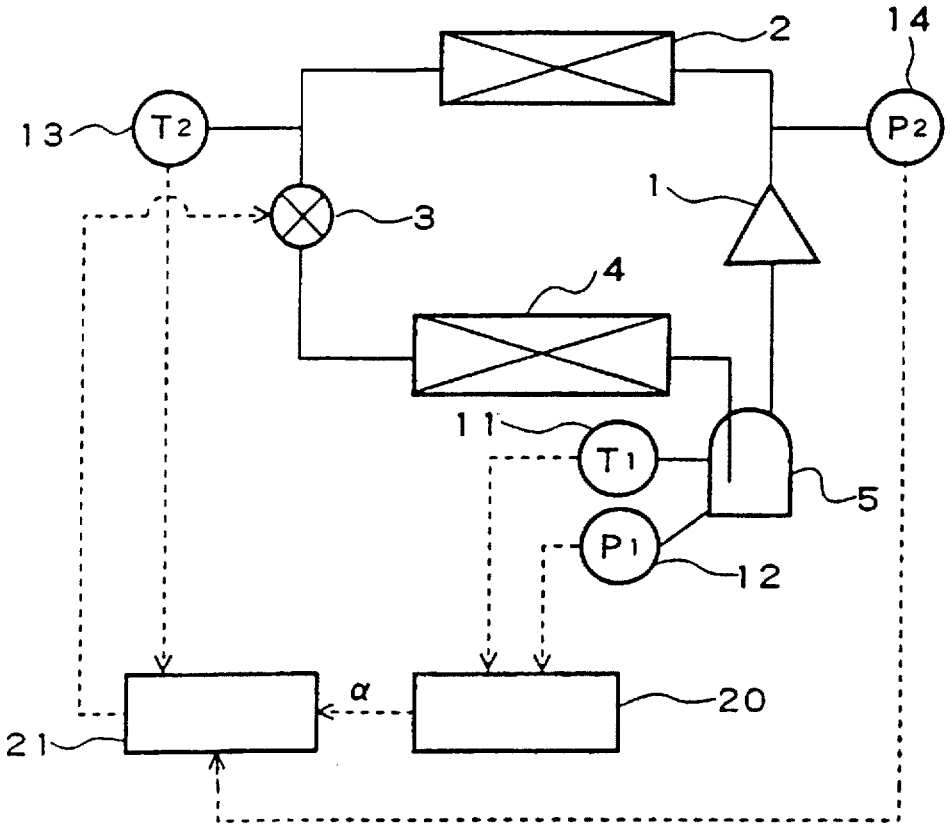
FIG. 7 is a block diagram showing the construction of a refrigeration air-conditioner using a non-azeotrope refrigerant, which air-conditioner is equipped with a control-information detecting apparatus for it according to a third embodiment (embodiment 3) of the present invention.

FIG. 7 is a block diagram showing the construction of a refrigeration air-conditioner using a non-azeotrope refrigerant, which air-conditioner is equipped with a control-information detecting apparatus for it according to a third embodiment of the present invention. The present embodiment is equipped with a first temperature detector 11 for detecting the temperature T1 of the refrigerant in the accumulator 5 thereof and a pressure detector 12 for detecting the pressure P1 of the refrigerant in the accumulator 5, and the signals detected by the temperature detector 11 and the pressure detector 12 respectively are input into the composition computing unit 20. The unit 20 has the function of computing the circulation composition a of the non-azeotrope refrigerant on the temperature T1 and the pressure P1 in the accumulator 5, which are detected by the temperature detector 11 and the pressure detector 12 respectively. Hereinafter the operation of the composition computing unit 20 will be described. The control-information detecting apparatus of the present embodiment comprises these temperature detector 11, pressure detector 12, and composition computing unit 20.

Figure 8:
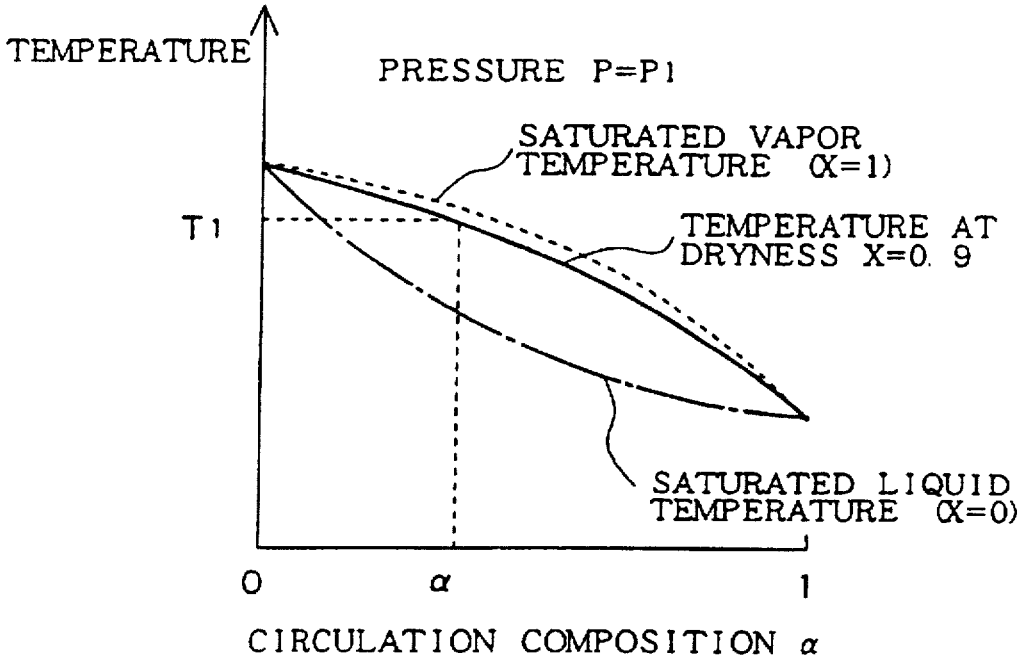
FIG. 8 is an explanatory diagram for the illustration of the operation of the composition computing unit of the embodiment 3 by using the relationships between the temperatures of a non-azeotrope refrigerant and circulation compositions.

The unit 20 takes therein the temperature T1 and the pressure P1 of the refrigerant in the accumulator 5. The refrigerant flowing into the accumulator 5 is ordinarily in a two-phase state of vapor and liquid, the dryness of which is about 0.8 to 1.0. Therefore, the dryness can approximately be regarded as, for example, 0.9. The temperature and the pressure of the refrigerant in this state is determined by the circulation composition of the non-azeotrope refrigerant flowing through the refrigerating cycle as shown in FIG. 8. The circulation composition a can be computed only on the temperature T1 and the pressure P1 in the accumulator 5 by using the characteristic shown with the full line in FIG. 8 accordingly Because the operation of the control unit 21 is similar to that of the embodiment 1, the description thereof is omitted. The can detect the circulation composition of the refrigerant in the refrigerating cycle only on the temperature and the pressure in the accumulator 5, and the computations in the composition computing unit 20 are consequently simplified, which makes it possible to obtain a control-information detecting apparatus with a simple construction, which apparatus has functions similar to those of the embodiment 1 and is cheap in cost similarly to the embodiment 2.

The present embodiment measures the temperature and the pressure in the accumulator 5, but the first temperature detector 11 and the pressure detector 12 may be equipped at a place between the accumulator 5 and the suction pipe of the compressor 1.

The dryness X may be set at a value other than one of about 0.8 to 1.0, the set value in the aforementioned embodiment.

EMBODIMENT 4

Figure 9:
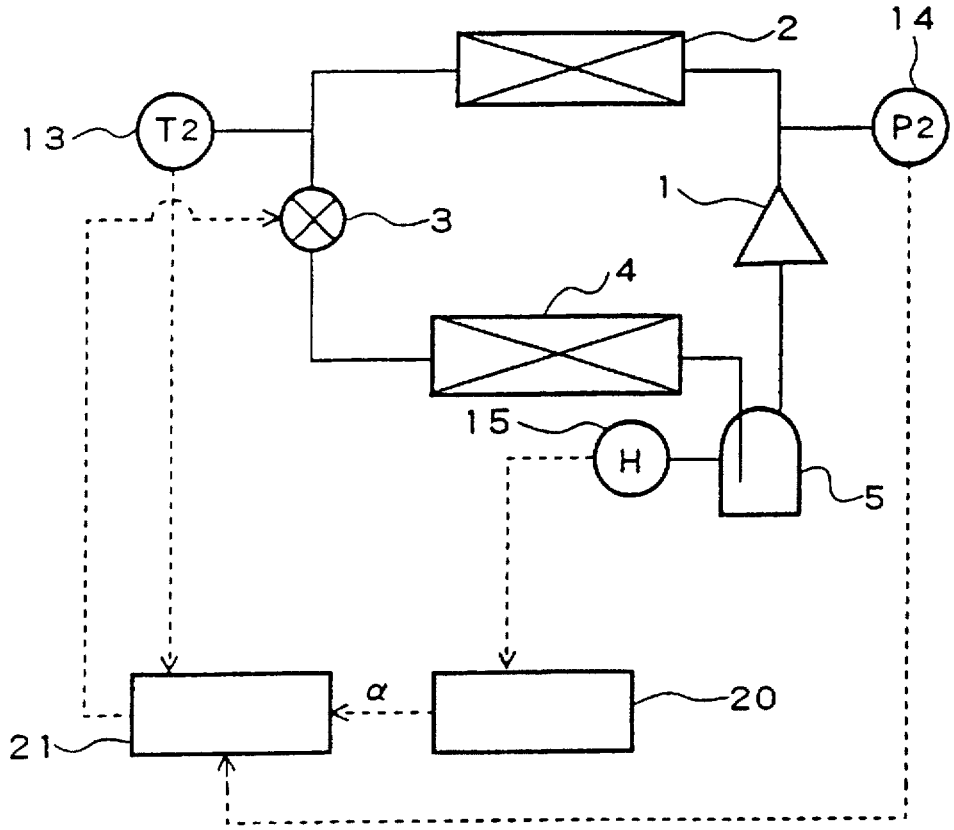
FIG. 9 is a block diagram showing the construction of a refrigeration air-conditioner using a non-azeotrope refrigerant, which air-conditioner is equipped with a control-information detecting apparatus for it according to a fourth embodiment (embodiment 4) of the present invention.

FIG. 9 is a block diagram showing the construction of a refrigeration air-conditioner using a non-azeotrope refrigerant, which air-conditioner is equipped with a control-information detecting apparatus for it according to a fourth embodiment of the present invention. The present embodiment is equipped with a liquid level detector 15 for detecting the liquid level of the refrigerant in the accumulator 5 therein, and the signals detected by the liquid level detector 15 are input into the composition computing unit 20. Well known level gauges such as an ultrasonic level gauge and a capacitance type level gauge may be employed as the liquid level detector 15. The unit 20 has the function of computing the circulation composition α of the non-azeotrope refrigerant on the liquid level h of the refrigerant in the accumulator 5, which is detected by the liquid level detector 15, and the operation of the unit 20 will be described hereinafter. The control-information detecting apparatus of the present embodiment comprises these liquid level detector 15 and composition computing unit 20.

Figure 10:
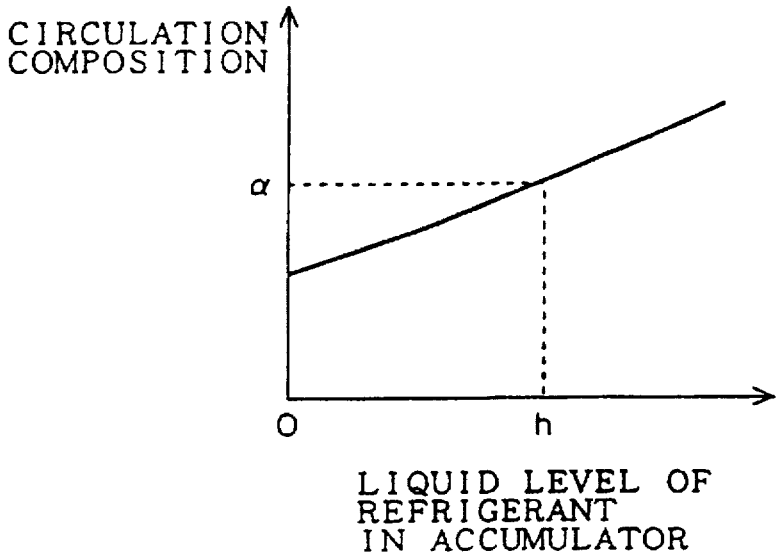
FIG. 10 is an explanatory diagram for the illustration of the operation of the composition computing unit of the embodiment 4 by using the relationship between the liquid levels of a refrigerant in an accumulator and the compositions of a refrigerant circulating through a refrigerating cycle.

When the unit 20 begins to operate, the unit 20 takes therein the liquid level h. The refrigerant in the accumulator in a refrigerating cycle using a non-azeotrope refrigerant is generally separated into a liquid phase rich in high boiling components and a vapor phase rich in low boiling components, and the liquid phase rich in high boiling components is stored in the accumulator. The composition of the refrigerant circulating through the refrigerating cycle consequently has the inclination of having much low boiling components (or the circulation composition increases), if the liquid refrigerant exists in the accumulator. FIG. 10 shows a relationship between the liquid level h in the accumulator and the circulation composition α. The higher the liquid level in the accumulator becomes, or the larger the quantity of the liquid refrigerant in the accumulator becomes, the larger the circulation composition becomes. The circulation composition α can be computed from the liquid level h in the accumulator 5, which is detected by the liquid level detector 15, by previously obtaining the relationship shown in FIG. 10 by experiments or the like accordingly.

Because the operation of the control unit 21 is similar to that of the embodiment 1, the description thereof is omitted. The present embodiment can detect the circulation composition in the refrigerating cycle only on the liquid level of the refrigerant in the accumulator 5, which makes it possible to obtain a control-information detecting apparatus with a simple construction and to keep the degree of supercooling at the exit of the condenser 2 to an appropriate value despite the change of the circulation composition for enabling the usual optimum operation of the refrigeration air-conditioner.

An ultrasonic or a capacitance type level gauge is used as the liquid level detector 15 of the aforementioned embodiment, but similar effects can be obtained by detecting the liquid level in the accumulator 5 by computing the surplus quantity of the refrigerant in the refrigerating cycle on the operation condition or the load condition thereof. Namely, the liquid level in the accumulator 5 may be detected by computing it from the relationship between the operation condition and the surplus quantity of the refrigerant, which relationship has been measured in advance by experiments or the like and is the fact, for example, that the surplus refrigerant is not produced in case of the operation of air cooling and a certain quantity of the surplus refrigerant is produced in case of the operation of air heating. Furthermore, the accuracy of detecting the liquid level in the accumulator may be improved by adding the information such as the temperature of the air inside a room and the temperature of the air outside the room at the time of the operation of air cooling or air heating.

EMBODIMENT 5

Figure 11:
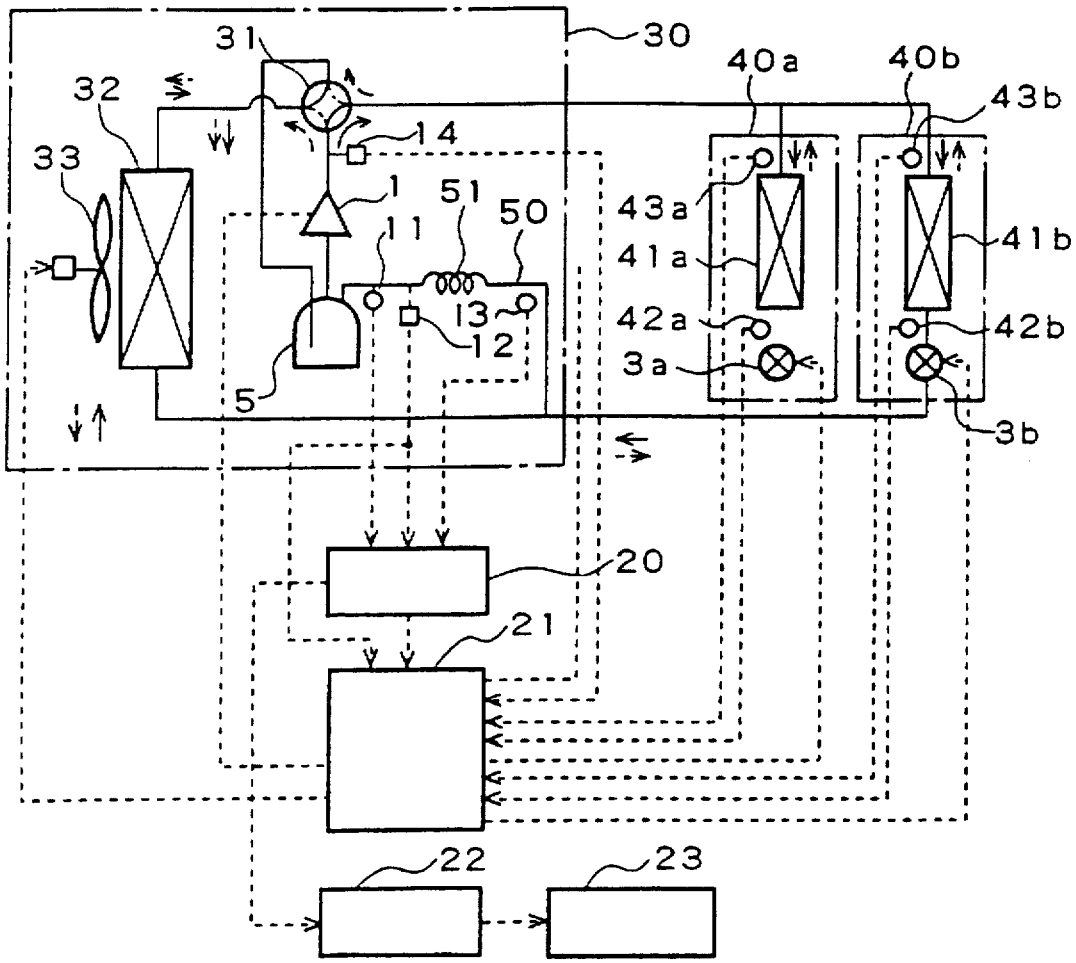
FIG. 11 is a block diagram showing the construction of a refrigeration air-conditioner using a non-azeotrope refrigerant, which air-conditioner is equipped with a control-information detecting apparatus for it according to a fifth embodiment (embodiment 5) of the present invention.

FIG. 11 is a block diagram showing the construction of a refrigeration air-conditioner using a non-azeotrope refrigerant, which air-conditioner is equipped with a control-information detecting apparatus for it according to a fifth embodiment of the present invention. In the present embodiment, the refrigeration air-conditioner comprises two indoor units connected to one outdoor unit. In FIG. 11, reference numeral 30 designates the outdoor unit comprising a compressor 1, a four-way type valve 31, an outdoor heat exchanger (a first heat exchanger) 32, an outdoor blower 33, and an accumulator 5. The discharge side pipe of the compressor 1 is equipped with a second pressure detector 14. Reference numerals 40*a* and 40*b* (hereinafter referred to as 40 generically) respectively designate an indoor unit comprising an indoor heat exchanger (a second heat exchanger) 41*a* or 41*b* (hereinafter referred to as 41 generically) and a first decompressing device 3*a* or 3*b* (hereinafter referred to as 3 generically) using a first electric expansion valve. A third heat exchanger 42*a* or 42*b* (hereinafter referred to as 42 generically) and a fourth temperature detector 43*a* or 43*b* (hereinafter referred to as 43 generically) are equipped at the entrances and the exits of the indoor heat exchangers 41 respectively. A bypass pipe 50 for connecting the pipe connecting the outdoor heat exchanger 32 with the decompressing devices 3 of the indoor units 40 with the accumulator 5 is equipped at an intermediate position of the pipe. A second decompressing device 51 composed of a capillary tube is equipped at an intermediate position of the bypass pipe 50. Furthermore, the bypass pipe 50 is equipped with a first temperature detector 11 and a first pressure detector 12 at the exit of the decompressing device 51, and a second temperature detector 13 at the entrance of the decompressing device 51. An indoor blower is also equipped, but omitted to be shown in FIG. 11.

Reference numeral 20 designates a composition computing unit, into which the signals from the first temperature detector 11, the first pressure detector 12, and the second temperature detector 13 are input for computing the composition of the refrigerant circulating through the refrigerating cycle of the air-conditioner. The control information detecting means comprises these first and second temperature detectors 11 and 13, first pressure detector 12, and composition computing unit 20. Reference numeral 21 designates a control unit, into which the circulation composition signals of the refrigerant from the composition computing unit 20 and the signals from the first pressure detector 12, the second pressure detector 14, the third temperature detectors 42, and the fourth temperature detectors 43 are input. The control unit 21 calculates the number of revolutions of the compressor 1, the number of the revolutions of the outdoor blower 33, and the degrees of the opening of the electric expansion valves of the decompressing devices 3 in accordance with the circulation composition of the refrigerant on the input signals to transmit commands to the compressor 1, the outdoor blower 33 and the decompressing devices 3 respectively. The compressor 1, the outdoor blower 33, and the decompressing devices 3 receive the command values transmitted from the control unit 21 to control the numbers of revolutions of them or the degrees of opening of their electric expansion valves. Reference numeral 22 designates a comparator, into which circulation composition signals are input from the composition computing unit 20 to compare whether the circulation compositions are within a predetermined range or not. A warning device 23 is connected to the comparator 22, and a warning signal is transmitted to the warning device 23 when a circulation composition is out of a predetermined range. The aforementioned control-information detecting apparatus also comprises these comparator 22 and warning device 23 as a part thereof.

Figure 12:
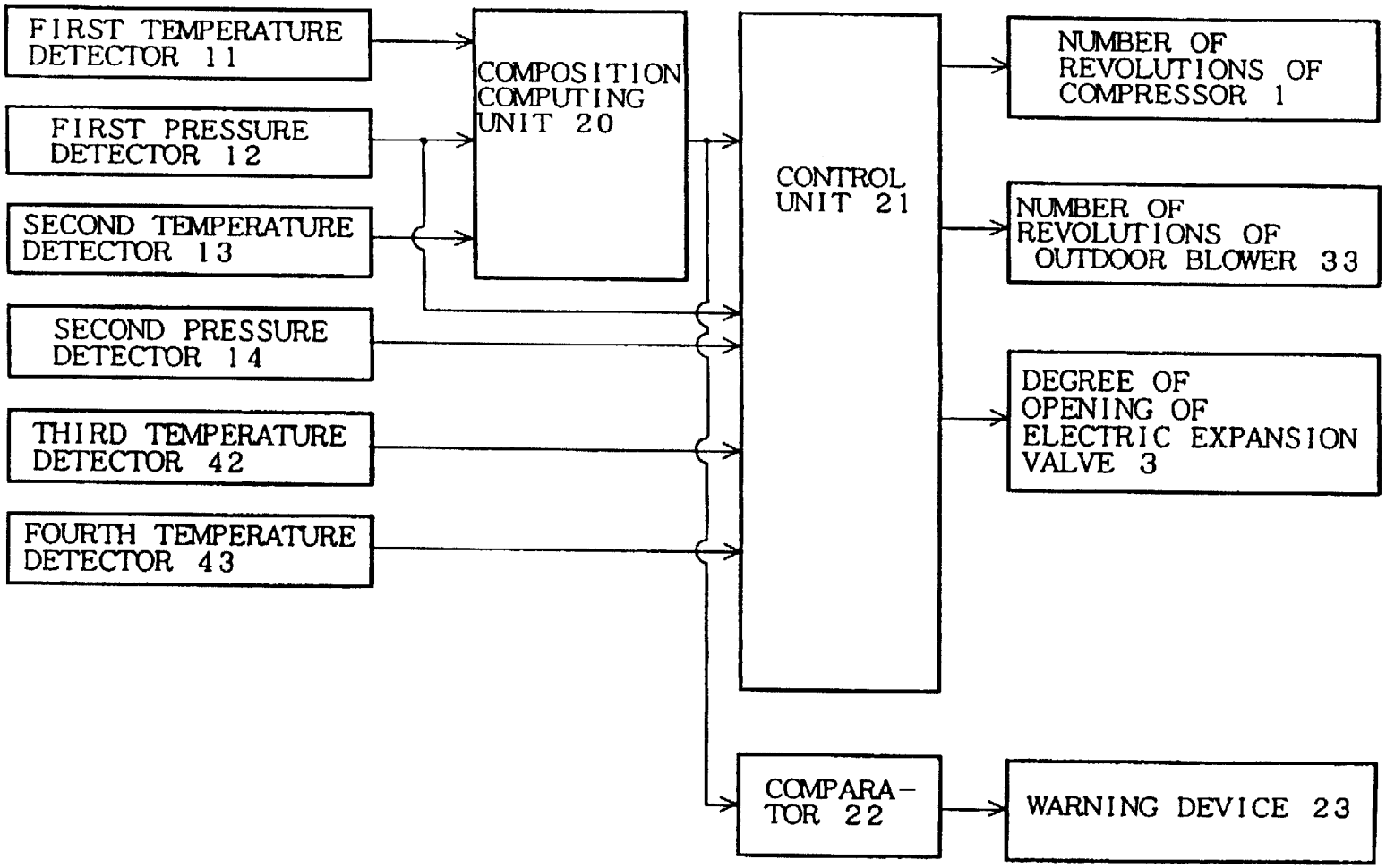
FIG. 12 is a control block diagram of a refrigeration air-conditioner using a non-azeotrope refrigerant, which air-conditioner is equipped with a control-information detecting apparatus for it according to the embodiment 5.

Next, the operation of the present embodiment thus constructed will be described in connection with FIG. 11 and the control block diagram shown in FIG. 12. The composition computing unit 20 takes therein the signals from the first temperature detector 11, the first pressure detector 12, and the second temperature detector 13 to calculate the dryness X of the refrigerant at the entrance of the decompressing device 51 by using the relationships shown in FIG. 3 and FIG. 4 for computing the circulation composition $\alpha$ in the refrigerating cycle. The control unit 21 computes the command of the optimum number of revolutions of the compressor 1, the command of the optimum number of revolutions of the outdoor blower 33, and the command of the optimum degree of opening of the electric expansion valves respectively in accordance with the circulation composition $\alpha$.

Figure 13:
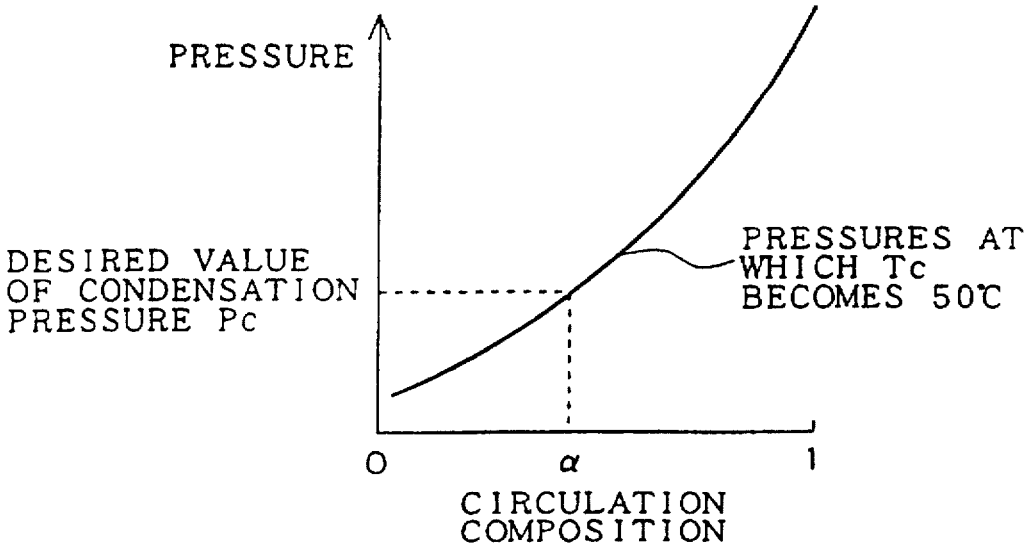
FIG. 13 is an explanatory diagram for the illustration of the operation of the control unit of the refrigeration air-conditioner related to the embodiment 5 by using the relationship between the condensation pressures of a non-azeotrope refrigerant and the compositions of a refrigerant circulating through the refrigerating cycle of the air-conditioner.

At first, the operation of air heating of the air-conditioner will be described. At the time of the operation of air heating, the refrigerant circulates to the directions shown by the arrows of the full lines in FIG. 11, and the indoor heat exchangers 41 operate as condensers for the operation of air heating. The number of revolutions of the compressor 1 is controlled so that the pressure of the condensation accords with a desired value, at which the condensation temperature Tc becomes, for example, 50° C. If the condensation temperature of a non-azeotrope refrigerant is defined as an average value of the saturated vapor temperature thereof and the saturated liquid temperature thereof, the desired value of the condensation pressure Pc, at which the condensation temperature Tc becomes 50° C., is uniquely determined in accordance with the circulation composition $\alpha$ as shown in FIG. 13. Accordingly, by memorizing the relational expression shown in FIG. 13 previously in the control unit 21, the unit 21 can compute the desired value of the condensation pressure by using the circulation composition signals transmitted from the composition computing unit 20. The unit 21 further computes a modifying value to the number of revolutions of the compressor 1 in accordance with the difference between the pressure detected by the second pressure detector 14 and the desired value of the condensation pressure by using a feedback control such as the PID (proportional integral and differential) control to output a command of the number of revolutions to the compressor 1.

Figure 14:
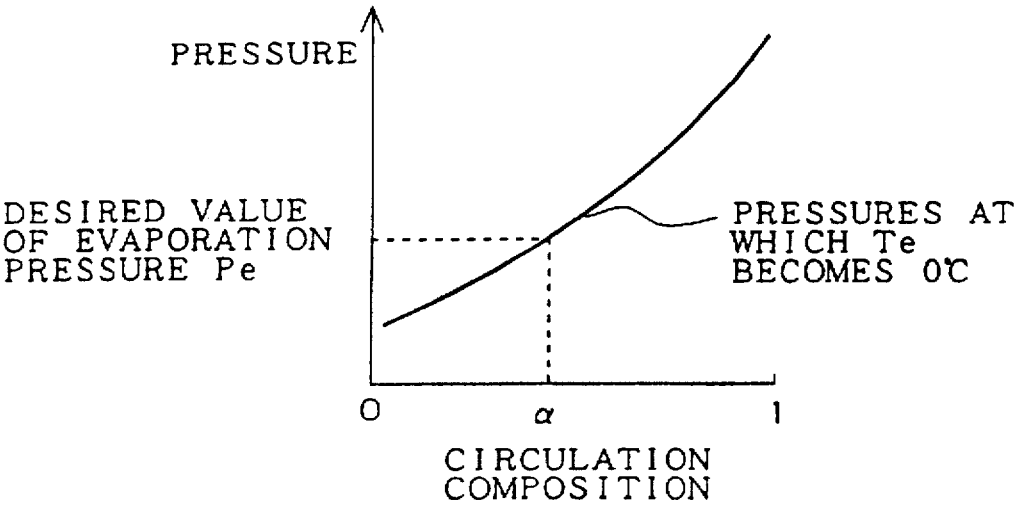
FIG. 14 is an explanatory diagram for the illustration of the operation of the control unit of the refrigeration air-conditioner related to the embodiment 5 by using the relationship between the evaporation pressures of a non-azeotrope refrigerant and the compositions of a refrigerant circulating through the refrigerating cycle of the air-conditioner.

The number of revolutions of the outdoor blower 33 is controlled so that the evaporation pressure accords with a desired value, at which the evaporation temperature Te becomes, for example, 0° C. If the evaporation temperature of a non-azeotrope refrigerant is defined as an average value of the saturated vapor temperature thereof and the saturated liquid temperature thereof, the desired value of the evaporation pressure Pe, at which the evaporation temperature Te becomes 0° C., is uniquely determined in accordance with the circulation composition $\alpha$ as shown in FIG. 14. Accordingly, by memorizing the relational expression shown in FIG. 14 previously in the control unit 21, the unit 21 can compute the desired value of the evaporation pressure by using the circulation composition signals transmitted from the composition computing unit 20. The unit 21 further computes a modifying value to the number of revolutions of the outdoor blower 33 in accordance with the difference between the pressure detected by the first pressure detector 12 and the desired value of the evaporation pressure by using a feedback control such as the PID control to output a command of the number of revolutions to the outdoor blower 33.

Figure 15:
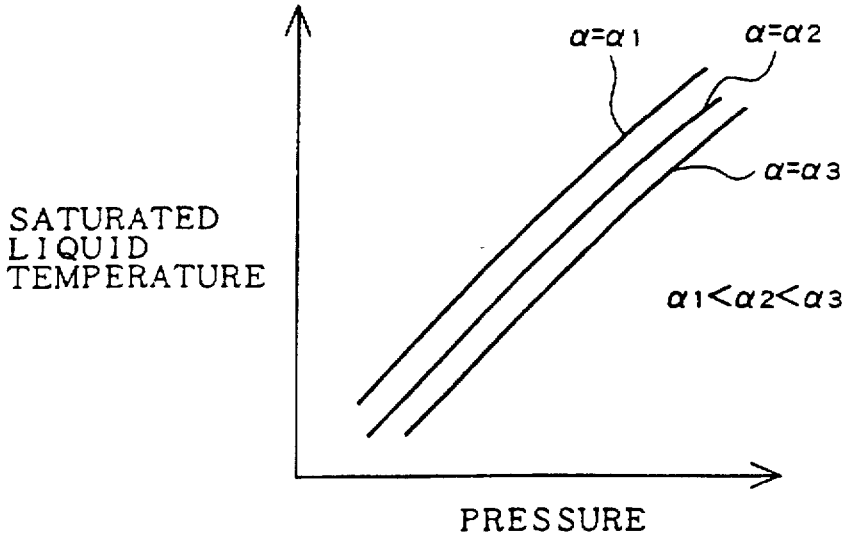
FIG. 15 is an explanatory diagram for the illustration of the operation of the control unit of the refrigeration air-conditioner related to the embodiment 5 by using the relationships among the saturated liquid temperatures and the pressures of a non-azeotrope refrigerant and the compositions of a refrigerant circulating through the refrigerating cycle of the air-conditioner.

The degrees of opening of the electric expansion valves of the decompressing devices 3 are controlled so that the degrees of supercooling at the exits of the indoor heat exchangers 41 become a predetermined value, for example, 5° C. The degrees of supercooling can be obtained as the differences between the saturated liquid temperatures at the pressures in the heat exchangers 41 and the temperatures at the exits of the heat exchangers 41. The saturated liquid temperatures can be obtained as functions of pressures and circulation compositions as shown in FIG. 15. Accordingly, by memorizing the relational expressions shown in FIG. 15 previously in the control unit 21, the unit 21 can compute the saturated liquid temperatures and the degrees of supercooling at the exits of the heat exchangers 41 by using the circulation composition signals transmitted from the composition computing unit 20, the pressure signals transmitted from the second pressure detector 14, and the temperature signals transmitted from the third temperature detectors 42. The unit 21 further computes a modifying value to the degrees of opening of the electric expansion valves of the decompressing devices 3 in accordance with the differences between the degrees of supercooling at the exits and the predetermined value (5° C.) by using a feedback control such as the PID control to output the commands of the degrees of opening of the electric expansion valves to the decompressing devices 3.

On the other hand, at the time of the operation of air cooling, the refrigerant circulates to the directions shown by the arrows of the dotted lines in FIG. 11, and the indoor heat exchangers 41 operate as evaporators for the operation of air cooling.

The number of revolutions of the compressor 1 is controlled so that the pressure of evaporation accords with a desired value, at which the evaporation temperature Te becomes, for example, 0° C. If the evaporation temperature of a non-azeotrope refrigerant is defined as an average value of the saturated vapor temperature thereof and the saturated liquid temperature thereof, the desired value of the evaporation pressure Pe, at which the evaporation temperature Te becomes 0° C., is uniquely determined in accordance with the circulation composition $\alpha$ as shown in FIG. 14. Accordingly, by memorizing the relational expression shown in FIG. 14 previously in the control unit 21, the unit 21 can compute the desired value of the evaporation pressure by using the circulation composition signals transmitted from the composition computing unit 20. The unit 21 further computes a modifying value to the number of revolutions of the compressor 1 in accordance with the difference between the pressure detected by the first pressure detector 12 and the desired value of the evaporation pressure by using a feedback control such as the PID control to output a command of the number of revolutions to the compressor 1.

The number of revolutions of the outdoor blower 33 is controlled so that the condensation pressure accords with a desired value, at which the condensation temperature Tc becomes, for example, 50° C. If the condensation temperature of a non-azeotrope refrigerant is defined as an average value of the saturated vapor temperature thereof and the saturated liquid temperature thereof, the desired value of the condensation pressure Pc, at which the condensation temperature Tc becomes 50° C., is uniquely determined in accordance with the circulation composition $\alpha$ as shown in FIG. 13. Accordingly, by memorizing the relational expression shown in FIG. 13 previously in the control unit 21, the unit 21 can compute the desired value of the condensation pressure by using the circulation composition signals transmitted from the composition computing unit 20. The unit 21 further computes a modifying value to the number of revolutions of the outdoor blower 33 in accordance with the difference between the pressure detected by the second pressure detector 14 and the desired value of the condensation pressure by using a feedback control such as the PID control to output a command of the number of revolutions to the outdoor blower 33.

The degrees of opening of the electric expansion valves of the decompressing devices 3 are controlled so that the degrees of supercooling at the exits of the indoor heat exchangers 41 become a predetermined value, for example, 5° C. The degrees of supercooling can be obtained as the differences between the saturated vapor temperatures at the pressures in the heat exchangers 41 and the temperatures at the exits of the heat exchangers 41, and the saturated vapor temperatures can be obtained as functions of pressures and circulation compositions similarly to the saturated liquid temperatures shown in FIG. 15. Accordingly, by memorizing the relational expressions among the saturated vapor temperatures, the pressures, and the circulation compositions previously in the control unit 21, the unit 21 can compute the saturated vapor temperatures and the degrees of supercooling at the exits of the heat exchangers 41 by using the circulation composition signals transmitted from the composition computing unit 20, the pressure signals transmitted from the first pressure detector 12, and the temperature signals transmitted from the fourth temperature detectors 43. The unit 21 further computes modifying values to the degrees of opening of the electric expansion valves of the decompressing devices 3 in accordance with the differences between the degrees of supercooling at the exits and the predetermined value (5° C.) by using a feedback control such as the PID control to output commands of the degrees of opening of the electric expansion valves to the decompressing devices 3.

Next, the operation of the comparator 22 will be described. The comparator 22 takes therein circulation composition signals from the composition computing unit 20 to judge whether the circulation compositions are within a previously memorized appropriate circulation composition range or not. The operation of the refrigeration air-conditioner is continued as it is if the circulation composition is in the appropriate circulation composition range. On the other hand, if the circulation composition has changed owing to the leakage of the refrigerant during the operation of the air-conditioner, or if the circulation composition has changed owing to an operational error at the time of filling up the refrigerant, the comparator 22 judges that the circulation composition is out of the previously memorized appropriate circulation composition range to transmit a warning signal to the warning device 23. The warning device 23 having received the warning signal sends out a warning for a predetermined time for warning the operator that the circulation composition of the non-azeotrope refrigerant of the air-conditioner is out of the appropriate range.

As described above, because the downstream side of the second decompressing device is always in two-phase state of low pressure regardless of air cooling or air heating in the present embodiment, temperatures and pressures can be measured with the same detectors to compute the composition of the refrigerant in both cases of air cooling and air heating. Consequently, there is no need of providing detectors respectively dedicated to air cooling or air heating, which makes the construction of the apparatus simple and makes the usual optimum operation of the air-conditioner possible even if the circulation composition has changed.

The present embodiment controls the number of revolutions of the outdoor blower 33 at the time of the operation of air heating so that the values detected by the first pressure detector 12 accord with the desired value of the evaporation pressure, which value is operated by the composition computing unit, but similar effects can be obtained by providing a temperature detector at the entrance of the outdoor heat exchanger 32 and controlling so that the temperature detected by the temperature detector becomes a predetermined value (for example 0° C.).

The present embodiment controls the degrees of opening of the electric valves so that the degrees of superheating at the exits of the indoor heat exchangers 41 become a predetermined value (for example 5° C.) at the time of the operation of air cooling, but similar effects can be obtained also by controlling them so that the temperature differences between the entrances and the exits of the indoor heat exchangers 41 become a predetermined value (for example 10° C.), that is to say, so that the temperature differences between the temperatures detected by the fourth temperature detectors and the third temperature detectors become the predetermined value.

The refrigeration air-conditioner of the present embodiment has one outdoor unit 30 and two indoor units 40 connected to the outdoor unit 30, but similar effects can be obtained also by connecting only one indoor unit or three indoor units or more to the outdoor unit.

EMBODIMENT 6

Figure 16:
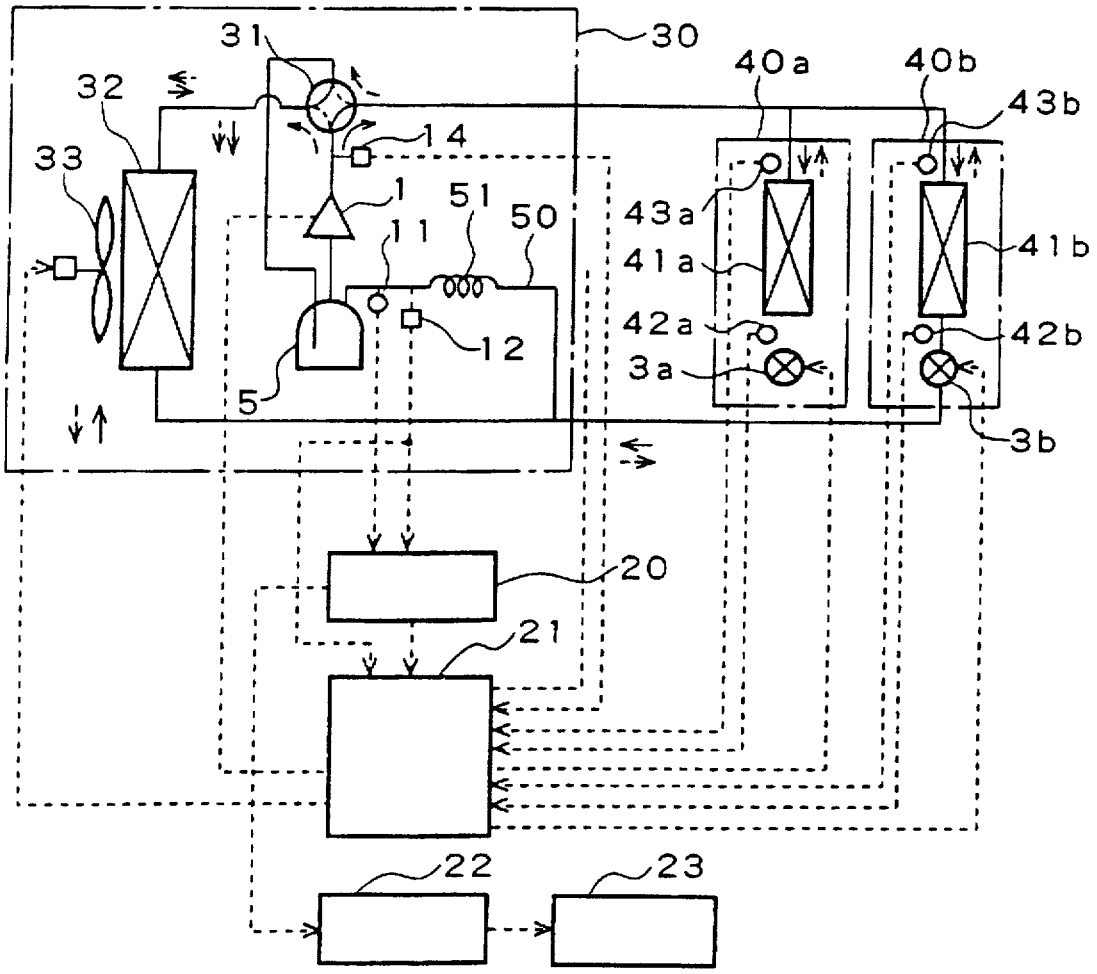
FIG. 16 is a block diagram showing the construction of a refrigeration air-conditioner using a non-azeotrope refrigerant, which air-conditioner is equipped with a control-information detecting apparatus for it according to a sixth embodiment (embodiment 6) of the present invention.
Figure 17:
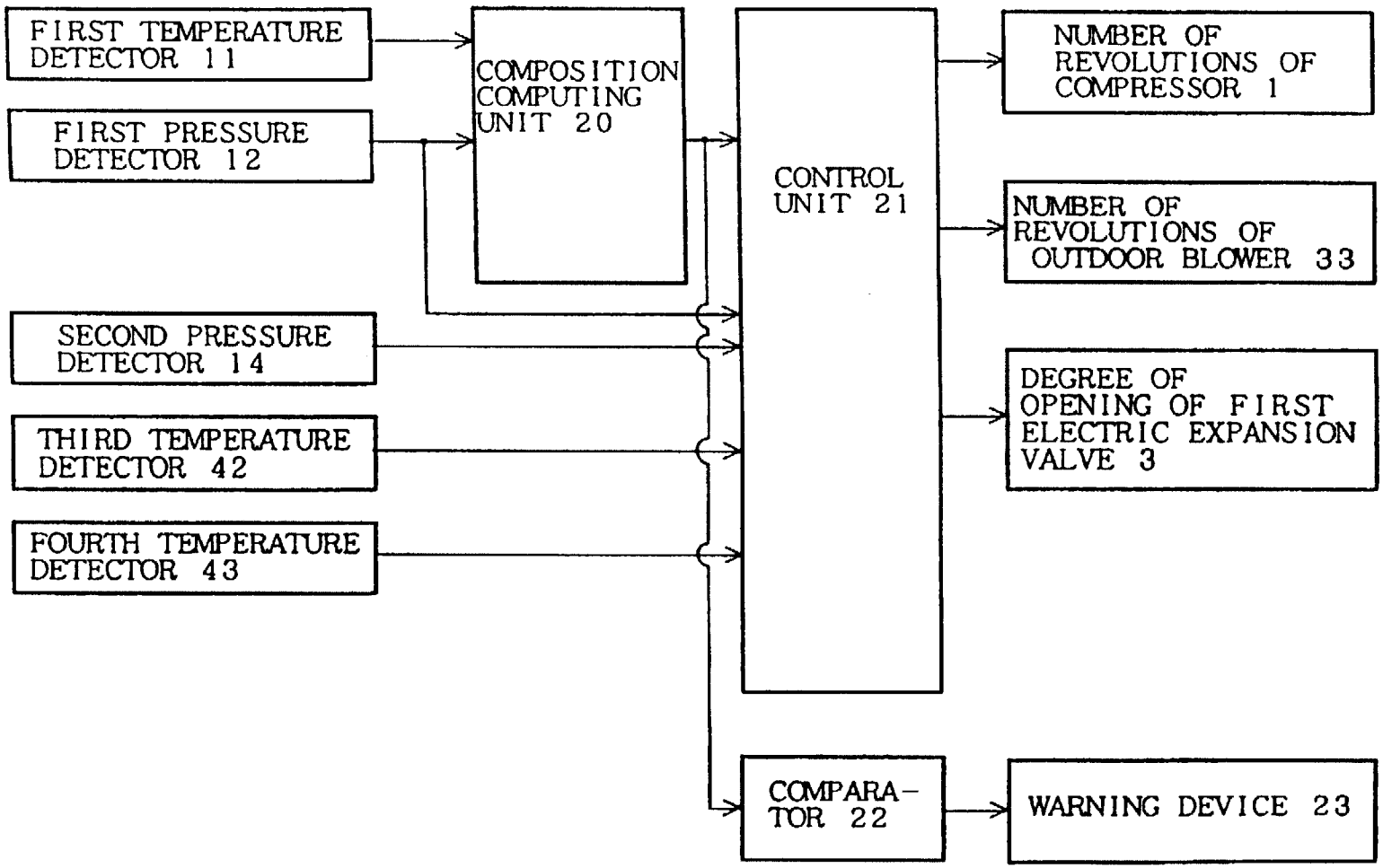
FIG. 17 is a control block diagram of a refrigeration air-conditioner using a non-azeotrope refrigerant, which air-conditioner is equipped with a control-information detecting apparatus for it according to the embodiment 6.

FIG. 16 is a block diagram showing the construction of a refrigeration air-conditioner using a non-azeotrope refrigerant, which air-conditioner is equipped with a control-information detecting apparatus for it according to a sixth embodiment of the present invention; and FIG. 17 is a control block diagram of the air-conditioner. The same reference numerals in FIG. 11 and FIG. 16 designate the same elements. The refrigerant circulates to the directions shown by the arrows of the full lines in FIG. 16 at the time of the operation of air heating, and circulates to the directions shown by the arrows of the dotted lines in FIG. 16 at the time of the operation of air cooling. In the present embodiment, only the signals from the first temperature detector 11 and the first pressure detector 12 input into the composition computing unit 20. The composition computing unit 20 computes circulation compositions only on the signals from the first temperature detector 11 and the first pressure detector 12 by supposing that the dryness X of the refrigerant flowing into the decompressing device 51 of the bypass pipe 50, for example, is 0.1 at the time of the operation of air heating and 0.2 at the time of the operation of air cooling. The operation of the control unit 21 and the comparator 22 is the same as that of the embodiment 5. The control-information detecting apparatus comprises these temperature detector 11, pressure detector 12, and the composition computing unit 20.

Consequently, the computations in the composition computing unit 20 of the control information detecting apparatus of the present embodiment is simplified similarly to the embodiment 2, and an apparatus similar to the embodiment 5 is realized with a simple construction cheap in cost.

EMBODIMENT 7

Figure 18:
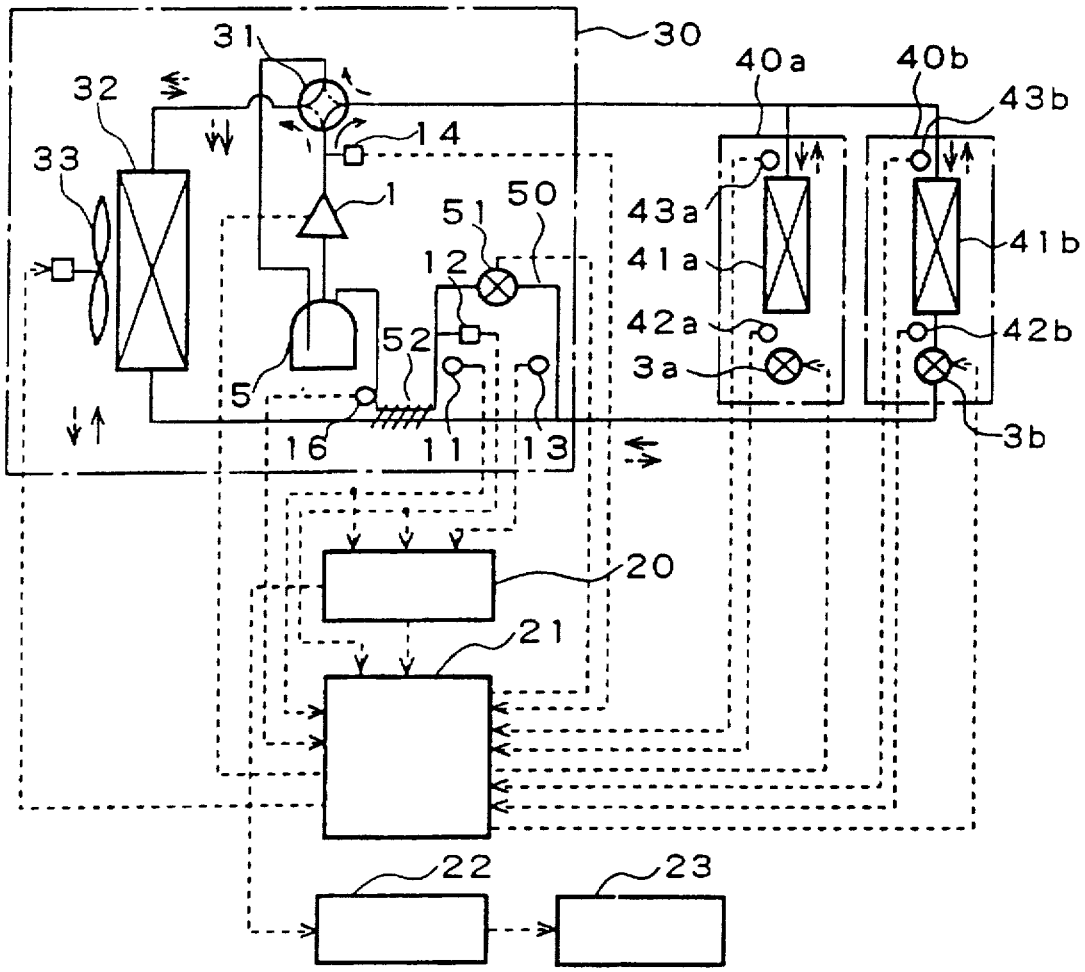
FIG. 18 is a block diagram showing the construction of a refrigeration air-conditioner using a non-azeotrope refrigerant, which air-conditioner is equipped with a control-information detecting apparatus for it according to a seventh embodiment (embodiment 7) of the present invention.
Figure 19:
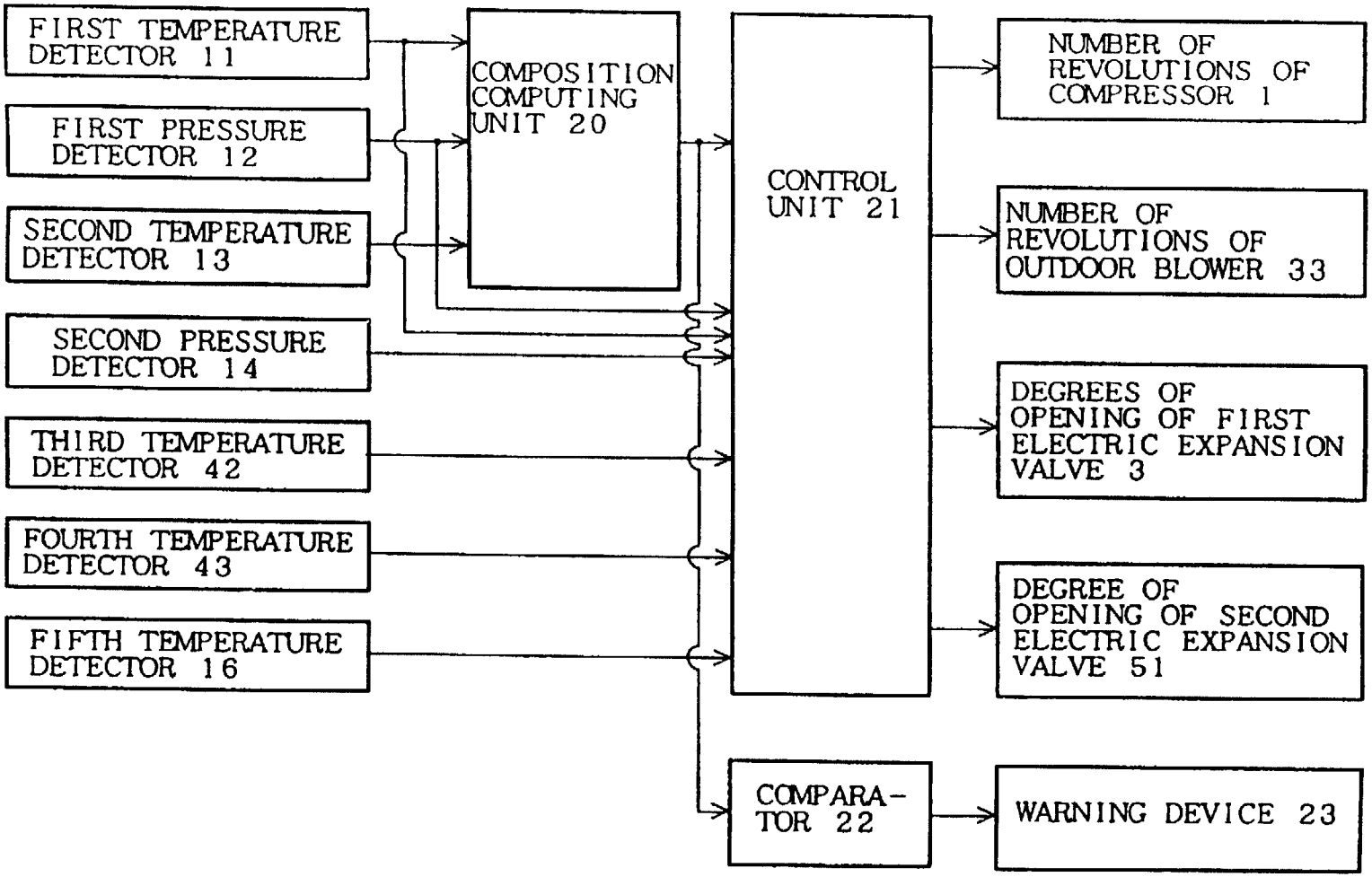
FIG. 19 is a control block diagram of a refrigeration air-conditioner using a non-azeotrope refrigerant, which air-conditioner is equipped with a control-information detecting apparatus for it according to the embodiment 7.

FIG. 18 is a block diagram showing the construction of a refrigeration air-conditioner using a non-azeotrope refrigerant, which air-conditioner is equipped with a control-information detecting apparatus for it according to a seventh embodiment of the present invention; and FIG. 19 is a control block diagram of the air-conditioner. The same reference numerals in FIG. 11 and FIG. 18 designate the same elements. The refrigerant circulates to the directions shown by the arrows of the full lines in FIG. 18 at the time of the operation of air heating, and circulates to the directions shown by the arrows of the dotted lines in FIG. 18 at the time of the operation of air cooling. The bypass pipe 50 is equipped with a second decompressing device 51 using an electric expansion valve, the degree of opening of which is controlled by the control unit 21. A heat exchanging section 52 for exchanging the heat thereof with a pipe (main pipe) connecting the outdoor heat exchanger 32 with first decompressing devices 3 using electric expansion valves is formed at an intermediate position of the bypass pipe 50. Because the heat exchanging section 52 transmits the enthalpy of the refrigerant flowing in the bypass pipe 50 to the refrigerant flowing in the main pipe, the enthalpy is collected for preventing energy loss. A fifth temperature detector 16 is equipped at the exit of the heat exchanging section 52, and the signals detected by the fifth temperature detector 16 is sent to the control unit 21.

Because only the method of controlling the second decompressing device 51 equipped on the bypass pipe 50 is different from that of the embodiment 6 of the operation of the control unit 21 of the present embodiment, hereinafter the method of controlling the second decompressing device 51 will be described. The degree of opening of the electric expansion valve of the decompressing device 51 is controlled so that the difference between the temperatures at the entrance and the exit of the heat exchanging section 52 formed on the bypass pipe 50 becomes a prescribed value (for example 10° C.). That is to say, the signals respectively detected by the first temperature detector 11 and the fifth temperature detector 16, both of which are equipped on the bypass pipe 50, are transmitted to the control unit 21, which computes the temperature difference between the signals respectively detected by the first temperature detector 11 and the fifth temperature detector 16 by using a feed back control such as the PID control for obtaining a modifying value to the degree of opening of the electric expansion valve of the second decompressing device 51 in accordance with the difference between the temperature difference and the prescribed value (for example 10° C.). Then, the unit 21 outputs a command of the degree of opening of the electric expansion valve to the second decompressing device 51. The refrigerant flowing form the bypass pipe 50 to the accumulator 5 is always in a vapor state by thus controlling. As a result, the energy thereof is efficiently used, and the returning of liquid to the compressor 1 is prevented.

The aforementioned embodiment uses the electric expansion valve as the second decompressing device 51, but a capillary tube or the like may be used.

EMBODIMENT 8.

Figure 20:
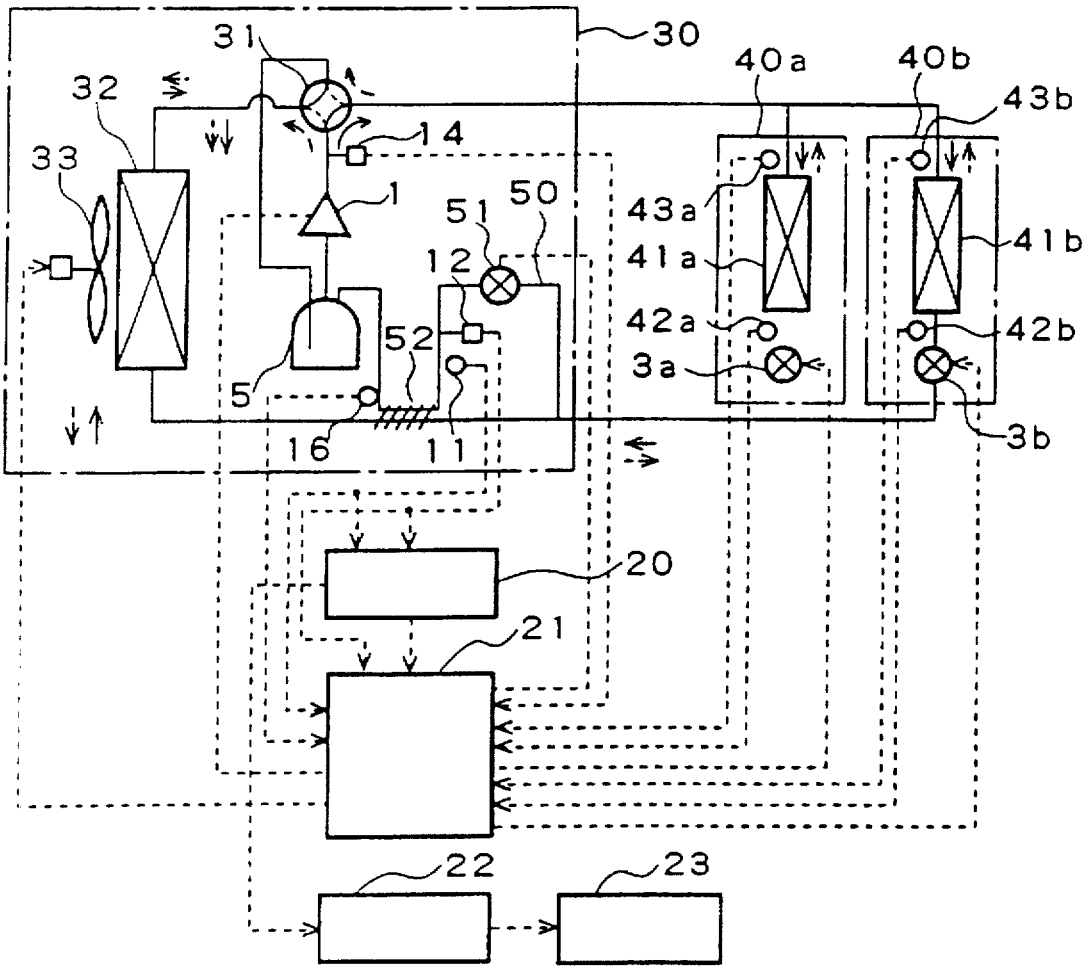
FIG. 20 is a block diagram showing the construction of a refrigeration air-conditioner using a non-azeotrope refrigerant, which air-conditioner is equipped with a control-information detecting apparatus for it according to a eighth embodiment (embodiment 8) of the present invention.
Figure 21:
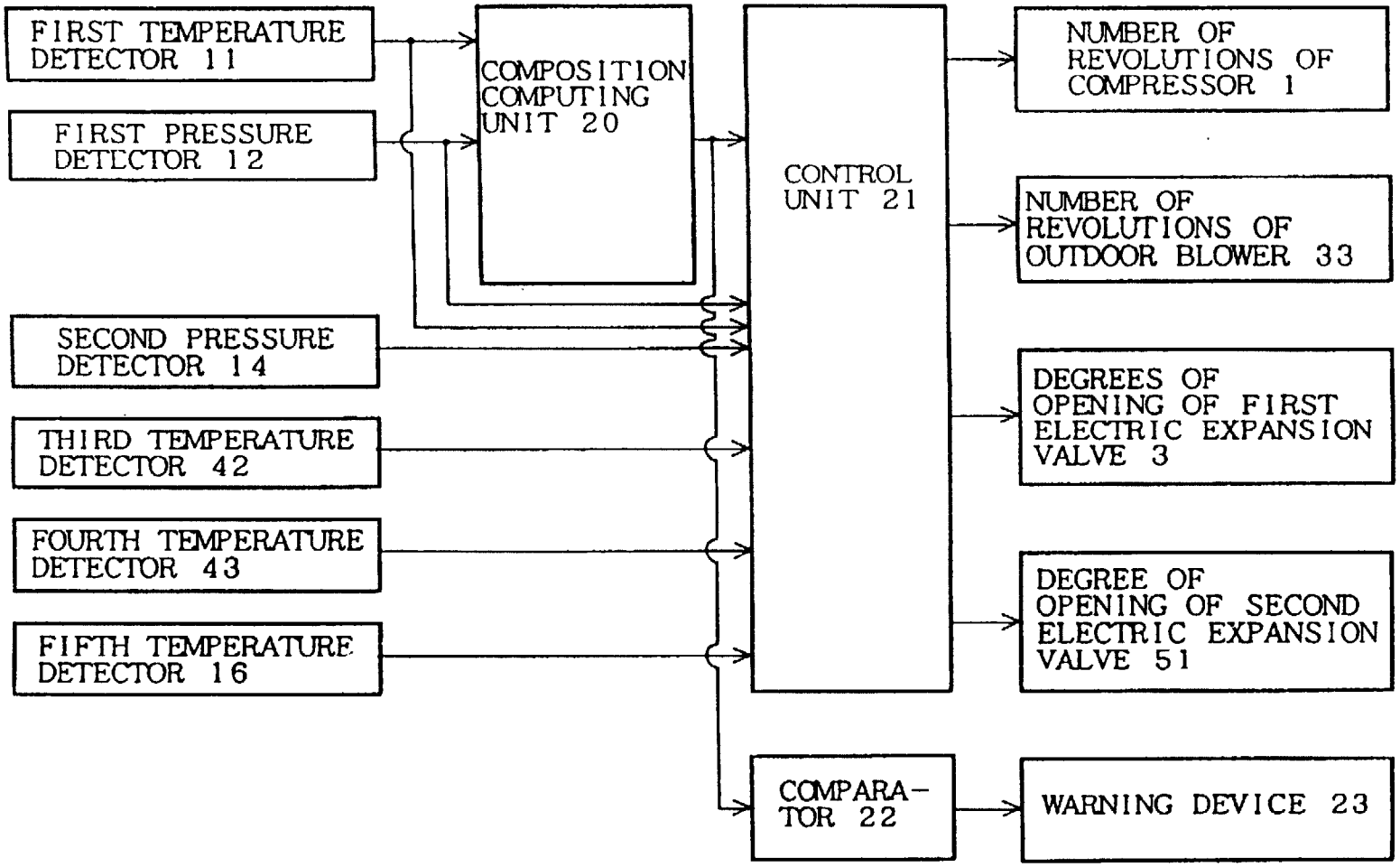
FIG. 21 is a control block diagram of a refrigeration air-conditioner using a non-azeotrope refrigerant, which air-conditioner is equipped with a control-information detecting apparatus for it according to the embodiment 8.

FIG. 20 is a block diagram showing the construction of a refrigeration air-conditioner using a non-azeotrope refrigerant, which air-conditioner is equipped with a control-information detecting apparatus for it according to a eighth embodiment of the present invention; and FIG. 21 is a control block diagram of a refrigeration air-conditioner. The same reference numerals in FIG. 18 and FIG. 20 designate the same elements. The refrigerant circulates to the directions shown by the arrows of the full lines in FIG. 20 at the time of the operation of air heating, and circulates to the directions shown by the arrows of the dotted lines in FIG. 20 at the time of the operation of air cooling. In the present embodiment, only the signals from the first temperature detector 11 and the first pressure detector 12 input into the composition computing unit 20 similarly in the embodiments 2 and 6. The unit 20 computes the circulation composition of the refrigerant only on the signals from the first temperature detector 11 and the first pressure detector 12 by assuming that the dryness X of the refrigerant flowing into the second decompressing device 51 of the bypass pipe 50, for example, is 0.1 at the time of the operation of air heating and 0.2 at the time of the operation of air cooling. The operation of the control unit 21 and the comparator 22 is the same as that of the embodiment 7.

The aforementioned embodiment uses the electric expansion valve as the second decompressing device 51, but a capillary tube or the like may be used.

The refrigerant air-conditioners of the embodiments 5 through 8 comprise the accumulator 5, but the accumulator 5 is not indispensable. If the accumulator 5 is not used, the bypass pipe 50 is constructed to connect the suction pipe of the compressor 1 to the main pipe with the second decompressing device 51 between them.

The control-information detecting apparatus of the embodiments 5 through 8 comprise the comparator 22 for transmitting a warning signal to the warning device 23 at the time when the circulation composition is out of a predetermined range, but these comparator 22 and warning device 23 are not indispensable.

Also the control-information detecting apparatus of the embodiments 1 through 4 may comprise the aforementioned comparator 22 and the warning device 23. The equipped comparator 22 and the warning device 23 constitute a part of the apparatus.

EMBODIMENT 9

Figure 22:
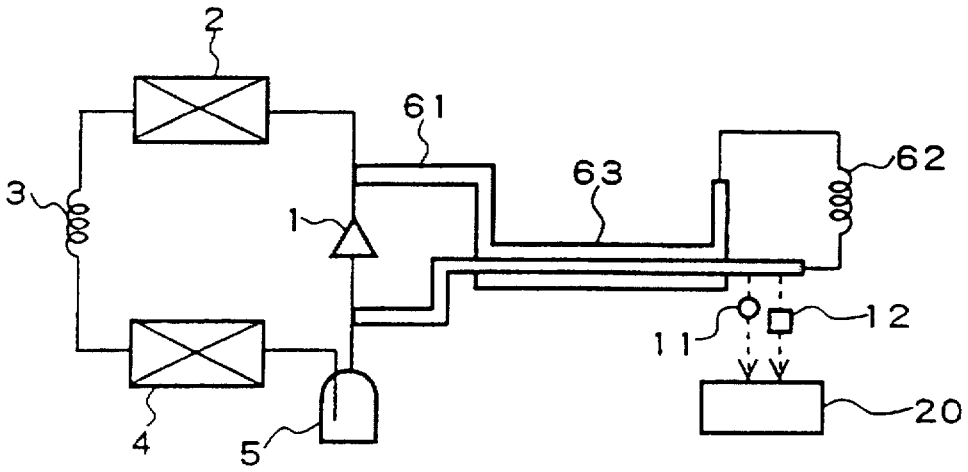
FIG. 22 is a block diagram showing the construction of a control-information detecting apparatus for a refrigeration air-conditioner using a non-azeotrope refrigerant according to a ninth embodiment (embodiment 9) of the present invention.

FIG. 22 is a block diagram showing the construction of a control-information detecting apparatus for a refrigeration air-conditioner using a non-azeotrope refrigerant according to a ninth embodiment of the present invention. In FIG. 22, reference numeral 1 designates a compressor; numeral 2 designates a condenser; numeral 3 designates a decompressing device using, for example, a capillary tube; numeral 4 designates an evaporator; and numeral 5 designates an accumulator. These elements are connected in series with a pipe between them, and compose a refrigerating cycle. For example, a non-azeotrope refrigerant composed of a high boiling component "R134*a*" and a low boiling component "R32" is filled in the refrigerating cycle.

Reference numeral 61 designates a bypass pipe for connecting the discharge pipe with the suction pipe of the compressor 1; a second decompressing device 62 composed of a capillary tube or the like is equipped at an intermediate position of the bypass pipe 61. Reference numeral 63 designates a double-pipe type heat exchanger as a cooling means for cooling the non-azeotrope refrigerant flowing into the second decompressing device 62 from the high pressure side of the bypass pipe 61; the heat exchanger 63 exchanges the heat thereof with the low pressure side of the bypass pipe 61. At the exit of the second decompressing device 62 are equipped a first temperature detector 11 for detecting the temperature of the refrigerant and a first pressure detector 12 for detecting the pressure of the refrigerant. Reference numeral 20 designates a composition computing unit, into which the signals detected by the first temperature detector 11 and the first pressure detector 12 are input.

The composition computing unit 20 has the function of computing the circulation composition of the non-azeotrope refrigerant in the refrigerating cycle of the refrigeration air-conditioner on the temperatures and the pressures at the exit of the second decompressing device 62, which temperatures and pressures are respectively detected by the first temperature detector 11 and the first pressure detector 12. These first temperature detector 11, first pressure detector 12, and composition computing unit 20 comprise a control-information detecting apparatus of the embodiment.

Next, the operation thereof will be described. The refrigerant gas in high temperature and high pressure having been compressed by the compressor 1 is condensed by the condenser 2 into liquid, and the liquefied refrigerant is decompressed by the decompressing device 3 into the refrigerant of two phases of vapor and liquid having a low pressure, which flows into the evaporator 4. The refrigerant is evaporated by the evaporator 4 and returns to the compressor 1 through the accumulator 5. Then, the refrigerant is again compressed by the compressor 1 to be sent into the condenser 2. The surplus refrigerants, which are produced at the time when the operation condition or the load condition of the air-conditioner is a specified condition, are stored in the accumulator 5. The refrigerants in the accumulator 5 are separated into liquid phase refrigerants rich in high boiling components and vapor phase refrigerants rich in low boiling components; the liquid phase refrigerants are stored in the accumulator 5. When the liquid refrigerants exist in the accumulator 5, the composition of the refrigerant circulating through the refrigerating cycle shows a tendency of becoming rich in the low boiling components (or the circulating components increase).

Figure 23:
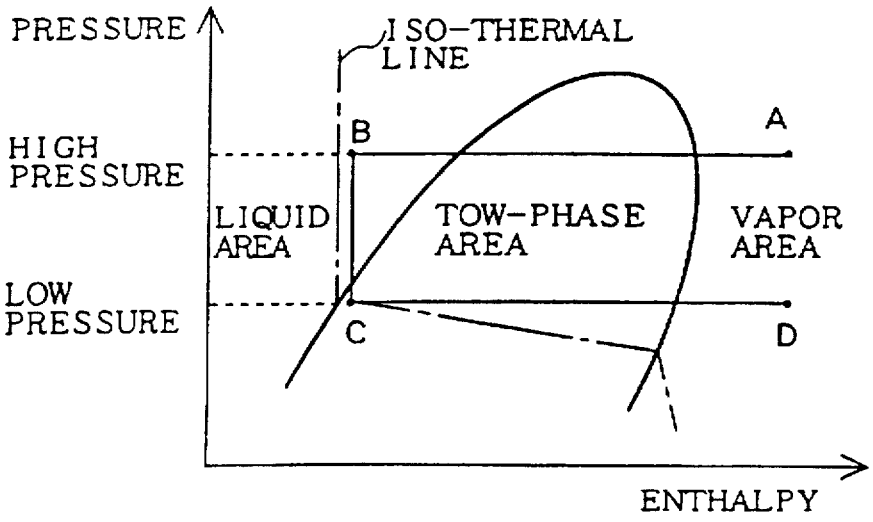
FIG. 23 is an explanatory diagram for the illustration of the operation of the composition computing unit of the embodiment 9 by using lines showing the relationships between pressures and enthalpy.

A part of the high pressure vapor refrigerants discharged by the compressor 1 flows into the bypass pipe 61 to exchange the heat thereof with low pressure refrigerants at the annular part of the double-pipe type heat exchanger 63 to be condensed into liquid. The liquefied refrigerant is decompressed by the second decompressing device 62 to flow into the inner tube of the double-pipe type heat exchanger 63 in the state of a low pressure refrigerant for exchanging the heat thereof with the high pressure refrigerant in the annular part and being evaporated. The low pressure vapor refrigerant flows into the suction pipe of the compressor 1. FIG. 23 shows the changes of states of the refrigerant in the bypass pipe 61 with a diagram showing the relationships between pressures and enthalpy. In FIG. 23, point "A" designates the state of the non-azeotrope refrigerant at the entrance on the high pressure side of the double-pipe type heat exchanger 63; point "B" designates the state of the refrigerant at the exit on the high pressure side of the heat exchanger 63 or the entrance of the second decompressing device 62; point "C" designates the state of the refrigerant at the entrance on the low pressure side of the heat exchanger 63 or the exit of the decompressing device 62; and point "D" designates the state of the refrigerant at the exit on the low pressure side of the heat exchanger 63.

Because the heat exchanger 63 is designed to exchange heat between the high pressure refrigerant and the low pressure refrigerant sufficiently, and because the isothermal line is almost perpendicular at the liquid phase area as shown with the alternate long and short dash line in FIG. 23 the temperature of the refrigerant at the exit on the high pressure side of the heat exchanger 63 represented by the point "B" is cooled near to the temperature of the refrigerant at the entrance on the low pressure side of the heat exchanger 63 represented by the point "C". Furthermore, because the refrigerant passing through the second decompressing device 62 expands in the state of iso-enthalpy, almost all of the refrigerant at the entrance on the low pressure side of the heat exchanger 63 represented by the point "B" becomes the saturated liquid state in a low pressure.

Figure 24:
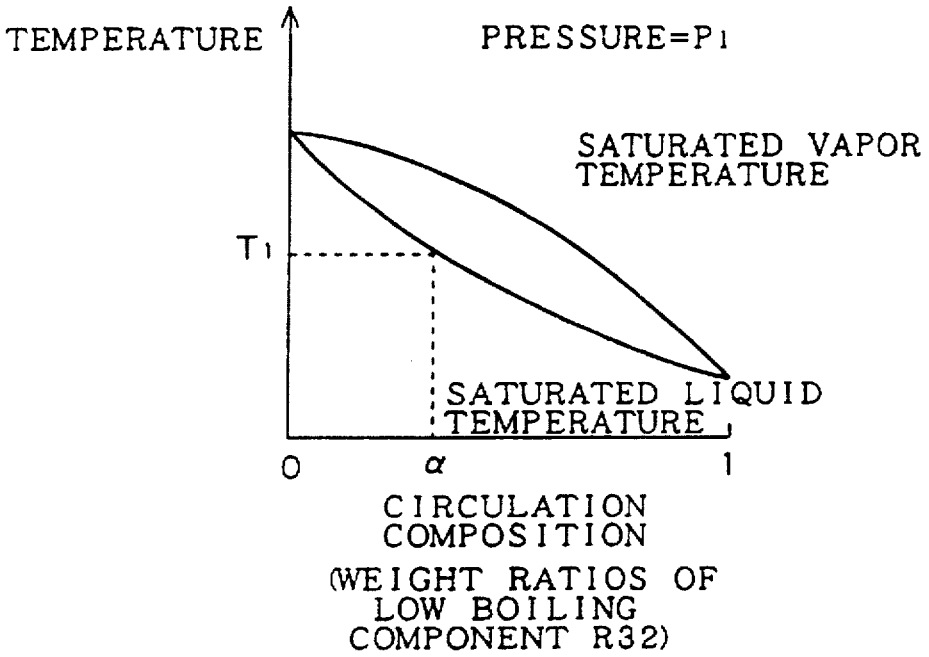
FIG. 24 is an explanatory diagram for the illustration of the operation of the composition computing unit of the embodiment 9 by using the relationships between the temperatures of a non-azeotrope refrigerant and circulation compositions.
Figure 25:
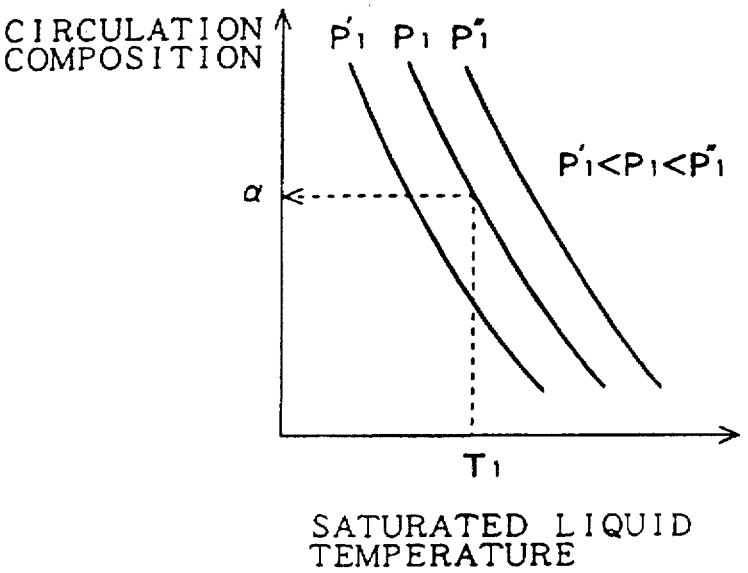
FIG. 25 is an explanatory diagram for the illustration of the operation of the composition computing unit of the embodiment 9 by using the relationships among the compositions, the saturated liquid temperatures, and the pressures of a circulating non-azeotrope refrigerant.

Next, the operation of the composition computing unit 20 will be described in connection with the vapor-liquid equilibrium diagram of FIG. 24. The unit 20 takes therein the temperature T1 and the pressure P1 of the refrigerant in a saturated liquid state of a low pressure at the exit of the second decompressing device 62 with the first temperature detector 11 and the first pressure detector 12. The saturated liquid temperature of the non-azeotrope refrigerant at the pressure P1 varies according to the circulation composition in the refrigerating cycle, or the circulation composition in the bypass pipe 61, as shown in FIG. 24. The circulation composition is represented by the weight ratio of the low boiling components of the non-azeotrope refrigerant. Consequently, the circulation composition α in the refrigerating cycle can be detected from the temperature T1 and the pressure P1 detected by the first temperature detector 11 and the first pressure detector 12 respectively by using the relationships shown in FIG. 24. FIG. 25 is a diagram showing the relationships among the saturated liquid temperatures T1, the pressures P1, and the circulation compositions α obtained from the vapor-liquid equilibrium diagram of the non-azeotrope refrigerant shown in FIG. 24. By memorizing these relationships in the composition computing unit 20 previously, the circulation composition α can be computed on the temperature T1 and the pressure P1. The relationships shown in FIG. 25 can be expressed in, for example, the following formula.

$$\alpha=(a\cdot T12+b\cdot T1+c)\times(d\cdot P12+e\cdot P1+f)$$

where a, b, c, d, e, and f respectively designates a constant.

The composition computing unit 20 computes the circulation composition α by means of the aforementioned formula.

Figure 26:
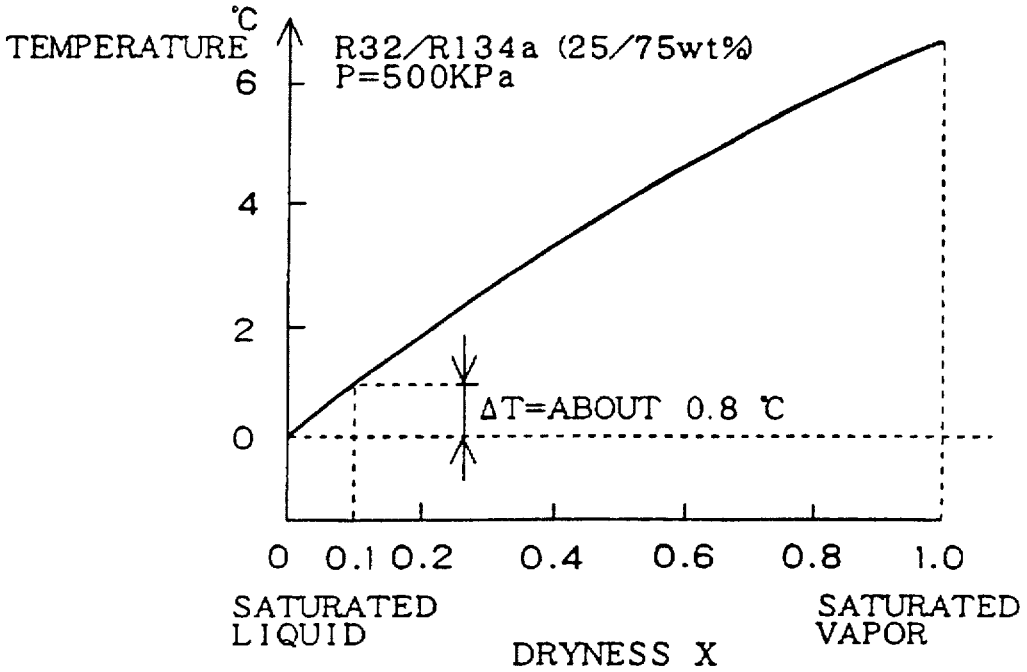
FIG. 26 is an explanatory diagram for the illustration of the operation of the composition computing unit of the embodiment 9 by using the relationships between the temperatures of a refrigerant and the dryness thereof.

The method of detecting the circulation composition concerns the saturated liquid state refrigerant at the entrance on the low pressure side of the heat exchanger 63, but the detection accuracy of the circulation composition is fully secured even if the refrigerant at the entrance does not reach to the saturated liquid state but comes to a two-phase state of vapor and liquid owing to the insufficient heat exchanging in the heat exchanger 63. This is why the changes of the equilibrium temperatures of the non-azeotrope refrigerant composed of, for example, "R32" and "R134*a*" to the change of the dryness thereof in the two-phase state of vapor and liquid is small as shown in FIG. 26. FIG. 26 is a diagram showing the changes of the equilibrium temperatures to the dryness X in two-phase state of vapor and liquid of the non-azeotrope refrigerant having been made by mixing "R32" and "R134*a*" in the pressure of 500 kilo-Pa at 25% and 75% in weight ratios; respectively. As for "R32" and "R134*a*", the difference between the saturated liquid temperature (the temperature at X=0) and the saturated vapor temperature (the temperature at X=1) is a small value around 6° C., and the difference between the equilibrium temperature at 0.1 of X and the saturated liquid temperature is a small value around 0.8° C. consequently. Therefore, even if the refrigerant at the entrance on the low pressure side of the heat exchanger 63 becomes the two-phase state of vapor and liquid, the dryness X of which is about 0.1, the difference between the temperature of the refrigerant in the two-phase state and the temperature of the refrigerant in the saturated liquid state is vary small in the circulation composition detecting method of the present embodiment, and consequently, the accuracy of detecting the circulation composition is practically secured sufficiently.

The present embodiment uses the double-pipe type heat exchanger 63 for exchanging the heat thereof with the refrigerant on the low pressure side as a cooling means for the refrigerant on the high pressure side, but similar effects can be obtained by exchanging the heat by touching the pipe on the high pressure side and the pipe on the low pressure side to each other.

The mixed refrigerant, which is a two-component system in the present embodiment, may be a multi-component system such as a three-component system for obtaining similar effects.

EMBODIMENT 10

Figure 27:
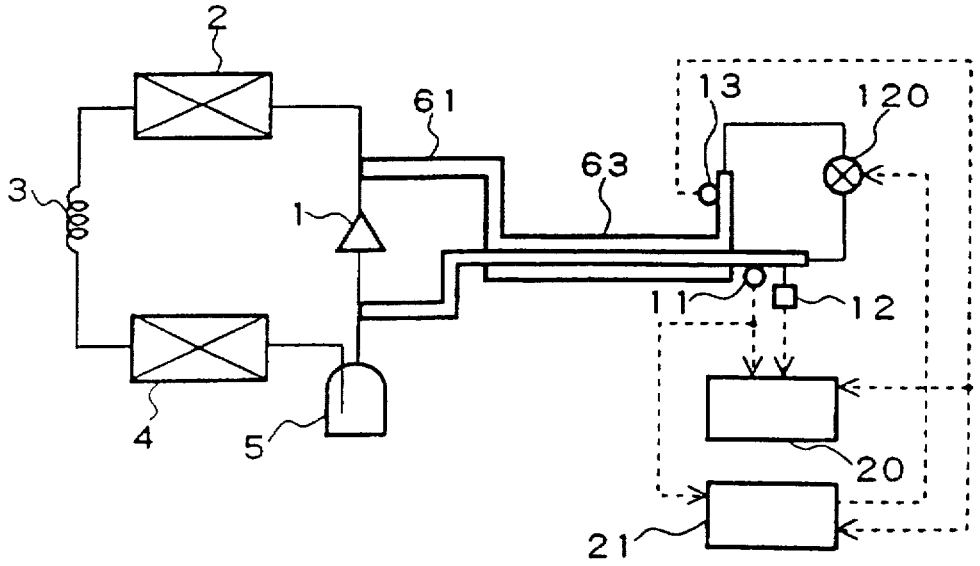
FIG. 27 is a block diagram showing the construction of a refrigeration air-conditioner using a non-azeotrope refrigerant, which air-conditioner is equipped with a control-information detecting apparatus for it according to a tenth embodiment (embodiment 10) of the present invention.

FIG. 27 is a block diagram showing the construction of a refrigeration air-conditioner using a non-azeotrope refrigerant, which air-conditioner is equipped with a control-information detecting apparatus for it according to a tenth embodiment of the present invention. The embodiment uses a second decompressing device 120 using an electric expansion valve. At the entrance of the decompressing device 120 is equipped a second temperature detector 13 for detecting the temperature of the refrigerant at that place. The composition computing unit 20 has the function of computing the dryness of the refrigerant at the exit of the decompressing device 120 and the circulation composition of the non-azeotrope refrigerant in the refrigerating cycle on the temperatures and the pressures respectively detected by the first temperature detector 11, the first pressure detector 12, and the second temperature detector 13. Reference numeral 21 designates a control unit for the decompressing device 120, which unit 21 has the function of controlling the degree of opening of the electric expansion valve on the temperature at the exit of the decompressing device 120 detected by the first temperature detector 11 and the temperature at the exit on the low pressure side of the double-pipe type heat exchanger 63 detected by the second temperature detector 13.

Figure 28:
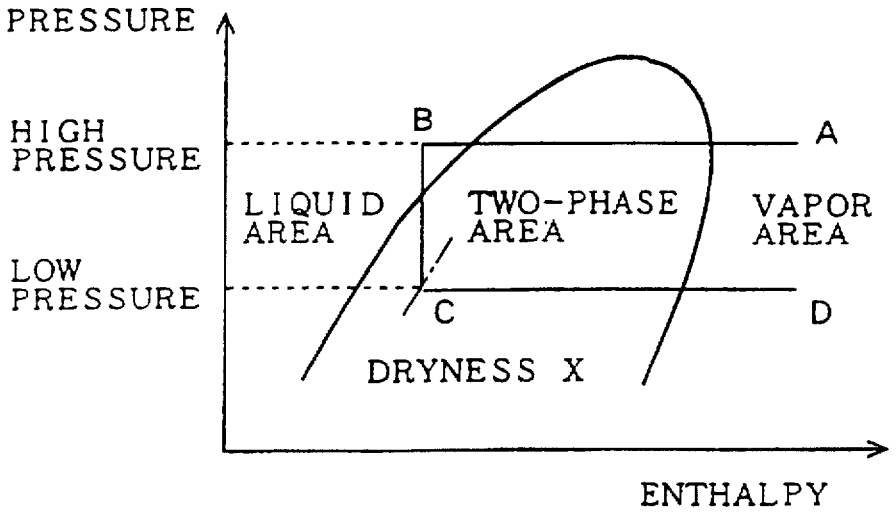
FIG. 28 is an explanatory diagram for the illustration of the operation of the composition computing unit of the embodiment 10 by using lines showing the relationships between pressures and enthalpy.

Next, the operation thereof will be described. A part of the vapor refrigerant in a high pressure having discharged from the compressor 1 flows into the bypass pipe 61 to exchange the heat thereof with low pressure refrigerants at the annular part of the heat exchanger 63 to be condensed into liquid. The liquid refrigerant is decompressed by the decompressing device 120 to flow into the inner tube of the heat exchanger 63 in the state of low pressure two-phase refrigerant of vapor and liquid, the dryness of which is X. Then, the two-phase refrigerant exchanges the heat thereof with the high pressure refrigerant in the annular part to be evaporated. The low pressure vapor refrigerant flows into the suction pipe of the compressor 1. FIG. 28 shows the changes of states of the refrigerant in the bypass pipe 61 with a diagram showing the relationships between pressures and enthalpy. In FIG. 28, point "A" designates the state of the refrigerant at the entrance on the high pressure side of the heat exchanger 63; point "B" designates the state of the refrigerant at the exit on the high pressure side of the heat exchanger 63, or the entrance of the second decompressing device 62; point "C" designates the state of the refrigerant at the entrance on the low pressure side of the heat exchanger 63, or the exit of the second decompressing device 62; and point "D" designates the state of the refrigerant at the exit on the low pressure side of the heat exchanger 63. The heat exchanger 63 is designed to exchange heat between the high pressure refrigerant and the low pressure refrigerant sufficiently, and designed so that the refrigerants, represented by point "B", at the exit on the high pressure side of the double-pipe type heat exchanger 63, or the entrance of the decompressing device 120 become a supercooled state.

Figure 29:
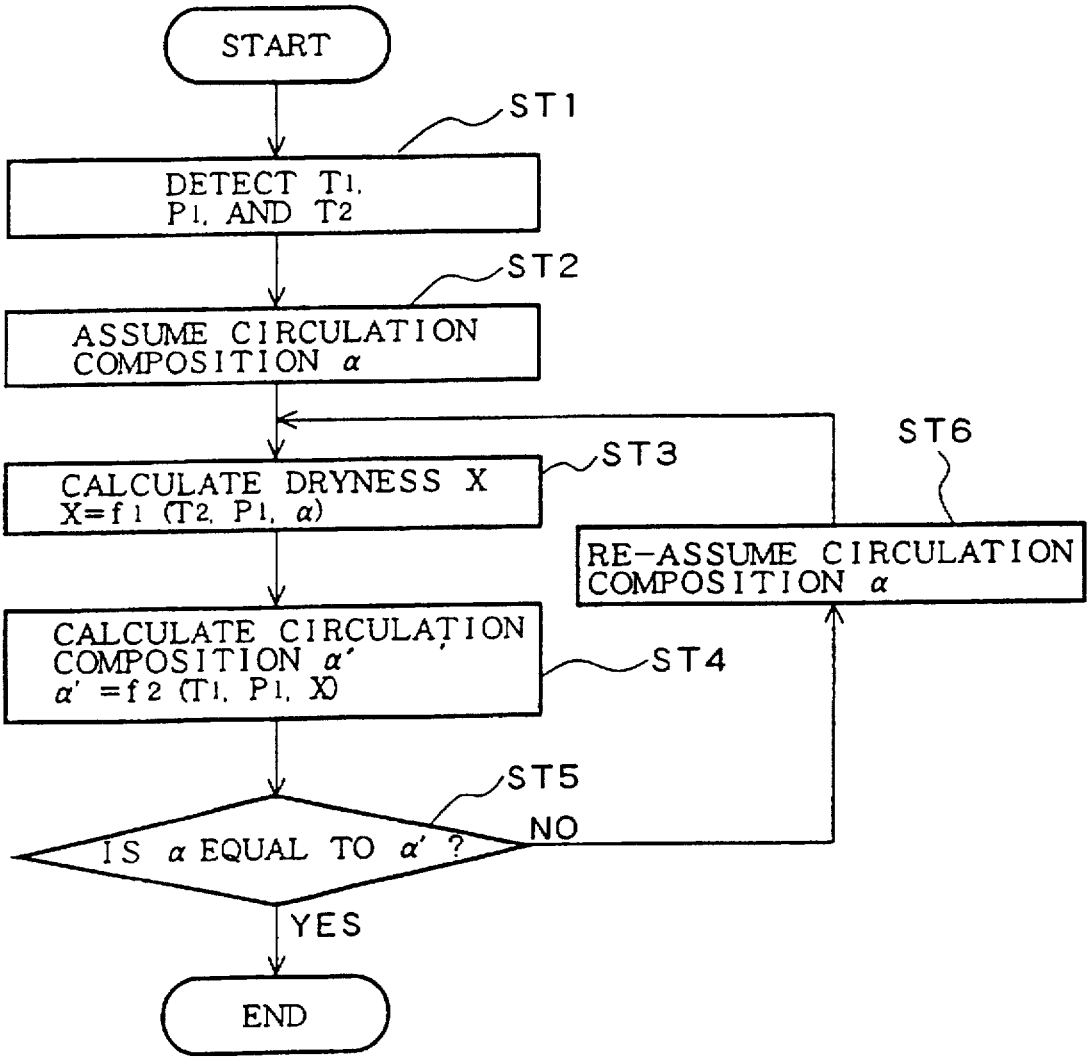
FIG. 29 is a flowchart showing the operation of the composition computing unit of the embodiment 10.
Figure 30:
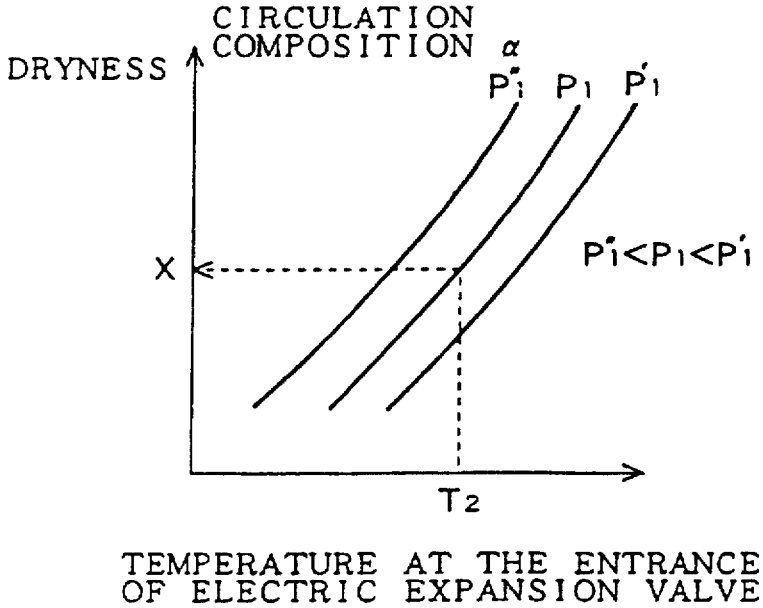
FIG. 30 is an explanatory diagram for the illustration of the operation of the composition computing unit of the embodiment 10 by using the relationships among the dryness, the temperatures, and the pressures of a circulating non-azeotrope refrigerant.

Next, the operation of the composition computing unit 20 will be described in connection with the flowchart shown in FIG. 29. When the unit 20 begins to operate, the unit 20 takes therein the temperature T1 and the pressure P1 of the refrigerant at the exit of the decompressing device 120, and the temperature T2 of the refrigerant at the entrance of the decompressing device 120, which temperatures T1, T2 and the pressure P1 are respectively detected by the first temperature detector 11, the second temperature detector 13, and the first pressure detector 12, at STEP ST1. Then, the circulation composition α in the refrigerating cycle is assumed as a certain value at STEP ST2, and the dryness X of the refrigerant at the exit of the decompressing device 120 is calculated on the assumed value α of the circulation composition, the temperature T2 at the entrance of the decompressing device 120, and the pressure P1 at the exit of the decompressing device 120 at STEP ST3. That is to say, because the refrigerant passing through the decompressing device 120 expands in the state of iso-enthalpy, the relationships shown in FIG. 30 exist in the temperature T2 at the entrance of the decompressing device 120, the pressure P2 at the exit of the decompressing device 120, and the dryness X. Accordingly, if the aforementioned relationships have been memorized in the composition computing unit 20 in advance as the following relational formula (1), the dryness X of the refrigerant at the exit of the decompressing device 120 can be computed on the temperature T2, the pressure P1, and the assumed circulation composition value α by using the formula (1).

$$X=f1(T2, P1, \alpha) \quad (1)$$

Figure 31:
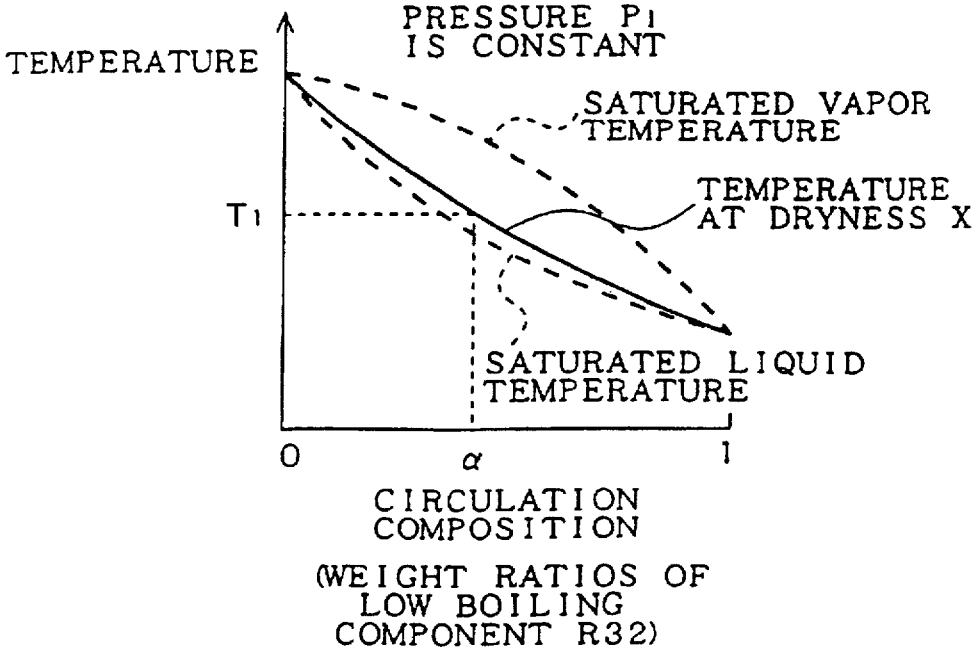
FIG. 31 is an explanatory diagram for the illustration of the operation of the composition computing unit of the embodiment 10 by using the temperatures at the dryness X of a non-azeotrope refrigerant in two phases of vapor and liquid.
Figure 32:
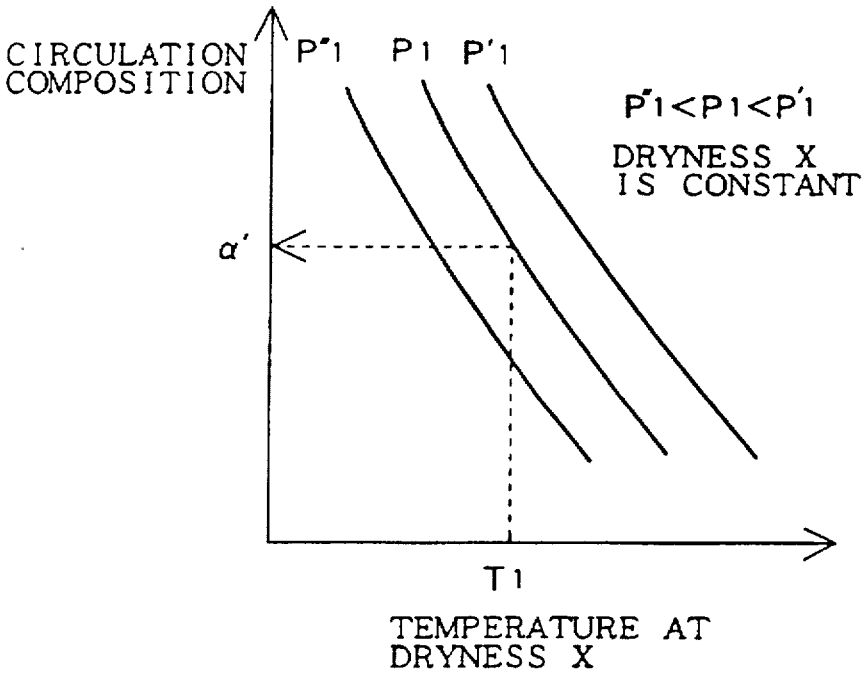
FIG. 32 is an explanatory diagram for the illustration of the operation of the composition computing unit of the embodiment 10 by using the temperatures at the dryness X of a non-azeotrope refrigerant in two phases of vapor and liquid and the circulation composition of the refrigerant.

Furthermore, at STEP ST4, a circulation composition α' is calculated from the temperature T1, the pressure P1 of the refrigerant at the exit of the decompressing device 120, and the dryness X obtained at STEP ST3. Namely, the temperature of the non-azeotrope refrigerant in two-phase state of vapor and liquid, the dryness of which is X, at the pressure P1 varies in accordance with the circulation composition in the refrigerating cycle, or the circulation composition flowing through the bypass pipe 11, as shown in FIG. 31. Accordingly, the circulation composition α' in the refrigerating cycle can be calculated on the temperature T1, the pressure P1 at the exit of the decompressing device 120, and the dryness X by using the characteristic shown in FIG. 31. FIG. 32 shows the relationships of the circulation composition α to the temperature T1, the pressure P1 at the exit of the decompressing device 120, and the dryness X from the relationships shown in FIG. 31. Accordingly, by memorizing the relationships shown in FIG. 32 in the composition computing unit 20 as the following relational formula (2) in advance, the circulation composition α' can be calculated on the temperature T2, the pressure P1 at the exit of the decompressing device 120, and the dryness X by using the formula (2).

$$\alpha'=f2(T1, P1, X) \quad (2)$$

At STEP ST5, the circulation composition α' and the circulation composition α having been assumed previously are compared. If both of them are equal, the circulation composition is obtained as the α. If both of them are not equal, the circulation composition α is re-assumed at STEP ST6. Then, the composition computing unit 20 again returns to STEP ST3 to compute the aforementioned calculations and continue them until the circulation composition α' and the circulation composition α accord with each other.

Next, the operation of the control unit 21 will be described. The unit 21 controls the degree of opening of the electric expansion valve of the decompressing device 120 so that the refrigerant at the exit on the high pressure side of the heat exchanger 63 surely becomes a supercooled state. That is to say, the unit 21 takes therein the temperature T1 at the exit of the decompressing device 120 detected by the first temperature detector 11 and the temperature T2 at the entrance of the decompressing device 120 detected by the second temperature detector 13, and computes the difference of them (or T2–T1). The unit 21 further computes a modifying value of the degree of opening of the electric expansion valve of the decompressing device 120 with a feed back control such as the PID control so that the temperature difference become a prescribed value (for example 10° C.) and below to output a command of the degree of opening to the decompressing device 120. Consequently, the refrigerant at the exit on the high pressure side of the heat exchanger 63 surely becomes supercooled condition, which makes it possible to minimize the quantity of flow of the refrigerant flowing through the bypass pipe 61 for minimizing the energy loss of the refrigerating cycle.

Since the composition computing unit 20 of the present embodiment computes the circulation composition by calculating the dryness of the refrigerant at the exit of the decompressing device 120, the circulation composition surely can be detected even if the state of the operation of the refrigerating cycle has changed to change the quantity of heat exchanged by the heat exchanger 63. And also, since the quantity of the flow of the refrigerant flowing through the bypass pipe 61 is controlled by the decompressing device 120 so that the refrigerant at the exit on the high pressure side of the heat exchanger 63 surely becomes supercooled state, the circulation composition is surely detected, and the quantity of the flow of the refrigerant flowing through the bypass pipe 61 is minimized for enabling the energy loss of the refrigerating cycle to be minimum.

EMBODIMENT 11

Figure 33:
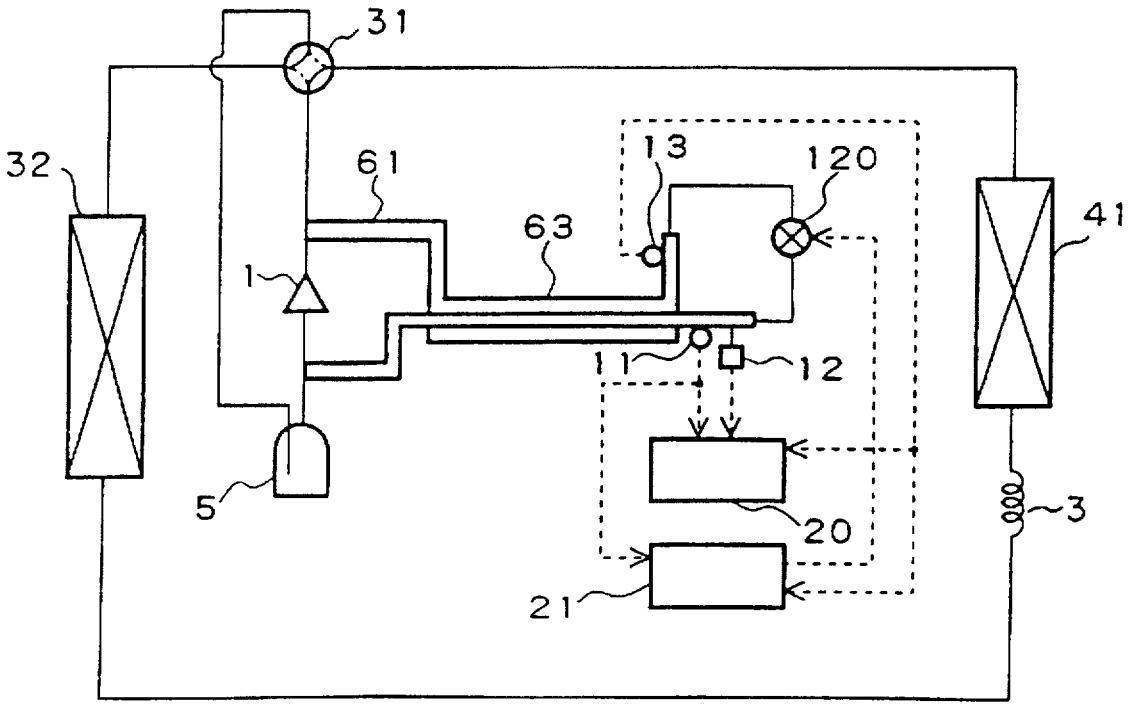
FIG. 33 is a block diagram showing the construction of a refrigeration air-conditioner using a non-azeotrope refrigerant, which air-conditioner is equipped with a control-information detecting apparatus for it according to a eleventh embodiment (embodiment 11) of the present invention.

FIG. 33 is a block diagram showing the construction of a refrigeration air-conditioner using a non-azeotrope refrigerant, which air-conditioner is equipped with a control-information detecting apparatus for it according to a eleventh embodiment of the present invention. In FIG. 33, a heat-pump type refrigerant air-conditioner, which can heating and cooling air by switching a four-way type valve 31, is shown. Reference numeral 32 designates an outdoor heat exchanger that operates as a condenser at the time of air cooling and as an evaporator at the time of air heating; and numeral 41 designates an indoor heat exchanger that operates as an evaporator at the time of air cooling and as a condenser at the time of air heating. The construction of the bypass pipe 61, the composition computing unit 20, the control unit 21, etc., is the same as that of the embodiment 10.

The principle of the detection of the circulation composition described as to the embodiment 10 is true in case of using the temperature and the pressure at the exit and the temperature at the entrance of the first decompressing device 3 in the main circuit, but because the directions of the flow of the refrigerant in the first decompressing device 3 are different in the cases of air cooling and air heating, a pair of a temperature detector and a pressure detector is needed at the exit and the entrance of the first decompressing device 3 respectively for detecting the circulation compositions at the time of air cooling and the time of air heating respectively. Thus four detectors are needed to be provided in all. But the control information detecting apparatus of the present embodiment can always detect the circulation composition with three detectors of the first temperature detector the first pressure detector 12, and the second temperature detector 13 in the bypass pipe 61 despite at the time of air cooling or the time of air heating. That is to say, the present embodiment can detect the circulation composition at the time of air cooling and the time of air heating with fewer detectors in low costs.

EMBODIMENT 12

Figure 34:
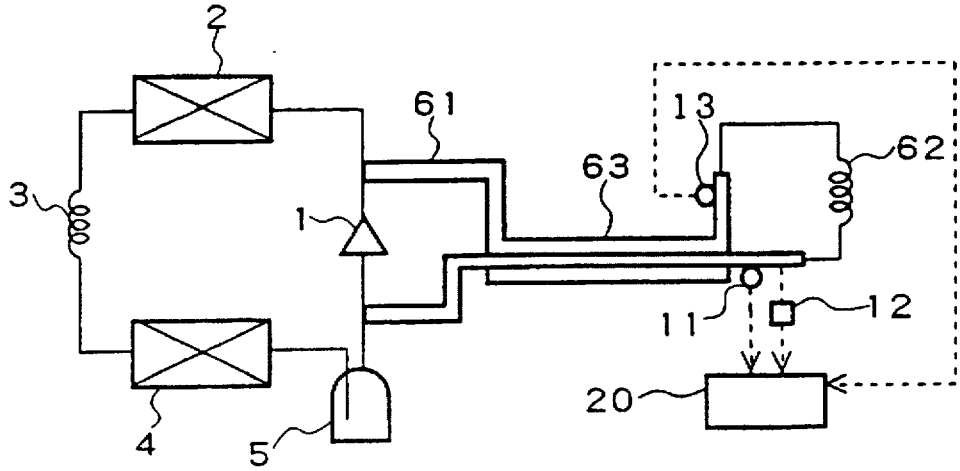
FIG. 34 is a block diagram showing the construction of a control-information detecting apparatus for a refrigeration air-conditioner using a non-azeotrope refrigerant according to a twelfth embodiment (embodiment 12) of the present invention.

FIG. 34 is a block diagram showing the construction of a control-information detecting apparatus for a refrigeration air-conditioner using a non-azeotrope refrigerant according to a twelfth embodiment of the present invention. The embodiment uses a second decompressing device 62 using a capillary tube. The operation of the composition computing unit 20 is similar to that of the embodiment 9, and consequently the description thereof is omitted. The embodiment can detect the circulation composition of the non-azeotrope refrigerant cheaply in cost by using the capillary tube cheaper than an electric expansion valve as the second decompressing device 62.

EMBODIMENT 13

Figure 35:
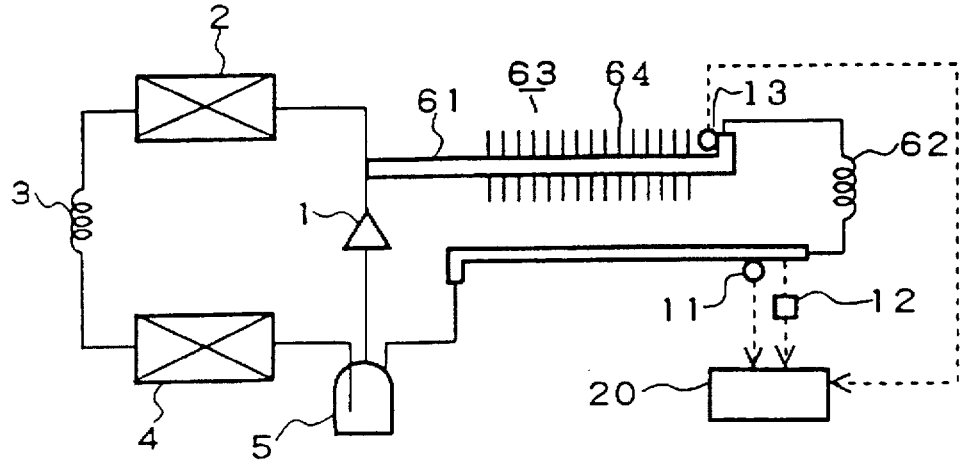
FIG. 35 is a block diagram showing the construction of a control-information detecting apparatus for a refrigeration air-conditioner using a non-azeotrope refrigerant according to a thirteenth embodiment (embodiment 13) of the present invention.

FIG. 35 is a block diagram showing the construction of a control-information detecting apparatus for a refrigeration air-conditioner using a non-azeotrope refrigerant according to a thirteenth embodiment of the present invention. The embodiment uses a double-pipe type heat exchanger 63 that exchanges the heat thereof with surrounding air for cooling the high pressure refrigerant in the bypass pipe 61. The heat of the vapor of the refrigerant lead into the bypass pipe 61 is exchanged with the surrounding air by the heat exchanger 63 to be condensed into a liquid. The liquefied refrigerant is decompressed by the decompressing device 62 into a low pressure refrigerant to flow into the accumulator 5. The double-pipe type heat exchanger 63 is equipped with fins 64 on the surface of the pipe thereof, which a high pressure refrigerant flows in, for promoting the heat exchange with the surrounding air. The operation of the computing unit 20 is similar to that of the embodiment 10, and the operation thereof is omitted. The present embodiment uses the cheap pipe equipped with fins 64 as the refrigerating means thereof, therefore it can detect the circulation composition of the non-azeotrope refrigerant cheaply in costs.

EMBODIMENT 14

Figure 36:
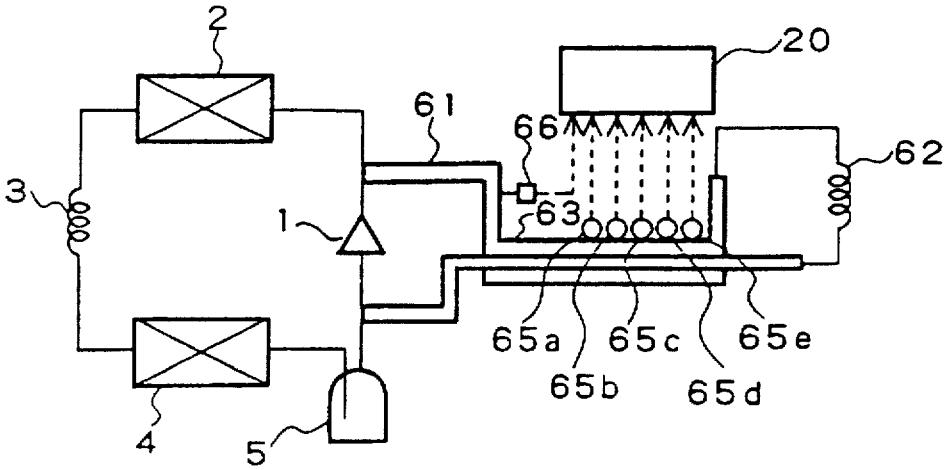
FIG. 36 is a block diagram showing the construction of a control-information detecting apparatus for a refrigeration air-conditioner using a non-azeotrope refrigerant according to a fourteenth embodiment (embodiment 14) of the present invention.

FIG. 36 is a block diagram showing the construction of a control-information detecting apparatus for a refrigeration air-conditioner using a non-azeotrope refrigerant according to a fourteenth embodiment of the present invention. The embodiment is equipped with five temperature detectors 65*a*, 65*b*, 65*c*, 65*d*, and 65*e* near the exit of the pipe on the high pressure side of the double-pipe type heat exchanger 63. And a pressure detector 66 for measuring the high pressure of the bypass pipe 61 is equipped at the entrance of the bypass pipe 61. The composition computing unit 20 has the function of computing the circulation composition of the non-azeotrope refrigerant in the refrigerating cycle on the temperatures and the pressure detected by the five temperature detectors 65 and the pressure detector 66 respectively. The embodiment uses a capillary tube as the second pressure detector 62.

Figure 37:
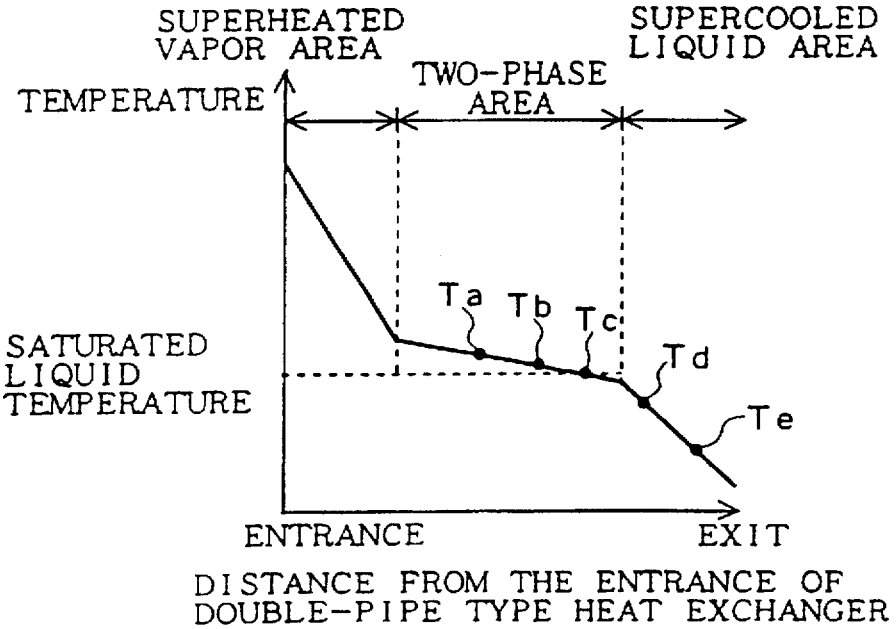
FIG. 37 is an explanatory diagram for the illustration of the operation of the composition computing unit of the embodiment 14 by using the temperatures of a non-azeotrope refrigerant at the distances from the entrance of a double-pipe type heat exchanger.

Next, the operation of the composition computing unit 20 will be described. The high pressure vapor refrigerant flown into the double-pipe type heat exchanger 63 exchanges the heat thereof with the low temperature and low pressure refrigerant to be condensed into liquid. A change of the temperature of the high pressure refrigerant is shown in FIG. 37. There exist a superheated vapor area at the entrance on the high pressure side of the heat exchanger 63, two-phase area at the intermediate part thereof, and the supercooled liquid area at the exit thereof. The values detected by the five temperature detectors 65 equipped on the pipe on the high pressure side of the heat exchanger 63 are shown in FIG. 37 as Ta, Tb, Tc, Td, and Te. Because the refrigerant in the two-phase area varies with latent heat, the variation of the temperature thereof is small, and then the variations of the detected temperatures Ta, Tb, and Tc are also small. On the other hand, because the refrigerant in the supercooled liquid area varies with sensible heat, the variation of the temperature thereof is large, and then the variations of the detected temperatures Td and Te are also large. Accordingly, by comparing the differences between the temperatures detected adjoining temperature detectors among the five detectors along the direction of the flow of the refrigerant in order, the temperature at the point where the differences varies in a large scale can be regarded as the saturated liquid temperature thereof. For example, as to the example shown in FIG. 37, by comparing the temperature differences (Ta–Tb), (Tb–Tc), (Tc–Td), (Td–Te) in the order of the direction of the flow, the temperature difference (Tc–Td) is proved to be larger than the temperature differences (Ta–Tb) and (Tb–Tc). As a result, the temperature Tc can be regarded as the saturated liquid temperature.

Figure 38:
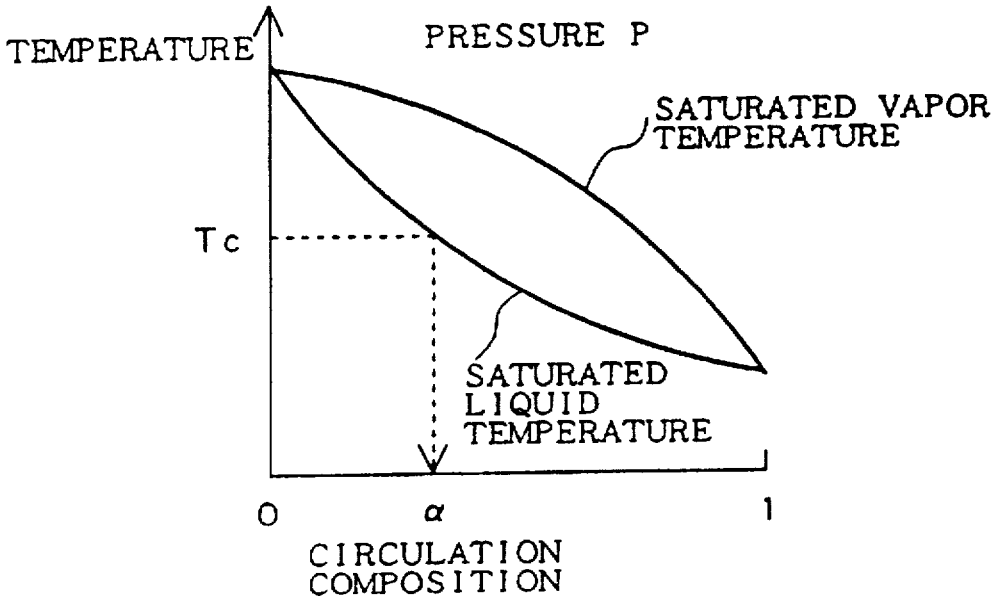
FIG. 38 is an explanatory diagram for the illustration of the operation of the composition computing unit of the embodiment 14 by using the temperatures to the compositions of a circulating non-azeotrope refrigerant.

The composition computing unit 20 computes the circulation composition $\alpha$ from the relationship among the saturated liquid temperatures, pressures, and the circulation compositions shown in FIG. 38 on the saturated liquid temperature Tc and the high pressure P detected by the pressure detector 66.

EMBODIMENT 15

Figure 39:
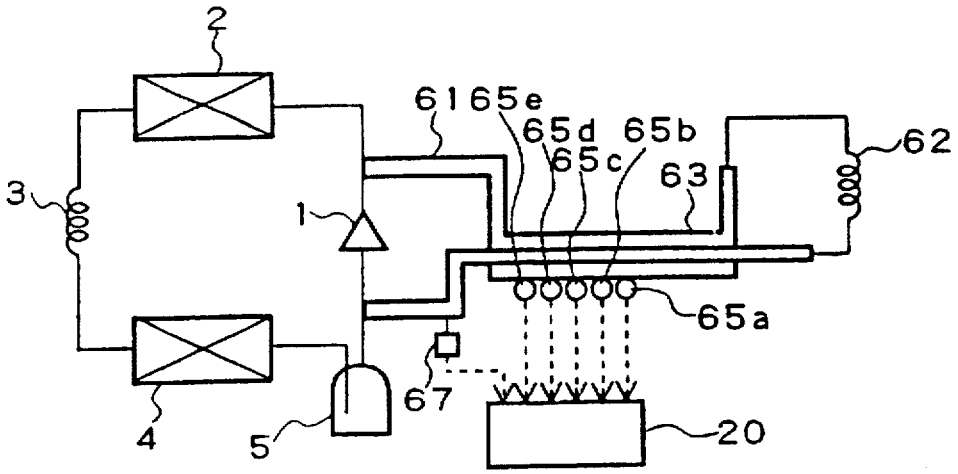
FIG. 39 is a block diagram showing the construction of a control-information detecting apparatus for a refrigeration air-conditioner using a non-azeotrope refrigerant according to a fifteenth embodiment (embodiment 15) of the present invention.

FIG. 39 is a block diagram showing the construction of a control-information detecting apparatus for a refrigeration air-conditioner using a non-azeotrope refrigerant according to a fifteenth embodiment of the present invention. The embodiment shown in FIG. 39 uses a heat exchanger composed by touching the high pressure side pipe and the low pressure side pipe of the bypass pipe 61 to each other as the double pipe type heat exchanger 63 thereof. The embodiment also uses a capillary tube as the second decompressing device 62 thereof. Five temperature detectors 65*a*–65*e* are equipped on the low pressure side pipe of the heat exchanger 63 near the exit thereof. A pressure detector 67 for detecting the low pressure in the bypass pipe 61 is attached at the exit thereof. The composition computing unit 20 has the function of computing the circulation composition of the non-azeotrope refrigerant in the refrigerating cycle on the temperature and the pressure detected by the five temperature detectors 65 and the pressure detector 67.

Figure 40:
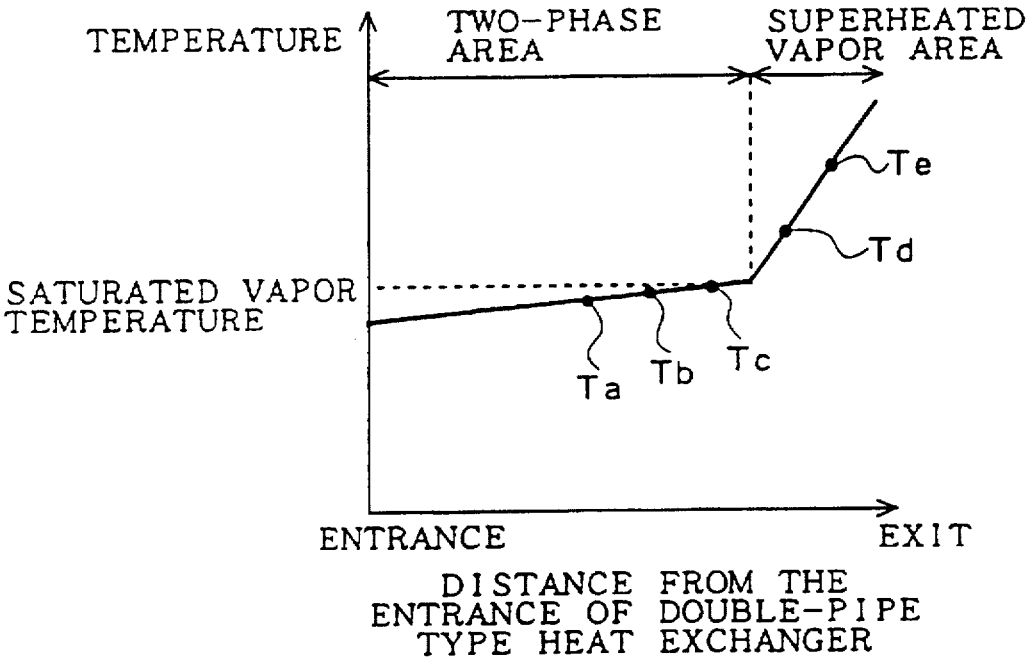
FIG. 40 is an explanatory diagram for the illustration of the operation of the composition computing unit of the embodiment 15 by using the temperatures of a non-azeotrope refrigerant at the distances from the entrance of a heat exchanger.

Next, the operation of the composition computing unit 20 will be described. The high pressure vapor refrigerant flown into the heat exchanger 63 exchanges the heat thereof with the refrigerant in a low temperature and a low pressure to be condensed into liquid. The liquefied refrigerant is decompressed by the decompressing device 62 into a two-phase refrigerant of a low pressure to be flown into the heat exchanger 63. The low pressure two-phase refrigerant is heated in the heat exchanger 63 to be a superheated vapor refrigerant, and flows into the suction pipe of the compressor 1. A temperature variation of the low pressure refrigerant is shown in FIG. 40. A two-phase area exists at the low pressure side entrance of the heat exchanger 63, and a superheated vapor area exists at the exit thereof. Five temperature values detected respectively by the five temperature detectors 65 equipped on the low pressure side pipe of the heat exchanger 63 are shown in FIG. 40 as Ta, Tb, Tc, Td, and Te. Because the refrigerant in the two-phase area varies with latent heat, the variation of the temperature thereof is small, and then the variations of the temperatures Ta, Tb, and Tc, which are detected in the two-phase area, are also small. On the other hand, because the refrigerant in the superheated vapor area varies with sensible heat, the variation of the temperature thereof is large, and then the variations of the temperatures Td and Te, which are detected in the superheated area, are also large. Accordingly, by comparing the differences between the temperatures detected adjoining temperature detectors among the five detectors along the direction of the flow of the refrigerant in order, the temperature at the point where the differences varies in a large scale can be regarded as the saturated liquid temperature thereof. For example, as to the example shown in FIG. 40, by comparing the temperature differences (Ta–Tb), (Tb–Tc), (Tc–Td), and (Td–Te) in the order of the direction of the flow, the temperature difference (Tc–Td) is proved to be larger than the temperature differences (Ta–Tb) and (Tb–Tc). As a result, the temperature Tc can be regarded as the saturated liquid temperature.

Figure 41:
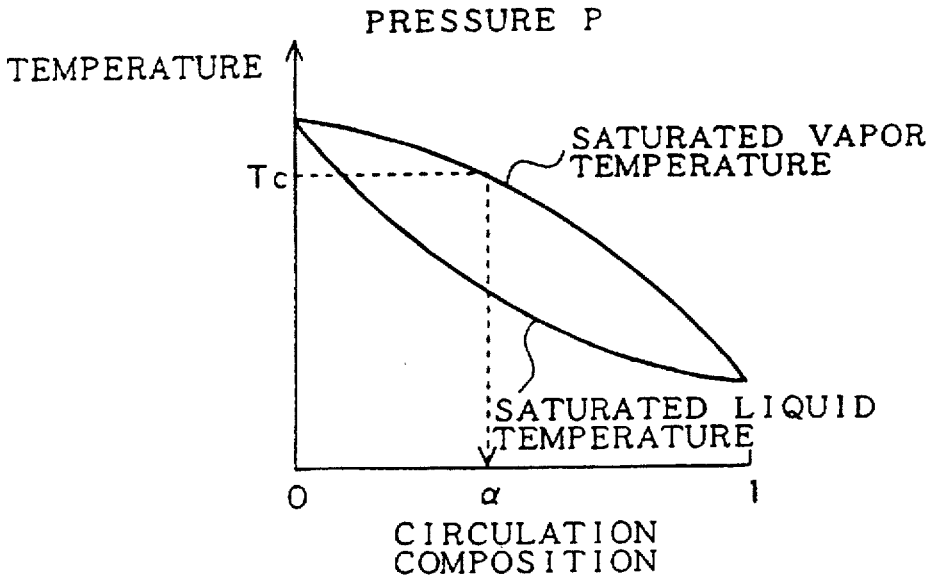
FIG. 41 is an explanatory diagram for the illustration of the operation of the composition computing unit of the embodiment 15 by using the temperatures to the compositions of a circulating non-azeotrope refrigerant.

The unit 20 computes the circulation composition a from the relationships among the saturated liquid temperatures, pressures, and the circulation compositions shown in FIG. 41 on the saturated liquid temperature Tc and the low pressure P detected by the pressure detector 67.

EMBODIMENT 16

Figure 42:
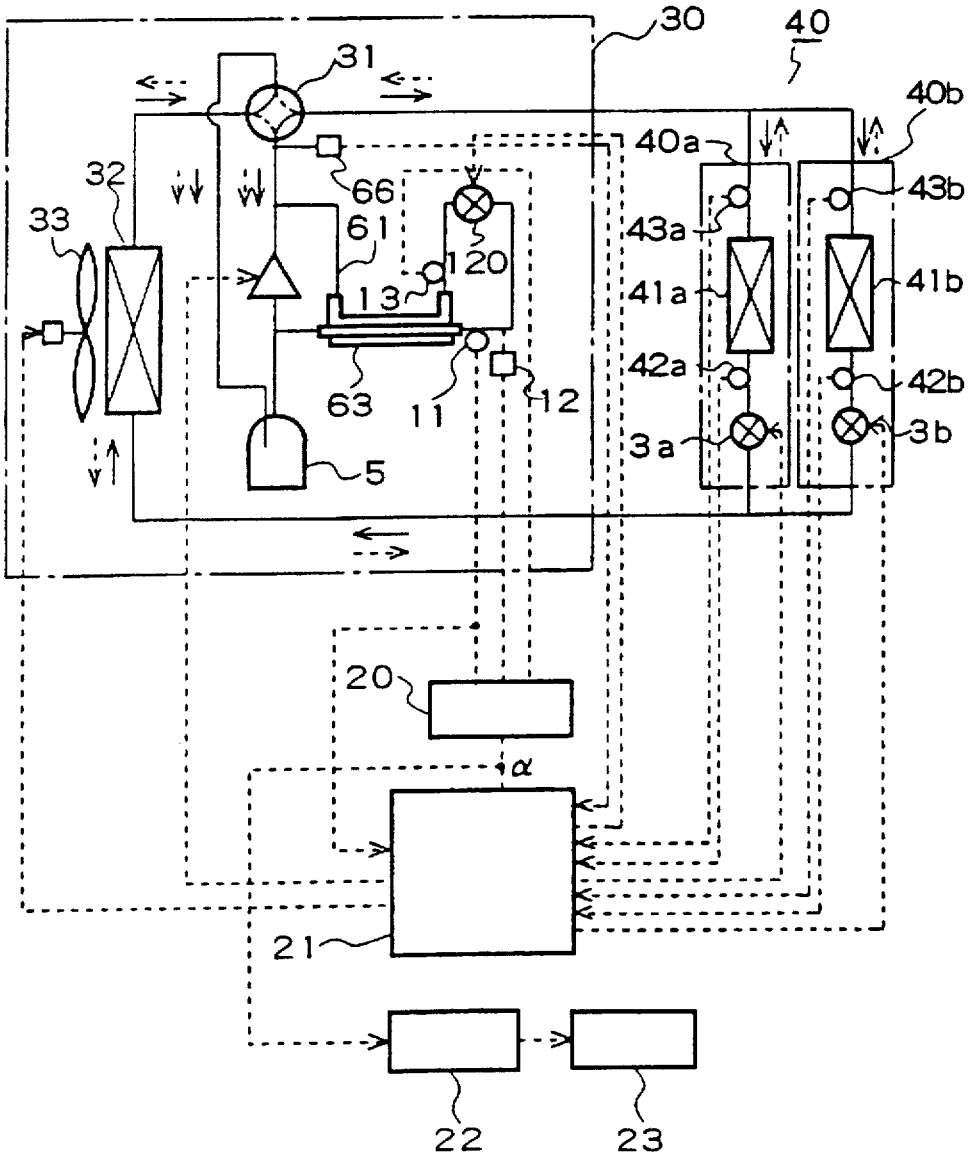
FIG. 42 is a block diagram showing the construction of a refrigeration air-conditioner using a non-azeotrope refrigerant, which air-conditioner is equipped with a control-information detecting apparatus for it according to a sixteenth embodiment (embodiment 16) of the present invention.

FIG. 42 is a block diagram showing the construction of a refrigeration air-conditioner using a non-azeotrope refrigerant, which air-conditioner is equipped with a control-information detecting apparatus for it according to a sixteenth embodiment of the present invention. A refrigeration air-conditioner composed of an outdoor unit and two indoor unit connected to the outdoor unit is shown in FIG. 42. In the figure, reference numeral 30 designates the outdoor unit comprising a compressor 1, a bypass pipe 61, an outdoor heat exchanger 32, an outdoor blower 33, and an accumulator 5. A second pressure detector 66 is equipped on the pipe on the discharge side of the compressor 1. Reference numeral 40 designates the indoor units comprising indoor heat exchangers 41*a* and 41*b* (hereinafter referred to as 41 generically) and first decompressing devices 3*a* and 3*b* (hereinafter referred to as 3 generically) using first electric expansion valves. Third heat exchangers 42*a* and 42*b* (hereinafter referred to as 42 generically) and fourth temperature detectors 43*a* and 43*b* (hereinafter referred to as 43 generically) are equipped at the entrances and the exits of the indoor heat exchangers 41 respectively. Reference numeral 61 designates the bypass pipe for connecting the discharge pipe of the compressor 1 with the suction pipe thereof. A second decompressing device 120 using an electric expansion valve is equipped at an intermediate position of the bypass pipe 61. Reference numeral 63 designates a cooling means for cooling the non-azeotrope refrigerant flowing from the high pressure side of the bypass pipe 61 into the second decompressing device 120. The cooling means 63 is composed as a double-pipe type heat exchanger for exchanging the heat thereof with the low pressure side of the bypass pipe 61. Furthermore, a first temperature detector 11 for detecting the temperature of the refrigerant and a first pressure detector 12 for detecting the pressure of the refrigerant are equipped at the exit of the second decompressing device 120. A second temperature detector 13 for detecting the temperature of the refrigerant is equipped at the entrance of the decompressing device 120. An indoor blower is also equipped in the embodiment, but is omitted to be shown in FIG. 42.

The composition computing unit 20 has the function of computing the dryness of the refrigerant at the exit of the decompressing device 120 in the bypass pipe 61 and the circulation composition of the refrigerant in the refrigerating cycle on the temperatures and the pressure detected by the temperature detectors 11, 13 and the pressure detector 12 respectively.

Reference numeral 21 designates a control unit into which the circulation composition signals from the composition computing unit 20 and the signals from the first temperature detector 11, the first pressure detector 12, the second pressure detector 66, the third temperature detectors 42 and the fourth temperature detectors 43 in the indoor units 40 are input. The control unit 21 calculates the number of revolutions of the compressor 1, the number of the revolutions of the outdoor blower 33, the degrees of opening of the electric expansion valves of the first decompressing devices 3 of the indoor units 40, and the degree of opening of the electric expansion valve of the second decompressing device 120 of the bypass pipe 61 in accordance with the circulation composition on the input signals to transmit commands to the compressor 1, the outdoor blower 33, the first decompressing devices 3, and the second decompressing device 120 respectively. The compressor 1, the outdoor blower 33, and the first and the second decompressing devices 3 and 120 receive the command values transmitted from the control unit 21 to control the numbers of revolutions of them or the degrees of opening of their electric expansion valves.

Reference numeral 22 designates a comparator, into which circulation composition signals are input from the composition computing unit 20 to compare whether the circulation compositions are within a predetermined range or not. The comparator 22 transmits a warning signal to the warning device 23, which is connected thereto, when the circulation composition is out of the predetermined range. These comparator 22 and warning device 23 are a part of the control-information detecting apparatus of the present embodiment.

Figure 43:
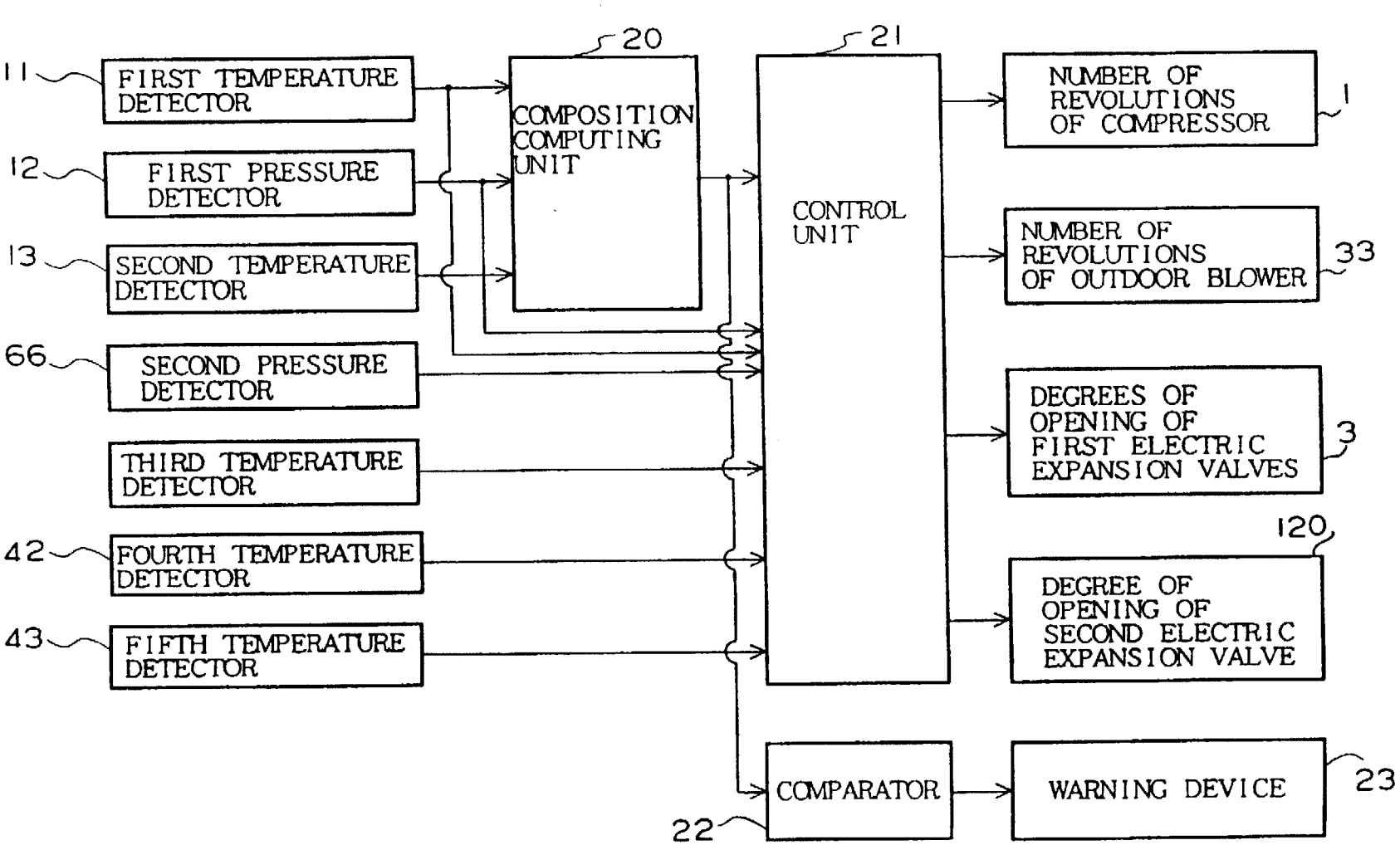
FIG. 43 is a control block diagram of a refrigeration air-conditioner using a non-azeotrope refrigerant, which air-conditioner is equipped with a control-information detecting apparatus according to the embodiment 16.

Next, the operation of the present embodiment thus constructed will be described in connection with the block diagram of FIG. 42 and the control block diagram of FIG. 43. The composition computing unit 20 takes therein the signals from the first temperature detector 11, the first pressure detector 12 and the second temperature detector 13, all of which are equipped on the bypass pipe 61, to calculate the dryness X of the refrigerant at the exit of the second decompressing device 120 similarly to the method of the embodiment 10 for computing the circulation composition $\alpha$ in the refrigerating cycle. The control unit 21 computes the command of the optimum number of revolutions of the compressor 1, the command of the optimum number of revolutions of the outdoor blower 33, the commands of the optimum degree of opening of the first decompressing devices 3, and the command of the optimum degree of opening of the second decompressing device 120 respectively in accordance with the computed circulation composition $\alpha$.

Figure 44:
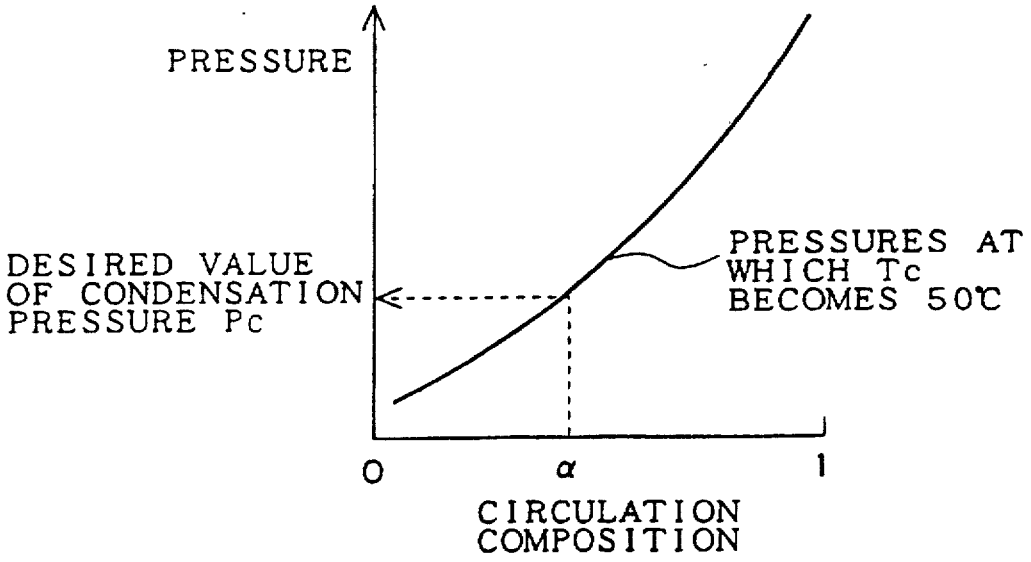
FIG. 44 is an explanatory diagram for the illustration of the operation of the composition computing unit of a control-information detecting apparatus for a refrigeration air-conditioner using a non-azeotrope refrigerant according to the embodiment 16 by using the relationship between the condensation pressures of a non-azeotrope refrigerant and circulation compositions.

At first, the operation of air heating of the air-conditioner will be described. At the time of the operation of air heating, the refrigerant circulates to the directions shown by the arrows of the full lines in FIG. 42. In this case, the outdoor heat exchanger 32 operate as an evaporator, and the indoor heat exchangers 40 operate as condensers for air heating. The number of revolutions of the compressor 1 is controlled so that the pressure of condensation accords with a desired value, at which the condensation temperature Tc becomes, for example, 50° C. If the condensation temperature of a non-azeotrope refrigerant is defined as an average value of the saturated vapor temperature thereof and the saturated liquid temperature thereof, the desired value of the condensation pressure Pc at which the condensation temperature Tc becomes 50° C. is uniquely determined in accordance with the circulation composition $\alpha$ as shown in FIG. 44. Accordingly, by memorizing the relationship shown in FIG.

44 in the control unit 21 as the following relational formula (3), the control unit 21 can compute the desired value of the condensation pressure Pc by using the relational formula (3) on the circulation composition signals α transmitted from the composition computing unit 20.

$$Pc=f3(\alpha) \quad (3)$$

The unit 21 further computes a modifying value to the number of revolutions of the compressor 1 in accordance with the difference between the pressure P2 detected by the second pressure detector 66 and the desired value of the condensation pressure Pc by using a feedback control such as the PID control to output a command of the number of revolutions to the compressor 1.

Figure 45:
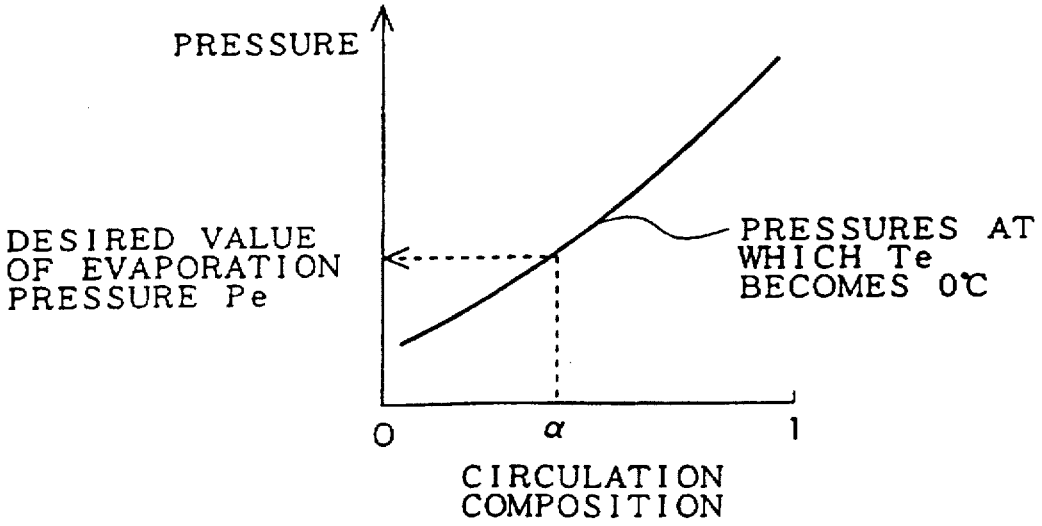
FIG. 45 is an explanatory diagram for the illustration of the operation of the composition computing unit of a control-information detecting apparatus for a refrigeration air-conditioner using a non-azeotrope refrigerant according to the embodiment 16 by using the relationship between the evaporation pressures of a non-azeotrope refrigerant and circulation compositions.

The number of revolutions of the outdoor blower 33 is controlled so that the evaporation pressure accords with a desired value, at which the evaporation temperature Te becomes 0° C. If the evaporation temperature of a non-azeotrope refrigerant is defined as an average value of the saturated vapor temperature thereof and the saturated liquid temperature thereof, the desired value of the evaporation pressure Pe, at which the evaporation temperature Te becomes 0° C., is uniquely determined in accordance with the circulation composition α as shown in FIG. 45. Accordingly, by memorizing the relationship shown in FIG. 45 in the control unit 21 as the following relational formula (4), the control unit 21 can compute the desired value of the evaporation pressure Pe by using the relational formula (4) on the circulation composition signals α transmitted from the composition computing unit 20.

$$Pe=f4(\alpha) \quad (4)$$

The control unit 21 further computes a modifying value to the number of revolutions of the outdoor blower 33 in accordance with the difference between the pressure P1 detected by the first pressure detector 12 and the desired value of the evaporation pressure Pe by using a feedback control such as the PID control to output a command of the number of revolutions to the outdoor blower 33.

Figure 46:
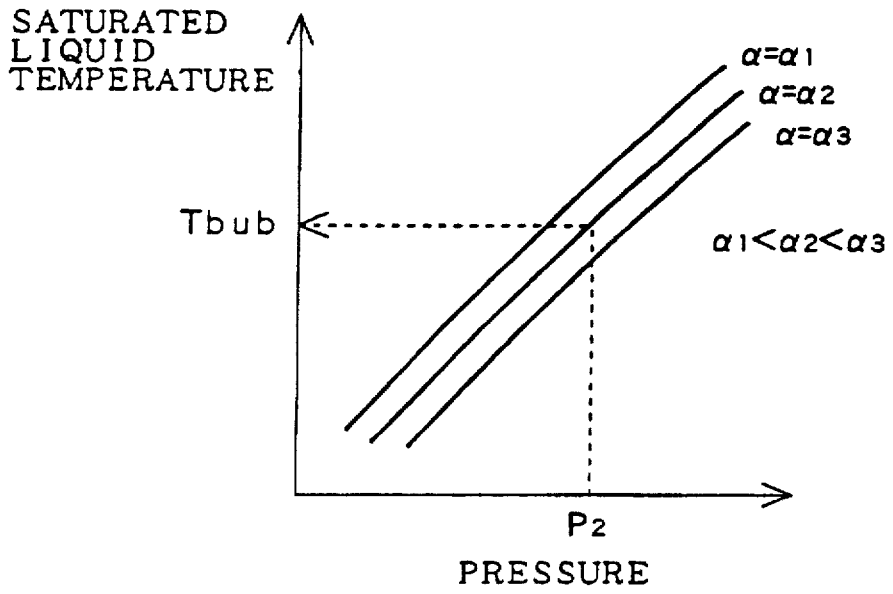
FIG. 46 is an explanatory diagram for the illustration of the operation of the composition computing unit of a control-information detecting apparatus for a refrigeration air-conditioner using a non-azeotrope refrigerant according to the embodiment 16 by using the relationships among the saturated liquid temperatures and the pressures of a non-azeotrope refrigerant and circulation compositions.

The degrees of opening of the electric expansion valves of the first decompressing devices 3 are controlled so that the degrees of supercooling at the exits of the indoor heat exchangers 40 become a predetermined value, for example, 5° C. The degrees of supercooling can be obtained as the differences between the saturated liquid temperatures at the pressures in the indoor heat exchangers 40 and the temperatures at the exits of the heat exchangers 40, and the saturated liquid temperatures can be obtained as functions of pressures and circulation compositions as shown in FIG. 46. Accordingly, by memorizing the relationships shown in FIG. 46 in the control unit 21 as the following relational formula (5), the control unit 21 can compute the saturated liquid temperature Tbub and the degrees of supercooling (Tbub−T4) at the exits of the indoor heat exchangers 40 by using the relational expression (5) on the circulation composition signals transmitted from the composition computing unit 20, the pressure signals P2 transmitted from the second pressure detector 66, and the temperature signals T4 transmitted from the third temperature detector 42.

$$Tbub=f5(P2, \alpha) \quad (5)$$

The control unit 21 further computes a modifying value to the degrees of opening of the electric expansion valves of the first decompressing devices 3 in accordance with the differences between the degrees of supercooling at the exits and a predetermined value (5° C.) by using a feedback control such as the PID control to output commands of the degrees of opening of the electric expansion valves to the decompressing devices 3.

The degree of opening of the electric expansion valve of the second decompressing device 120 is controlled so that the refrigerant at the high pressure side exit of the double-pipe type heat exchanger 63 surely becomes a supercooled state. That is to say, the control unit 21 takes therein the temperature T1 at the exit of the second decompressing device 120, which is detected by the first temperature detector 11, and the temperature T2 at the entrance of the second decompressing device 120, which is detected by the second temperature detector 13, to calculate the temperature difference (T2−T1). The control unit 21 further computes a modifying value to the degree of opening of the decompressing device 120 by using a feed back control such as the PID control so that the temperature difference becomes a predetermined value (for example 10° C.) and below to output a command of the degree of opening to the decompressing device 120. As a result, the refrigerant at the high pressure side exit of the heat exchanger 63 surely becomes a supercooled state, and the quantity of the refrigerant flowing in the bypass pipe 61 becomes minimum, which enables the energy loss of the refrigerating cycle to be minimum.

On the other hand, at the time of the operation of air cooling, the refrigerant circulates to the directions shown by the arrows of the dotted lines in FIG. 42. The outdoor heat exchanger 33 operates as a compressor, and the indoor heat exchangers 40 operate as evaporators for air cooling. The number of revolutions of the compressor 1 is controlled so that the pressure of evaporation accords with a desired value, at which the evaporation temperature Te becomes, for example, 0° C. The desired value Pe of the evaporation pressure is determined in conformity with the relational formula (4) similarly in the operation of air heating. Accordingly, the control unit 21 can compute the desired value Pe of the evaporation pressure by using the circulation composition signal a transmitted from the composition computing unit 20. The unit 21 further computes a modifying value to the number of revolutions of the compressor 1 in accordance with the difference between the pressure P1 detected by the first pressure detector 12 and the desired value Pe by using a feedback control such as the PID control to output a command of the number of revolutions to the compressor 1.

The number of revolutions of the outdoor blower 33 is controlled so that the condensation pressure accords with a desired value, at which the condensation temperature Tc becomes, for example, 50° C. The desired value Pc of the condensation pressure is determined in conformity with the relational formula (3) similarly in the operation of air heating. Accordingly, the control unit 21 can compute the desired value Pc by using the circulation composition signal a transmitted from the composition computing unit 20. The unit 21 further computes a modifying value to the number of revolutions of the outdoor blower 33 in accordance with the difference between the pressure P2 detected by the second pressure detector 66 and the desired value Pc by using a feedback control such as the PID control to output a command of the number of revolutions to the outdoor blower 33.

Figure 47:
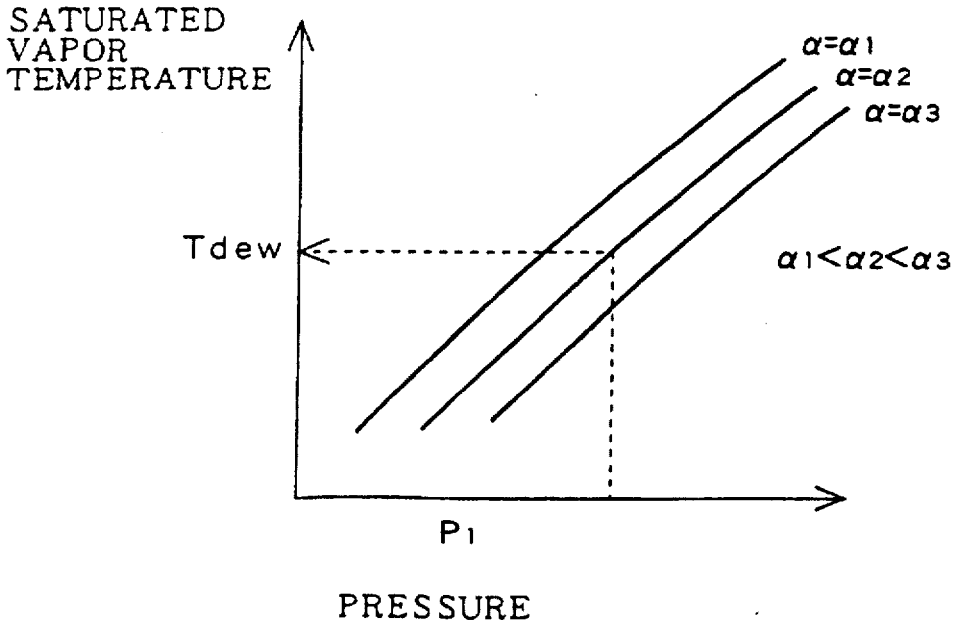
FIG. 47 is an explanatory diagram for the illustration of the operation of the composition computing unit of a control-information detecting apparatus for a refrigeration air-conditioner using a non-azeotrope refrigerant according to the embodiment 16 by using the relationships among the saturated vapor temperatures and the pressures of a non-azeotrope refrigerant and circulation compositions.
Figure 48:
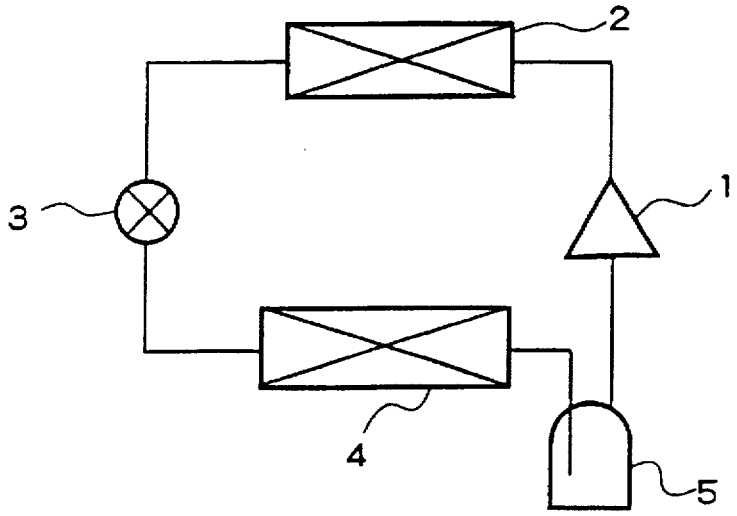
FIG. 48 (PRIOR ART)
FIG. 48 is a block diagram showing the construction of a conventional refrigeration air-conditioner using a non-azeotrope refrigerant.

The degrees of opening of the electric expansion valves of the first decompressing devices 3 are controlled so that the degrees of superheating at the exits of the indoor heat exchangers 40 become a predetermined value, for example, 5° C. The degrees of superheating can be obtained as the differences between the saturated vapor temperatures at the pressures in the indoor heat exchangers 40 and the temperatures at the exits of the indoor heat exchangers 40, and the saturated vapor temperatures can be obtained as the functions of pressures and circulation compositions as shown in FIG. 47. Accordingly, by memorizing the relationships shown in FIG. 47 in the control unit 21 as the relational formula (6), the unit 21 can compute the saturated vapor temperature Tdew and the degree of superheating (T5–Tdew) at the exits of the indoor heat exchangers 40 by using the relational formula (6) on the circulation composition a transmitted from the composition computing unit 20, the pressure signal P1 transmitted from the first pressure detector 12, and the temperature signal T5 transmitted from the fourth temperature detector 43.

$$Tdew=f6(P1, \alpha) \quad (6)$$

The control unit 21 further computes modifying values to the degrees of opening of the electric expansion valves of the first decompressing devices 3 in accordance with the difference between the degree of supercooling at the exits and a predetermined value (5° C.) by using a feedback control such as the PID control to output commands of the degrees of opening of the electric expansion valves to the first decompressing devices 3.

Since the control of the degree of opening of the second decompressing device 120 is similar to that at the time of the operation of air heating, the description thereof is omitted. Next, the operation of the comparator 22 will be described. The comparator 22 takes therein circulation composition signals from the composition computing unit 20 to judge whether the circulation compositions are within a previously memorized appropriate circulation composition range or not. The operation of the refrigeration air-conditioner is continued as it is if the circulation composition is in the appropriate circulation composition range. On the other hand, if the circulation composition has changed owing to the leakage of the refrigerant during the operation of the air-conditioner, or if the circulation composition has changed owing to an error operation at the time of filling up the refrigerant, the comparator 22 judges that the circulation composition is out of the previously memorized appropriate circulation composition range to transmit a warning signal to the warning device 23. The warning device 23 having received the warning signal sends out a warning for a predetermined time for warning the operator that the circulation composition of the non-azeotrope refrigerant of the air-conditioner is out of the appropriate range.

The present embodiment controls the number of revolutions of the outdoor blower 33 so that the values detected by the first pressure detector 12 accord with the desired value of the evaporation pressure, which is computed from the circulation composition, but similar effects can be obtained by providing a temperature detector at the entrance of the outdoor heat exchanger 32 and controlling so that the temperature detected by the temperature detector becomes a predetermined value (for example 0° C.).

The embodiment controls the degrees of opening of the electric valves of the first decompressing devices 3 at the time of the operation of air cooling so that the degrees of superheating at the exits of the indoor heat exchangers 40 become a predetermined value (for example 5° C.), but similar effects can be obtained also by controlling them so that the differences between the temperatures at the entrances and the temperatures at the exits of the indoor heat exchangers 40 become a predetermined value (for example 10° C.), that is to say, so that the temperature differences between the temperatures detected by the fourth temperature detectors 43 and the temperatures detected by the third temperature detectors 42 become the predetermined value.

The air-conditioner of the embodiment has one outdoor unit 30 and two indoor units 40 connected to the outdoor unit 30, but the number of the indoor units 40 is not restricted to two. Similar effects can be obtained also by connecting only one indoor unit or three indoor units or more to the outdoor unit.

It will be appreciated from the foregoing description that, according to the first aspect of the present invention, the control-information detecting apparatus for a refrigeration air-conditioner using a non-azeotrope refrigerant is constructed so as to input the pressure and the temperature of the refrigerant at the entrance of the evaporator in the refrigerating cycle of the air-conditioner into the composition computing unit of the apparatus, which unit computes the composition of the refrigerant with the composition computing unit on the assumption that the dryness of the refrigerant flowing into the evaporator is a prescribed value, and consequently, the apparatus, which is constructed simply, can detect the circulation composition of the refrigerant for determining the control values of the compressor, the decompressing device, and so forth of the air-conditioner in accordance with the composition of the refrigerant. Thereby, the air-conditioner can be controlled to be the optimum condition thereof even if the circulation composition of the refrigerant has changed.

Furthermore, according to the second aspect of the present invention, the control-information detecting apparatus for a refrigeration air-conditioner using a non-azeotrope refrigerant is constructed so as to detect the temperature and the pressure of the refrigerant at the entrance of the evaporator of the air-conditioner and the temperature of the refrigerant at the exit of the condenser thereof for computing these detected values with the composition computing unit of the apparatus to output them, and consequently, the control values of the compressor, the decompressing device, and so forth of the air-conditioner can be determined in accordance with the circulation composition of the refrigerant. Thereby, the air-conditioner can be controlled to be the optimum condition thereof even if the circulation composition of the refrigerant has changed.

Furthermore, according to the third aspect of the present invention, the control-information detecting apparatus for a refrigeration air-conditioner using a non-azeotrope refrigerant is constructed so that the comparison operation means of the apparatus generates a warning signal when the composition of the refrigerant detected by the composition computing unit thereof is out of a predetermined range, and that the warning means thereof operates on the waning signal generated by the comparison operation means, and consequently, when the composition of the refrigerant is out of the prescribed range, the fact can immediately be known.

Furthermore, according to the fourth aspect of the present invention, the control-information detecting apparatus for a refrigeration air-conditioner using a non-azeotrope refrigerant is constructed so as to detect the temperature and the pressure of the refrigerant in the accumulator of the air-conditioner or of the refrigerant between the accumulator and the suction pipe of the condenser thereof with the temperature detector and the pressure detector of the apparatus respectively, and to compute the composition of the refrigerant with the composition computing unit thereof on the assumption that the dryness of the refrigerant flowing into the evaporator of the air-conditioner is a prescribed value, and consequently, the apparatus, which is constructed simply, can detect the change of the circulation composition of the refrigerant for determining the control values of the compressor, the decompressing device, and so forth of the air-conditioner in accordance with the circulation composition of the refrigerant. Thereby, the air-conditioner can be controlled to be the optimum condition thereof even if the circulation composition of the refrigerant has changed.

Furthermore, according to the fifth aspect of the present invention, the control-information detecting apparatus for a refrigeration air-conditioner using a non-azeotrope refrigerant is constructed so as to detect the liquid level in the accumulator of the air-conditioner with the liquid level detector of the apparatus to input the detected signals into the composition computing unit thereof for computing the composition of the refrigerant on the relationships, having been previously investigated, between the liquid levels and the circulation compositions with the composition computing unit, and consequently, the air-conditioner can be controlled to be the optimum condition thereof with the simply constructed control-information detecting apparatus even if the circulation composition of the refrigerant has changed.

Furthermore, according to the sixth aspect of the present invention, the control-information detecting apparatus for a refrigeration air-conditioner using a non-azeotrope refrigerant is constructed so as to compute the composition of the refrigerant by providing a first temperature detector and a pressure detector on a bypass pipe provided so as to connect the pipe between the first heat exchanger of the air-conditioner and the first decompressing device thereof to the suction pipe of the compressor thereof with a second decompressing device between them, and consequently, the downstream side of the second decompressing device is always in a low pressure two-phase state in such a construction, and thereby the composition of the refrigerant can be known from the temperatures and the pressures detected with the same temperature detector and the pressure detector in both cases of air cooling and air heating.

Furthermore, according to the seventh aspect of the present invention, the control-information detecting apparatus for a refrigeration air-conditioner using a non-azeotrope refrigerant is constructed so as to compute the composition of the refrigerant by providing a first and a second temperature detectors and a pressure detector on a bypass pipe provided so as to connect the pipe between the first heat exchanger of the air-conditioner and the first decompressing device thereof to the suction pipe of the compressor thereof with a second decompressing device between them, and consequently, the downstream side of the second decompressing device is always in a low pressure two-phase state, and thereby the composition of the refrigerant can be known from the temperatures and the pressures detected with the same temperature detector and the pressure detector in both cases of air cooling and air heating.

Furthermore, according to the eighth aspect of the present invention, the control-information detecting apparatus for a refrigeration air-conditioner using a non-azeotrope refrigerant is constructed so as to convey the enthalpy of the refrigerant flowing in the bypass pipe of the air-conditioner to the refrigerant flowing the main pipe thereof by forming a heat exchanging section on the bypass pipe, and consequently, a control-information detecting apparatus for the refrigeration air-conditioner, which can prevent energy loss, can be obtained.

Furthermore, according to the ninth aspect of the invention, the control-information detecting apparatus for a refrigeration air-conditioner using a non-azeotrope refrigerant is constructed so as to compute the composition of the refrigerant circulating through the refrigerating cycle of the air-conditioner on the signals having been detected by the temperature detector and the pressure detector of the apparatus, and consequently, the apparatus can exactly detect the circulation composition in the refrigerating cycle even if the circulation composition has changed owing to the change of the operation condition or the load condition of the air-conditioner, or even if the circulation composition has changed owing to the leakage of the refrigerant during the operation thereof or an operational error at the time of filling up the refrigerant.

Furthermore, according to the tenth aspect of the present invention, the control-information detecting apparatus for a refrigeration air-conditioner using a non-azeotrope refrigerant is constructed so as to exchange heat between the high pressure side and the low pressure side of the bypass pipe of the air-conditioner as a method for cooling the bypass pipe, and consequently, a control-information detecting apparatus for the refrigeration air-conditioner shaped in a compact form can be obtained.

Furthermore, according to the eleventh aspect of the present invention, the control-information detecting apparatus for a refrigeration air-conditioner using a non-azeotrope refrigerant is constructed so as to compute the composition of the refrigerant circulating through the refrigerating cycle of the air-conditioner on the signals having been detected by the first and the second temperature detectors and the pressure detector of the apparatus with the composition computing unit thereof, and consequently, the apparatus can exactly detect the circulation composition in the refrigerating cycle even if the circulation composition has changed owing to the change of the operation condition or the load condition of the air-conditioner, or even if the circulation composition has changed owing to the leakage of the refrigerant during the operation thereof or an operational error at the time of filling up the refrigerant.

Furthermore, according to the twelfth aspect of the present invention, the control-information detecting apparatus for a refrigeration air-conditioner using a non-azeotrope refrigerant is constructed so as to computes the composition of the refrigerant circulating through the refrigerating cycle of the air-conditioner on the signals having been detected by the three temperature detectors or more and the pressure detector of the apparatus for detecting the temperatures and the pressure of the refrigerant on the high pressure side of the bypass pipe of the air-conditioner respectively, and consequently, the apparatus can exactly detect the circulation composition in the refrigerating cycle even if the circulation composition has changed owing to the change of the operation condition or the load condition of the air-conditioner, or even if the circulation composition has changed owing to the leakage of the refrigerant during the operation thereof or an operational error at the time of filling up the refrigerant.

Furthermore, according to the thirteenth aspect of the present invention, the control-information detecting apparatus for a refrigeration air-conditioner using a non-azeotrope refrigerant is constructed so as to compute the composition of the refrigerant circulating through the refrigerating cycle of the air-conditioner on the signals having been detected by the three temperature detectors or more and the pressure detector of the apparatus for detecting the temperatures and the pressure of the refrigerant on the low pressure side of the bypass pipe of the air-conditioner respectively, and consequently, the apparatus can exactly detect the circulation composition in the refrigerating cycle even if the circulation composition has changed owing to the change of the operation condition or the load condition of the air-conditioner, or even if the circulation composition has changed owing to the leakage of the refrigerant during the operation thereof or an operational error at the time of filling up the refrigerant.

While preferred embodiments of the present invention have been described using specific terms, such description is for illustrative purposes only, and it is to be understood that changes and variations may be made without departing from the spirit or scope of the following claims.

What is claimed is:

1. A control-information detecting apparatus for a refrigeration air-conditioner using a non-azeotrope refrigerant as a refrigerant thereof; the air-conditioner having a refrigerating cycle composed by connecting a compressor, a condenser, a decompressing device, an evaporator, and an accumulator; said apparatus comprising:

a liquid level detector for detecting a liquid level in said accumulator, and a composition computing unit for computing a composition of the refrigerant circulating through said refrigerating cycle on a signal detected by said liquid level detector.

2. The control-information detecting apparatus for a refrigeration air-conditioner using a non-azeotrope refrigerant according to claim 1, which apparatus further comprises:

a comparison operation means for generating a warning signal when the composition of the refrigerant computed by said composition computing unit is out of a predetermined range, and a warning means operating on a warning signal generated by said comparison operation means.

* * * * *